US009034551B2

(12) United States Patent
Endo et al.

(10) Patent No.: US 9,034,551 B2
(45) Date of Patent: May 19, 2015

(54) TWO-COMPONENT DEVELOPER

(75) Inventors: Tomoko Endo, Odawara (JP); Koh Ishigami, Mishima (JP); Naoki Okamoto, Mishima (JP); Yoshinobu Baba, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 508 days.

(21) Appl. No.: 12/864,447

(22) PCT Filed: Mar. 10, 2009

(86) PCT No.: PCT/JP2009/054980

§ 371 (c)(1),
(2), (4) Date: Jul. 23, 2010

(87) PCT Pub. No.: WO2009/113700

PCT Pub. Date: Sep. 17, 2009

(65) Prior Publication Data

US 2010/0310978 A1 Dec. 9, 2010

(30) Foreign Application Priority Data

Mar. 11, 2008 (JP) ..... 2008-061053
Aug. 6, 2008 (JP) ..... 2008-202696

(51) Int. Cl.
*G03G 9/107* (2006.01)
*G03G 9/08* (2006.01)
(Continued)

(52) U.S. Cl.
CPC ..... *G03G 9/107* (2013.01); *G03G 9/0819* (2013.01); *G03G 9/0827* (2013.01); *G03G 9/10* (2013.01); *G03G 9/1075* (2013.01); *G03G 9/113* (2013.01); *G03G 9/1133* (2013.01)

(58) Field of Classification Search
CPC ..... G03G 9/1075; G03G 9/107; G03G 9/10; G03G 9/1136
USPC ..... 430/110.3, 111.3, 111.31, 111.32, 430/111.35
See application file for complete search history.

(56) References Cited

U.S. PATENT DOCUMENTS 4,873,551 A * 10/1989 Tajima et al. ..... 399/270
5,104,761 A * 4/1992 Saha et al. ..... 430/111.31
(Continued)

FOREIGN PATENT DOCUMENTS

EP 0 693 712 A1 1/1996
EP 0801335 A1 * 10/1997
(Continued)

OTHER PUBLICATIONS

Donald et al. IEEE Transactions on Electron Devices, vol. Ed-19, No. 4, pp. 458-462, Apr. 1972.*
(Continued)

*Primary Examiner* — Peter Vajda
*Assistant Examiner* — Olatunji Godo
(74) *Attorney, Agent, or Firm* — Fitzpatrick, Cella, Harper and Scinto

(57) ABSTRACT

Provided is a two-component developer containing: a magnetic carrier obtained by coating a magnetic core with a resin; and toner, in which: the magnetic core contains at least a ferrite component and at least one kind of an oxide selected from the group consisting of $SiO_2$ and $Al_2O_3$; the content of the oxide is 4.0 mass % or more and 40.0 mass % or less with respect to the magnetic core; the magnetic core has a specific resistance of $5.0\times10^4$ Ω·cm or more and $5.0\times10^8$ Ω·cm or less at the time of the application of 1,000 V/cm; the magnetic carrier has an intensity of magnetization in 79.6 kA/m of 40.0 $Am^2/kg$ or more and 65.0 $Am^2/kg$ or less, and a residual magnetization after the application of an external magnetic field of 79.6 kA/m of 3.0 $Am^2/kg$ or less; and the toner has a weight-average particle diameter (D4) of 3.0 μm or more and 10.0 μm or less and an average circularity of 0.940 or more and 0.990 or less.

9 Claims, 8 Drawing Sheets

(51) Int. Cl.
*G03G 9/10* (2006.01)
*G03G 9/113* (2006.01)

(56) References Cited

U.S. PATENT DOCUMENTS

| | | | | |
|---|---|---|---|---|
| 5,494,770 | A | 2/1996 | Baba et al. | 430/122 |
| 5,652,079 | A | 7/1997 | Mochizuki et al. | |
| 5,795,693 | A * | 8/1998 | Okado et al. | 430/109.4 |
| 5,876,893 | A | 3/1999 | Ochiai et al. | |
| 6,026,260 | A * | 2/2000 | Aita et al. | 399/175 |
| 7,252,919 | B2 | 8/2007 | Suzuki et al. | |
| 7,452,651 | B2 | 11/2008 | Hotta et al. | |
| 7,476,482 | B2 | 1/2009 | Iinuma et al. | |
| 7,566,519 | B2 | 7/2009 | Kobayashi et al. | |
| 2004/0038144 | A1 * | 2/2004 | Hultman et al. | 430/111.31 |
| 2004/0229151 | A1 * | 11/2004 | Kobayashi et al. | 430/111.32 |
| 2006/0269862 | A1 | 11/2006 | Kobayashi et al. | |
| 2007/0048650 | A1 * | 3/2007 | Inoue et al. | 430/111.33 |
| 2009/0047592 | A1 * | 2/2009 | Okamoto et al. | 430/109.3 |
| 2009/0123856 | A1 | 5/2009 | Hotta et al. | 430/106.1 |
| 2009/0246675 | A1 | 10/2009 | Nakamura et al. | 430/111.31 |
| 2009/0258311 | A1 | 10/2009 | Nakao et al. | |
| 2010/0143833 | A1 | 6/2010 | Baba et al. | 430/106.2 |

FOREIGN PATENT DOCUMENTS

| | | | |
|---|---|---|---|
| JP | 6-208254 | A | 7/1994 |
| JP | 8-6302 | A | 1/1996 |
| JP | 8-234501 | A | 9/1996 |
| JP | 9-281805 | A | 10/1997 |
| JP | 11-242362 | A | 9/1999 |
| JP | 2002-091090 | A | 3/2002 |
| JP | 2004-302408 | A | 10/2004 |
| JP | 2005-162597 | A | 6/2005 |
| JP | 2005-181944 | A | 7/2005 |
| JP | 2005-352473 | A | 12/2005 |
| JP | 2006-030263 | A | 2/2006 |
| JP | 2006-154806 | A | 6/2006 |
| JP | 2006-195079 | A | 7/2006 |
| JP | 2006-337579 | A | 12/2006 |
| JP | 2007-034249 | A | 2/2007 |
| JP | 2007-057943 | A | 3/2007 |
| JP | 2007-218955 | A | 8/2007 |
| JP | 2007-279588 | A | 10/2007 |
| JP | 2008-065106 | A | 3/2008 |
| JP | 2008-249899 | A | 10/2008 |
| WO | WO 2007138912 | A1 * | 12/2007 |

OTHER PUBLICATIONS

European Search Report dated Sep. 24, 2012 in European Application No. 09720492.9.

* cited by examiner

VOID PORTION

TWO-COMPONENT DEVELOPER

TECHNICAL FIELD

The present invention relates to a two-component developer containing toner and a magnetic carrier to be used in each of an electrophotographic method and an electrostatic recording method.

BACKGROUND ART

Electrophotographic developing systems are classified into a one-component developing system involving the use of toner alone and a two-component developing system involving the use of a mixture of toner and a magnetic carrier.

The two-component developing system provides a stable triboelectric charging characteristic and is advantageous for maintaining high image quality over a long time period as compared to the one-component developing system because of the following reason: the two-component developing system involves the use of the magnetic carrier, and hence the magnetic carrier often undergoes triboelectric charging with the toner. In addition, the two-component developing system is often used particularly in a high-speed machine because the magnetic carrier shows a high ability to feed the toner to a developing zone.

An iron powder or a heavy metal-based ferrite carrier has been conventionally used as a magnetic carrier for the two-component developing system. However, any such magnetic carrier is apt to cause the deterioration of a developer such as toner spent to the magnetic carrier or the deterioration of toner due to the embedment of an external additive because of the following reason: the magnetic carrier has a large specific gravity and a high magnetization, and hence a magnetic brush becomes rigid.

In view of the foregoing, a magnetic carrier with its volume magnetization specified to 20 to 60 emu/cm$^3$ (see JP 09-281805 A) and a resin-coated magnetic carrier with its average particle diameter and specified intensity of magnetization in 79.6 kA/m (1 kOe) (see JP 2002-91090 A) have been proposed for the purpose of controlling the magnetic force of a magnetic brush. Each of those proposals describes that an improvement in image quality by virtue of an improvement in dot reproducibility, and image stability over a long time period can be achieved by the following procedure: magnetic brushes on a developer carrying member are controlled so as to be soft and dense to such an extent that the adhesion of the carrier to an electrostatic latent image bearing member can be suppressed. However, when the triboelectric charge quantity of toner increases under a low-humidity environment, counter charge remaining on the magnetic carrier also increases, and hence it may become impossible to suppress the adhesion of the carrier sufficiently at the time of the application of an alternating electric field.

Meanwhile, investigations have been conducted on a resin-loaded magnetic carrier obtained by loading a resin into voids in the core of a magnetic carrier for the purpose of reducing the specific gravity of the magnetic carrier. For example, Japanese Patent Application Laid-Open No. 2007-57943 achieves the reduction in specific gravity with a magnetic carrier having the following structure: a resin is loaded into voids in a porous ferrite core characterized in that each void continuously reaches the inside of the core from the surface of the core so that a resin layer and a ferrite layer may be alternately present. However, when a starting material is non-uniform, even a magnetic carrier obtained by sufficiently loading a resin into a ferrite having voids formed of the starting material may be unable to obtain a strength enough for the magnetic carrier to withstand a stress which the magnetic carrier receives at the time of the mixing and stirring of a developer.

In view of the foregoing, Japanese Patent Application Laid-Open No. 2007-34249 proposes a magnetic carrier which has improved abrasion resistance while achieving a reduction in its specific gravity on the basis of the following procedure: a ferrite core having a fine porous structure is formed, and, furthermore, a non-magnetic oxide is incorporated into the core to impart a strength to the core.

A stress to be applied to the magnetic carrier at the time of the mixing and stirring of a developer is alleviated. In addition, the abrasion resistance of the magnetic carrier itself is improved. As a result, the magnetic carrier allows high-speed development and maintains image stability over a long time period, and the extension of the replacement life of the magnetic carrier is achieved. However, the non-magnetic oxide has a high resistance, and the resistance of the magnetic carrier eventually increases. As a result, the developer containing the magnetic carrier may be poor in developing performance particularly under a low-humidity environment, and the insufficient developing performance may lead to image defects such as blank dots.

In addition, Japanese Patent Application Laid-Open No. 2007-218955 proposes a carrier using a porous core having the following characteristics: the pore volume of the porous core is specified, the carrier core, that is, the porous core, is subjected to a resistance-increasing treatment to have a resistance high enough to suppress breakdown at the time of the application of a high voltage, and the porous core is excellent in spent resistance. The use of the carrier suppresses spent and provides a high-quality image. However, a developer containing such carrier core of which has an increased resistance may be poor in developing performance. As a result, even when an image density is sufficient, the following image defects (hereinafter referred to as "blank dots") may occur: toner at the rear end of a halftone image portion is scraped at a boundary between the halftone image portion and a solid image portion, with the result that a white stripe is formed to highlight the edge of the solid image portion. Further, when the triboelectric charge quantity of the toner is increased so that fogging may be additionally alleviated and dot reproducibility may be additionally improved, an additional improvement in developing performance is requested, and hence an improvement in developing performance based on modifications to the carrier is requested.

As described above, investigations have been conducted on a method of alleviating a stress to be applied to a magnetic carrier at the time of the mixing and stirring of a developer in order that the deterioration of the developer may be prevented, and an improvement in image quality and an increase in speed at which development is performed may be achieved. Accordingly, a two-component developer capable of satisfying developing performance and durability under various environments has been demanded.

DISCLOSURE OF THE INVENTION

Problems to be Solved by the Invention

An object of the present invention is to provide a two-component developer which: has solved such problems as described above; and can stably form high-definition images. To be specific, the object is to provide a two-component developer which: is excellent in dot reproducibility; does not cause the adhesion of a carrier; has high developing performance under various environments; has a sufficient image density; and can maintain these characteristics even after a durability test.

Means for Solving the Problems

The constitution of the present invention that solves the above-mentioned problems is as described below.

That is, the present invention provides a two-component developer including: a magnetic carrier obtained by coating a magnetic core with a resin; and toner, in which: the magnetic core contains at least a ferrite component and at least one kind of an oxide selected from the group consisting of $SiO_2$ and $Al_2O_3$; a content of the oxide is 4.0 mass % or more and 40.0 mass % or less with respect to the magnetic core; the magnetic core has a specific resistance of $5.0\times10^4$ Ω·cm or more and $5.0\times10^8$ Ω·cm or less at a time of application of 1,000 V/cm under the following measurement conditions; the magnetic carrier has an intensity of magnetization in 79.6 kA/m of 40.0 $Am^2/kg$ or more and 65.0 $Am^2/kg$ or less, and a residual magnetization after application of an external magnetic field of 79.6 kA/m of 3.0 $Am^2/kg$ or less; and the toner has a weight-average particle diameter (D4) of 3.0 μm or more and 10.0 μm or less and an average circularity of 0.940 or more and 0.990 or less:

Measurement Conditions:

upper and lower portions in a cylindrical resin container having a measuring space with a sectional area of 2.4 $cm^2$ are provided with upper and lower electrodes each having a measuring surface identical in shape to a sectional shape of the measuring space, 0.7 g of the magnetic core is loaded into a gap between the upper and lower electrodes, and the loaded magnetic core is subjected to measurement while being sandwiched between the upper and lower electrodes at a pressure of 50 $g/cm^2$.

Effects of the Invention

According to a preferred embodiment of the present invention, there can be provided a two-component developer which: is excellent in dot reproducibility; does not cause the adhesion of a carrier; has high developing performance under various environments; does not cause image defects such as blank dots; has a sufficient image density; can maintain these characteristics even after a durability test; and can stably form high-definition images.

BRIEF DESCRIPTION OF THE DRAWINGS

FIG. 6(*a*) illustrates a blank state and FIG. 6(*b*) illustrates a state where a sample is loaded.

DESCRIPTION OF SYMBOLS

Figure 1:
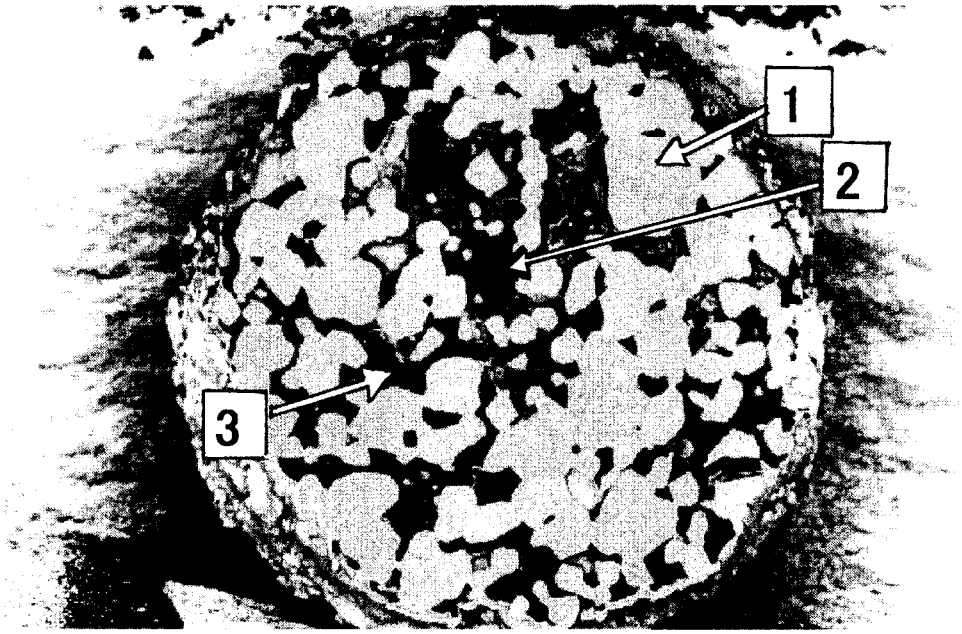
FIG. 1 is an SEM reflected electron image of an $SiO_2$-containing magnetic core used in the present invention.

1 . . . ferrite component
2 . . . $SiO_2$ component
3 . . . void portion
4 . . . length of connecting phase which can be specified with straight line
5 . . . maximum diameter of magnetic core
6 . . . resin container
7 . . . lower electrode
8 . . . supporting base
9 . . . upper electrode
10 . . . sample
11 . . . electrometer
12 . . . computer
A . . . resistance-measuring cell
d . . . sample thickness

BEST MODE FOR CARRYING OUT THE INVENTION

The inventors of the present invention have made extensive studies with a view to solving the above-mentioned problems in a two-component developer. As a result, the inventors have found that the developing performance of the developer can be improved by controlling the specific resistance of a magnetic core on condition that an appropriate amount of a non-magnetic, low-specific-gravity component is incorporated into the magnetic core.

In addition, the inventors have found that, when the magnetic properties of a magnetic carrier obtained by coating the magnetic core with a resin are appropriately controlled, the adhesion of the carrier can be suppressed, the dot reproducibility of the developer can be improved, and a stress to be applied to the carrier at the time of the mixing and stirring of the developer can be alleviated.

Further, the inventors have found the following: when the particle diameter and shape of each particle of toner are controlled and the magnetic carrier in the present invention is used in combination with the toner in order that the dot reproducibility may be improved, high developing performance can be achieved even though the toner has high triboelectric charging performance, and hence an effect on fogging can be additionally improved.

As a result of the foregoing, the inventors have found that, when the two-component developer of the present invention is used, the two-component developer has high developing performance under various environments, is free of image defects such as blank dots, has a sufficient image density, can maintain these characteristics even after a durability test, and can stably form high-definition images. Hereinafter, the present invention will be described in detail.

The two-component developer of the present invention has a feature of including: a magnetic carrier obtained by coating a magnetic core with a resin; and toner, in which: the magnetic core contains at least a ferrite component and at least one kind of an oxide selected from the group consisting of $SiO_2$ and $Al_2O_3$; a content of the oxide is 4.0 mass % or more and 40.0 mass % or less with respect to the magnetic core; the magnetic core has a specific resistance of $5.0\times10^4$ Ω·cm or more and $5.0\times10^8$ Ω·cm or less at a time of application of 1,000 V/cm under the following measurement conditions; the magnetic carrier has an intensity of magnetization in 79.6 kA/m of 40.0 $Am^2$/kg or more and 65.0 $Am^2$/kg or less, and a residual magnetization after application of an external magnetic field of 79.6 kA/m of 3.0 $Am^2$/kg or less; and the toner has a weight-average particle diameter (D4) of 3.0 μm or more and 10.0 μm or less and an average circularity of 0.940 or more and 0.990 or less:

Measurement Conditions:

upper and lower portions in a cylindrical resin container having a measuring space with a sectional area of 2.4 $cm^2$ are provided with upper and lower electrodes each having a measuring surface identical in shape to a sectional shape of the measuring space, 0.7 g of the magnetic core is loaded into a gap between the upper and lower electrodes, and the loaded magnetic core is subjected to measurement while being sandwiched between the upper and lower electrodes at a pressure of 50 g/$cm^2$.

As described above, the magnetic core to be used in the present invention contains at least one ferrite component, and at the same time, at least one oxide (hereinafter referred to as non-magnetic, low-specific-gravity component) selected from the group consisting of $SiO_2$ and $Al_2O_3$, whereby the oxide, that is, the content of $SiO_2$ or $Al_2O_3$, or $SiO_2$ and $Al_2O_3$ (hereinafter also referred to as $SiO_2$ and/or $Al_2O_3$), is 4.0 mass % or more and 40.0 mass % or less with respect to the magnetic core. It should be noted the case where both $SiO_2$ and $Al_2O_3$ are included is possible as long as the total content is within the above-mentioned range.

Setting the content of the non-magnetic, low-specific-gravity component and the specific resistance of the magnetic core within the above ranges can achieve a reduction in specific gravity of the magnetic carrier and high developing performance. The reason for the foregoing is as described below. The ferrite component as a low-resistance phase in the magnetic core has a distorted current path owing to the presence of $SiO_2$ and/or $Al_2O_3$ as the non-magnetic, low-specific-gravity component and as a high-resistance phase. In addition, the ratio of the low-resistance phase reduces, and hence the resistance of the magnetic carrier is increased in the absence of an electric field, and a triboelectric charge quantity obtained by friction between the carrier and the toner can be maintained at a high level. On the other hand, a sufficient current can flow in the ferrite phase as the low-resistance phase when a developing bias is applied, and hence the resistance of the carrier abruptly reduces. As a result, an electrode effect of the carrier may be achieved, in other words, the developing performance may be improved. In addition, the expression of sufficient developing performance can fill charge on an electrostatic latent image with the charge of the toner. Further, the resistance of the carrier reduces at the time of the application of a developing electric field, and hence counter charge remaining on the surface of the magnetic carrier generated by the development of the toner immediately attenuates, and the pullback of the toner can be suppressed. Blank dots may be prevented via such mechanism.

When the content of $SiO_2$ and/or $Al_2O_3$ in the magnetic core exceeds 40.0 mass %, the amount of the ferrite phase as the low-resistance phase of the magnetic core reduces, with the result that the specific resistance of the magnetic core increases, and the developing performance deteriorates. Further, blank dots become remarkable.

On the other hand, when the content of $SiO_2$ and/or $Al_2O_3$ is less than 4.0 mass %, the current path of the ferrite phase as the low-resistance phase of the magnetic core is not distorted, and, furthermore, the specific resistance of the magnetic carrier reduces. As a result, the resistance of the magnetic carrier is apt to undergo breakdown at the time of the application of a developing bias. Accordingly, the developing bias injects charge into part of a latent image potential through the magnetic carrier to disturb the latent image, thereby reducing the dot reproducibility. In addition, the injection of charge onto an electrostatic latent image bearing member reduces a fogging removing voltage (Vback), and hence a sufficient Vback cannot be obtained, and fogging is apt to occur. Further, the adhesion of the magnetic carrier to the electrostatic latent image bearing member may occur owing to the injection of charge into the carrier itself. Further, a reduction in resistance of the magnetic carrier in the absence of an electric field may inhibit the maintenance of the triboelectric charge quantity obtained by friction between the carrier and the toner.

It should be noted that the above content of $SiO_2$ and/or $Al_2O_3$ is preferably 10 mass % or more and 35 mass % or less, or more preferably 15 mass % or more and 30 mass % or less with respect to the magnetic core.

In addition, the above magnetic core must have a specific resistance of $5.0\times10^4$ Ω·cm or more and $5.0\times10^8$ Ω·cm or less at the time of the application of 1,000 V/cm under the following measurement conditions.

Measurement Conditions:

The upper and lower portions in a cylindrical resin container having a measuring space with a sectional area of 2.4 $cm^2$ are provided with upper and lower electrodes each having a measuring surface identical in shape to the sectional shape of the measuring space, 0.7 g of the magnetic core is loaded into a gap between the upper and lower electrodes, and the loaded magnetic core is subjected to measurement while being sandwiched between the upper and lower electrodes at a pressure of 50 g/$cm^2$.

When the above magnetic core has a specific resistance of $5.0\times10^4$ Ω·cm or more and $5.0\times10^8$ Ω·cm or less at the time of the application of 1,000 V/cm, particularly in the case where the magnetic core is coated with a resin before use, counter charge remaining on the resultant magnetic carrier can be easily caused to escape, and hence the developing performance of the developer is improved, and a high image density can be easily obtained. In addition, an edge is not highlighted at a boundary between a halftone portion and a solid portion, and the occurrence of blank dots due to the peeling of the toner at the halftone portion toward the solid portion can be suppressed.

When the above magnetic core has a specific resistance of less than $5.0\times10^4$ Ω·cm at the time of the application of 1,000 V/cm, even if the magnetic core is coated with a resin, partial leakage of charge is inevitable, and hence charge is injected onto an electrostatic latent image bearing member to reduce the dot reproducibility, and the triboelectric charge quantity of the toner cannot be maintained in some cases.

The presence of the phase composed of $SiO_2$ and/or $Al_2O_3$ as the high-resistance phase in, and on the surface of, the magnetic core can reduce the resistance of the ferrite phase as the low-resistance phase. Accordingly, it is important to cause the phase composed of $SiO_2$ and/or $Al_2O_3$ to exist so that the resultant specific resistance of the magnetic core may be $5.0\times10^4$ Ω·cm or more and $5.0\times10^8$ Ω·cm or less. The resistance of the magnetic core can be appropriately controlled depending on, for example, the composition of the ferrite, the grain sizes and grain size distribution of the ferrite before firing, a temperature and an atmosphere at the time of the firing, an oxidation treatment or reduction treatment, and the grain sizes, grain size distribution, and addition amount of $SiO_2$ and/or $Al_2O_3$.

The intensity of magnetization of the magnetic carrier to be used in the two-component developer of the present invention in 79.6 kA/m (1 kOe) is 40.0 $Am^2/kg$ or more and 65.0 $Am^2/kg$ or less, and the residual magnetization after application of an external magnetic field of 79.6 kA/m is 0.0 $Am^2/kg$ or more and 3.0 $Am^2/kg$ or less. More preferably, the intensity of magnetization of the magnetic carrier in 79.6 kA/m is 45.0 $Am^2/kg$ or more and 60.0 $Am^2/kg$ or less, and the residual magnetization after application of an external magnetic field of 79.6 kA/m is 2.0 $Am^2/kg$ or less.

Setting the magnetic properties of the magnetic carrier within the above ranges can: impart excellent dot reproducibility to the developer; achieve the prevention of the adhesion of the carrier; and alleviate a stress to be applied to the magnetic carrier. As a result, the developing performance and durability of the developer under various environments can be improved.

When the intensity of magnetization of the magnetic carrier in 79.6 kA/m exceeds 65.0 $Am^2/kg$, magnetic brushes become hard and coarse, with the result that the dot reproducibility reduces. Further, the deterioration of the toner may be accelerated by the packing of the developer at a toner layer control portion.

On the other hand, when the intensity of magnetization in 79.6 kA/m is less than 40.0 $Am^2/kg$, it becomes difficult to prevent the adhesion of the carrier to a latent image bearing member.

On the other hand, when the residual magnetization exceeds 3.0 $Am^2/kg$, the agglomeration of particles of the magnetic carrier by magnetization occurs at a position distant from the magnetic field of a developer carrying member. As a result, the surface area of the carrier with respect to the toner reduces, and hence a sufficient triboelectric charge quantity cannot be provided for the toner, and fogging occurs in some cases. It should be noted that the above magnetic properties of the magnetic carrier can be adjusted to fall within the above ranges by properly selecting the composition of the ferrite and controlling a firing temperature and a firing environment, and the addition amount of $SiO_2$ and/or $Al_2O_3$. In particular, the incorporation of Mn can suitably establish a balance between desired magnetic properties and a desired resistance characteristic.

The toner used in the two-component developer of the present invention has a weight-average particle diameter (D4) of 3.0 μm or more and 10.0 μm or less and an average circularity of 0.940 or more and 0.990 or less, or more preferably has a weight-average particle diameter (D4) of 4.0 μm or more and 8.0 μm or less and an average circularity of 0.950 or more and 0.985 or less.

Setting the weight-average particle diameter and average circularity of the toner within the above ranges can achieve excellent dot reproducibility and high developing performance under various environments when the toner is used in combination with the magnetic carrier in the present invention. When the weight-average particle diameter of the toner is small, or the average circularity of the toner is low, triboelectric charge or charge due to the application of a developing bias is apt to converge on an edge of each toner particle, and hence the magnetic carrier used in the present invention is apt to receive charge injected from the low-resistance phase. As a result, a variation in charge quantity such as a partial increase in charge quantity occurs, and may be responsible for poor developing performance or fogging. Compatibility between an increase in charge quantity of the toner and developing performance with which highly charged toner can be sufficiently developed can be achieved by setting the average circularity of the toner to a desired value and moderately distributing the low-resistance phase of the magnetic carrier. Further, such control of the shape of the toner as described above inhibits the deterioration of the developer such as toner spent to the magnetic carrier or the deterioration of the toner due to the embedment of an external additive, and enables the maintenance of the developing performance at a high level even in the case of duration output.

When the weight-average particle diameter (D4) of the toner exceeds 10.0 μm, the developing performance becomes good, but the charge quantity of the toner is apt to reduce, and the dot reproducibility reduces, and hence a high-definition image is hardly obtained. On the other hand, when the weight-average particle diameter is less than 3.0 μm, as described above, the surface area of the toner increases, and the triboelectric charge quantity distribution of the toner becomes wide, and hence the developing performance may reduce even in the case where the magnetic carrier of the present invention is used. It should be noted that, when the toner is produced by a kneading pulverization method, the above weight-average particle diameter of the toner can be controlled depending on, for example, a pulverization condition and a classification condition. In addition, when the toner is produced by a polymerization method, the weight-average particle diameter can be adjusted to fall within the above range depending on the concentration of a dispersion stabilizer and a stirring condition at the time of granulation.

In addition, when the average circularity of the toner is less than 0.940, as described above, the developing performance may reduce even in the case where the magnetic carrier of the present invention is used. In addition, the specific surface area of the toner increases, and a site where the external additive weakly adheres to the toner owing to the presence of a large number of edges of the toner exists. Accordingly, the migration of the toner external additive to the magnetic carrier is apt to occur, and a change in charge quantity of the toner occurs owing to duration so that the developing performance may be apt to change. When the average circularity exceeds 0.990, a developer obtained by mixing the toner and the magnetic carrier is apt to slip in the case where a developer carrying member is caused to carry the developer. Owing to the insufficient extent to which the developer carrying member carries the developer, the uniformization of an image density cannot be achieved, and a reduction in image quality occurs in some cases. In addition, the external additive is apt to be embedded, and hence, as duration output progresses, the toner deteriorates, and the developing performance reduces in some cases. It should be noted that, when the toner is produced by a kneading pulverization method, the above average circularity of the toner can be adjusted to fall within the above range by employing a method such as mechanical sphering or thermal sphering.

As a result of additional investigations, the inventors have found that the state of presence of each of the ferrite phase and the phase composed of an $SiO_2$ component and/or an $Al_2O_3$ component in the magnetic core used in the present invention contributes to the developing performance. FIG. 1 illustrates an example of an SEM reflected electron image of the section of an $SiO_2$-containing magnetic core used in an example of the present application. A ferrite component 1, an $SiO_2$ component 2, and a void portion 3 are present in FIG. 1.

The above-mentioned states of presence of the phases are specified as follows: in the image of a section of the magnetic core, the total amount of the sectional areas of at least one kind of an oxide selected from the group consisting of $SiO_2$ and $Al_2O_3$ (the $SiO_2$ component and/or the $Al_2O_3$ component) of the magnetic core accounts for preferably 2% or more and 35% or less, or more preferably 8% or more and 33% or less with reference to the area of the section of the magnetic core.

When the total amount of the sectional areas of the $SiO_2$ component and/or the $Al_2O_3$ component accounts for more than 35% with reference to the sectional area of the magnetic core, the $SiO_2$ component and/or the $Al_2O_3$ component as a non-electrification region are/is present in the ferrite component as an electrification region, and hence the number of sites where the connecting phase of the ferrite component is interrupted increases in some cases. As a result, the specific resistance of the magnetic core increases. Finally, the resistance of the magnetic carrier coated or filled with the resin increases, and the electric field intensity at which the magnetic carrier comes close to undergo breakdown also increases. Accordingly, no electrode effect can be exerted, and the developing performance reduces, and hence image defects such as blank dots occur in some cases particularly under a low-humidity environment.

On the other hand, when the total amount of the sectional areas accounts for less than 2% with reference to the sectional area of the magnetic core, the specific resistance of the magnetic core becomes low, but the number of void portions of the magnetic core must be increased in order that the need for a reduction in specific gravity of the magnetic carrier may be satisfied. In this case, the magnetic core cannot obtain a sufficient strength, and even the magnetic carrier obtained by loading the resin into the void portions cannot obtain a strength, and hence the magnetic carrier destroys during its use, and the destruction is responsible for the adhesion of the carrier in some cases. It should be noted that the above total amount of the sectional areas of the $SiO_2$ component and/or $Al_2O_3$ component of the magnetic core can be adjusted to fall within the above range by adding a desired amount of $SiO_2$ and/or $Al_2O_3$ in a particle state at the time of granulation before the final firing of the magnetic core. In addition, the weight-average particle diameter of the particles of $SiO_2$ and/or $Al_2O_3$ is preferably adjusted to 2 μm or more and 5 μm or less, and the particles used are preferably spherical because of the following reasons: the high-resistance phase mixes excellently with the ferrite component before the granulation, the state of dispersion of the high-resistance phase at the time of the melting of the high-resistance phase becomes good, a balance between the ferrite continuous phase and the high-resistance phase is established, and the resistance of the magnetic core can be easily controlled to a low value.

Figure 2:
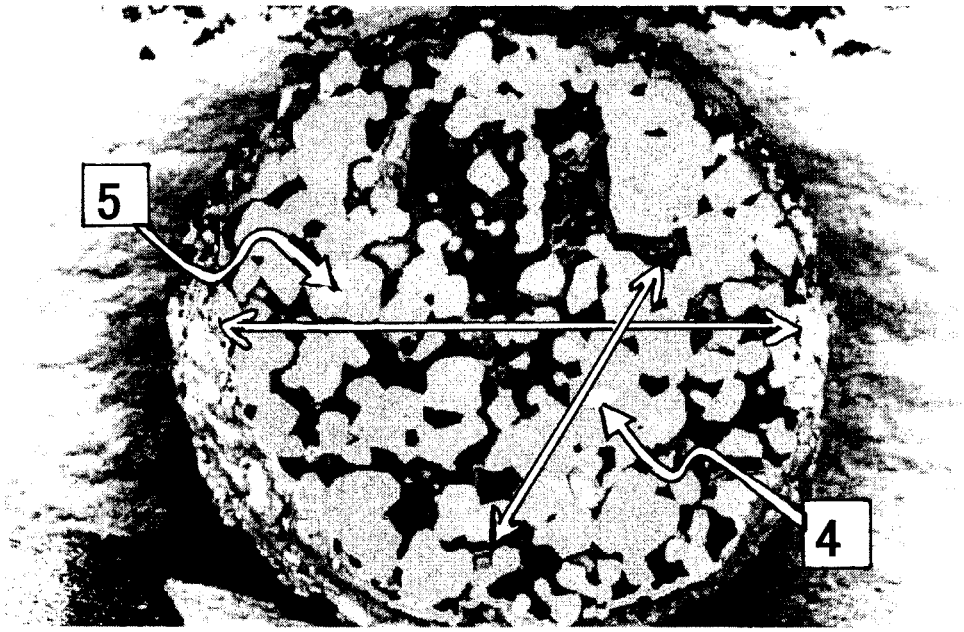
FIG. 2 is an outline view illustrating the maximum length of a connecting phase of a ferrite component and the maximum diameter of the magnetic core used in the present invention in an SEM reflected electron image of a section of the magnetic core.

In the above image of the section of the magnetic core, a ratio of the maximum length (for example, the length represented by reference numeral 4 in FIG. 2) of each connecting phase of the ferrite component which can be specified with a straight line without including an $SiO_2$ region and/or an $Al_2O_3$ region, and a void region to the maximum diameter (for example, the diameter represented by reference numeral 5 in FIG. 2) of the magnetic core, the ratio being an average obtained from the sections of ten magnetic core particles, is preferably 40% or more and 90% or less, or more preferably 50% or more and 85% or less.

The connecting phase of the ferrite component of the magnetic core is an aggregate of individual grains obtained by sintering fine particles as ferrite raw materials in a high-temperature state. The composition of each of the grains, and the state of distribution of the grains largely affect the strength and electrical characteristics of the magnetic carrier. When a ratio of the maximum length of each connecting phase to the maximum diameter of the magnetic carrier falls within the above range, the area of contact between grains is large, and adhesiveness between the grains is high. When the magnetic core has such structure, the magnetic core can satisfy a certain strength even though the magnetic core has voids. In addition, connectivity between electrification paths is high, and hence the attenuation of counter charge remaining on the magnetic carrier becomes fast, and the force by which the toner is pulled back disappears. As a result, the developing performance is improved.

It should be noted that the above average is obtained by averaging the respective values obtained from the sections of the ten magnetic core particles; when magnetic carrier particles each having a moderate connecting phase length occupy a large part of the magnetic carrier, such attenuation of the counter charge as described above can be favorably performed with no unevenness in a developing zone. The above average can be adjusted to fall within the above range by: setting the particle diameters and shapes of the $SiO_2$ and/or $Al_2O_3$ particles within desired ranges to improve the mixing performance of the particles with ferrite particles before the firing; and controlling the firing temperature and the firing environment.

The magnetic core used in the present invention preferably contains void portions in its section, and the total sum of the sectional areas of the void portions accounts for preferably 2% or more and 15% or less, or more preferably 3% or more and 10% or less with reference to the area of the section of the magnetic core. When a ratio of the total sum of the sectional areas of the void portions to the area of the section of the magnetic core falls within the above range, as long as the resin is loaded into the magnetic core before the magnetic core is used, a balance between the strength of the resultant magnetic carrier and a reduction in specific gravity of the magnetic carrier can be established. In addition, the ratio is preferably set within the above range in order that connectivity between electrification paths by the ferrite may be made moderate together with the phase composed of $SiO_2$ and/or $Al_2O_3$. The lower the extent to which an electrification path is bent, the greater the ease with which a current flows through the path; connecting bent electrification paths facilitates the occurrence of the distortion of a developing electric field, whereby the developing performance can be additionally improved. Causing the voids as well as the phase composed of $SiO_2$ and/or $Al_2O_3$ to exist can increase the degree of freedom in such formation of a bent connecting phase.

It should be noted that the above ratio of the total sum of the sectional areas of the void portions to the area of the section of the magnetic core can be adjusted to fall within the above range by using a void-forming agent, lowering the firing temperature to increase the number of void portions, or controlling the firing environment. The ratio can be adjusted to fall within the above range when the void-forming agent is used in an amount of 10 parts by mass or less with respect to 100 parts by mass in total of the ferrite component, and the $SiO_2$ component and/or the $Al_2O_3$ component. Examples of the void-forming agent include a foaming agent and a resin fine particle. Examples of the foaming agent include sodium hydrogen carbonate, potassium hydrogen carbonate, lithium hydrogen carbonate, ammonium hydrogen carbonate, sodium carbonate, potassium carbonate, lithium carbonate, and ammonium carbonate. Examples of the resin fine particle include resin fine particles each made of polyester, polystyrene, or a styrene-acrylate copolymer.

The ferrite component of the magnetic core used in the present invention preferably contains at least an Mn atom. When the ferrite component contains an Mn atom, the ease with which the specific resistance and magnetic properties of a ferrite containing a non-magnetic component such as $SiO_2$ or $Al_2O_3$ are controlled to fall within such desired ranges as described above can be improved.

Next, a method of producing the magnetic core used in the present invention is exemplified. However, the present invention is not limited to the example.

The magnetic core used in the present invention suitably contains a ferrite for reducing the true density of the magnetic core. Further, the ferrite component more suitably has voids for reducing the apparent density of the magnetic carrier. The use of a two-component developer containing a magnetic carrier containing the magnetic core can: provide good dot reproducibility; alleviate a stress to be applied to the toner to exert a preventing effect on toner spent; and alleviate a stress which the magnetic carrier receives at the time of the mixing and stirring of the developer.

A method involving adjusting a temperature at the time of firing to a low value to control the rate of the crystal growth of the ferrite component, or a method involving adding a void-forming agent such as a foaming agent or an organic fine particle can be employed as an approach to forming voids in the ferrite component.

The ferrite component used in the above magnetic core contains a sintered body represented by the following general formula: $(M1_2O)_x(M2O)_y(Fe_2O_3)_z$ (where M1 represents a monovalent metal atom, M2 represents a divalent metal, $x+y+z=1.0$, x and y each satisfy the relationship of $0\leq(x, y)\leq1.0$, and z satisfies the relationship of $0.2<z<1.0$).

In the above formula, M1 represents Li and the like, and M2 represents a metal atom selected from the group consisting of Ni, Cu, Zn, Mg, Mn, Sr, Ca, and Ba. Those metal atoms, may be used alone or plural kinds may be used in combination.

Specific examples include, a magnetic Li ferrite (such as $(Li_2O)_a(Fe_2O_3)_b$ ($0.0<a<0.4$, $0.6\leq b<1.0$, $a+b=1$)), an Mn ferrite (such as $(MnO)_a(Fe_2O_3)_b$ ($0.0<a<0.5$, $a+b=1$)), an Mn—Mg ferrite (such as $(MnO)_a(MgO)_b(Fe_2O_3)_c$ ($0.0<a<0.5$, $0.0<b<0.5$, $0.5<c<1.0$, $a+b+c=1$)), an Mn—Mg—Sr ferrite (such as $(MnO)_a(MgO)_b(SrO)_c(Fe_2O_3)_d$ ($0.0<a<0.5$, $0.0<b<0.5$, $0.0<c<0.5$, $a+b+c+d=1$)), and a CU—Zn ferrite (such as $(CuO)_a(ZnO)_b(Fe_2O_3)_c$ ($0.0<a<0.5$, $0.0<b<0.5$, $0.5\leq c<1.0$, $a+b+c=1$)). It should be noted that the above-mentioned ferrites each represent a main element and may also contain trace amounts of other metals.

An Mn ferrite, Mn—Mg ferrite, or a Mn—Mg—Sr ferrite containing an Mn element is preferable from the viewpoints of easy control of the growth rate of the crystal and easy control of the magnetic strength and specific resistance of the magnetic core.

Alternatively, the specific resistance of the magnetic core can be adjusted by thermally treating magnetic particles in an inert gas or hydrogen gas to reduce the surfaces of the magnetic particles instead of selecting the kind of a magnetic material. For example, the heat treatment can be performed under a nitrogen atmosphere at a temperature of 600 to 1,000° C.

In addition, an approach to incorporating $SiO_2$ and/or $Al_2O_3$ into the magnetic core is specifically, for example, the following method.

Raw materials for the ferrite component are blended at a target composition ratio, and are then subjected to wet mixing. After the wet mixing, the resultant is calcined so that a ferrite may be produced. After that, the ferrite is finely pulverized. A pulverizer used here is not particularly limited. Examples of the pulverizer include a crusher, a hammer mill, a ball mill, a bead mill, a planetary mill, and a jet mill. It is preferred that the ferrite be finely pulverized with a ball mill because the particle diameter of each particle can be easily controlled to a desired one.

The finely pulverized products of the ferrite preferably have a 50% particle diameter on a volume basis (D50) of 0.1 μm or more and 5 μm or less, and preferably have a 90% particle diameter on a volume basis (D90) of 3 μm or more and 10 μm or less in order that the maximum diameter and flexibility of a ferrite connecting phase based on the formation of voids or an improvement in mixing performance with $SiO_2$ and/or $Al_2O_3$ particles may be controlled. $SiO_2$ and/or $Al_2O_3$ are/is added to the resultant finely pulverized products of the ferrite. The weight-average particle diameter of $SiO_2$ and/or $Al_2O_3$ to be added is preferably 1 μm to 10 μm (more preferably 2 μm to 5 μm), and $SiO_2$ and/or $Al_2O_3$ are/is preferably added in an amount of 5 parts by mass to 45 parts by mass with respect to 100 parts by mass of the finely pulverized products of the ferrite. In addition, the shape of $SiO_2$ and/or $Al_2O_3$ is preferably spherical. The addition of spherical $SiO_2$ and/or $Al_2O_3$ particles having a weight-average particle diameter in the above range improves a state where the finely pulverized products are mixed with the particles, and facilitates the formation of voids. A void-forming agent may be used in combination with the particles for additionally facilitating the formation of the voids. The addition of $SiO_2$ and/or $Al_2O_3$ in an amount within the above range can finally control the content of $SiO_2$ and/or $Al_2O_3$ with respect to the magnetic core within the range of 4.0 mass % to 40.0 mass %.

At the same time, polyvinyl alcohol having a weight-average molecular weight of 1,000 to 5,000, a dispersant such as polyammonium carboxylate, a wetting agent such as a nonionic surfactant, and water are added to the mixture. Adjusting the viscosity of the resultant slurry can finally control the particle diameters and voids of the magnetic core. Subsequently, ferrite slurry composed of a mixture of those components is granulated and dried with a spray dryer under an atmosphere having a temperature increased to 100° C. or higher and 300° C. or lower. The granulated product is fired in an electric furnace having a temperature of 600 to 1,300° C. under an appropriate atmosphere, whereby a magnetic core containing the phase composed of $SiO_2$ and/or $Al_2O_3$ is obtained.

Next, a method of producing the magnetic carrier obtained by coating the above magnetic core with a resin is described. However, the present invention is not limited to the following description. Here, the phrase "coating the magnetic core with a resin" means that the surface of the magnetic core is covered with the resin. In addition, the term "surface" is a concept including the entire surface and part of the surface. Further, the term "coat" comprehends the following concept: the magnetic core is coated with the resin so that the resin may be loaded into the magnetic core.

A general method of coating or loading the resin into each of the magnetic core involves: diluting the resin component with a solvent; and adding the diluted solution to the magnetic core. The solvent used here is not particularly limited as long as the solvent is capable of dissolving each resin component.

In the case of a resin soluble in an organic solvent, organic solvents such as toluene, xylene, cellosolve butyl acetate, methyl ethyl ketone, methyl isobutyl ketone, and methanol may be used. In the case of a water-soluble resin component or an emulsion type resin component, water may be used. A method of adding the resin component diluted with a solvent into the magnetic core is, for example, a method involving: impregnating the magnetic core with the resin component by an application method such as a dipping method, a spray method, a brush coating method, a fluidized bed method, or a kneading method; and volatilizing the solvent after the impregnation.

The resin is preferably loaded into the void portions of the magnetic core by a dipping method under reduced pressure at a solvent viscosity of 5.0 mPa·s or more and 100.0 mPa·s or less. In addition, upon loading of, or coating with, the resin, the following procedure is desirably adopted because the resin can be favorably loaded into the magnetic core: the resin solution is charged in multiple portions, and the removal and charging of the solvent are repeated. Thus, the magnetic carrier can obtain a desired specific resistance, or the electric field intensity at which the magnetic carrier comes close to undergo breakdown can be controlled. The resin solution is charged in preferably three or more and ten or less portions, or more preferably three or more and five or less portions.

The coat amount of the above resin is preferably 2 parts by mass or more and 15 parts by mass or less, or more preferably 5 parts by mass or more and 12 parts by mass or less with respect to 100 parts by mass of the magnetic core.

A generally known resin can be used as the resin used in the present invention with which the magnetic core is coated. Each of a thermoplastic resin and a thermosetting resin can be used as the resin; a resin showing high wettability for the magnetic core is preferable.

Examples of the thermoplastic resin includes the following: a polystyrene; polymethyl methacrylate; a styrene-acrylate copolymer; a styrene-methacrylate copolymer; a styrene-butadiene copolymer; an ethylene-vinyl acetate copolymer; polyvinyl chloride; polyvinyl acetate; a polyvinylidene fluoride resin; a fluorocarbon resin; a perfluorocarbon resin; a solvent-soluble perfluorocarbon resin; polyvinyl pyrrolidone; a petroleum resin; a novolac resin; a saturated alkylpolyester resin; aromatic polyester resins such as, polyethylene terephthalate, polybutylene terephthalate, and polyarylate; a polyamide resin; a polyacetal resin; a polycarbonate resin; a polyethersulfone resin; a polysulfone resin; a polyphenylene sulfide resin; and a polyetherketone resin.

Examples of the thermosetting resin can include the following: a phenol resin; a modified phenol resin; a maleic resin; an alkyd resin; an epoxy resin; an acrylic resin; unsaturated polyester obtained by polycondensation of maleic anhydride, terephthalic acid, and a polyhydric alcohol; a urea resin; a melamine resin; a urea-melamine resin; a xylene resin; a toluene resin; a guanamine resin; a melamine-guanamine resin; an acetoguanamine resin; a glyptal resin; a furan resin; a silicone resin; polyimide; a polyamideimide resin; a polyetherimide resin; and a polyurethane resin.

Of the above-mentioned resins, a resin containing a copolymer using at least a monomer having a structure represented by the following formula (A1) and a macromonomer having a structure represented by the following formula (A2) as copolymerization components is preferably used as the resin for coating the magnetic core. The content of the copolymer is preferably 50 mass % to 100 mass % with respect to the above resin for coating the magnetic core. In addition, in the above resin for coating the magnetic core, any one of the above-mentioned generally known resins can be used as a component except the above copolymer.

[Chem 1]

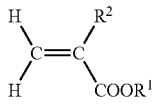

(A1)

where $R^1$ represents a hydrocarbon group having 4 or more carbon atoms, and $R^2$ represents H or $CH_3$,

[Chem 2]

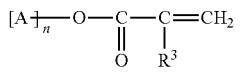

(A2)

where

[Chem 3]

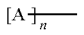

represents a polymer unit having a weight-average molecular weight of 3,000 or more and 10,000 or less, $R^3$ represents H or $CH_3$, and n represents the number of repetitions which is a positive integer.

The monomer [A] of which the polymer unit having a weight-average molecular weight of 3,000 or more and 10,000 or less in the above formula (A2) is constituted is more preferably one or more monomers selected from styrene, styrene-acrylonitrile, methyl methacrylate, and n-butyl methacrylate. It should be noted that the macromonomer represented by the above formula (A2) can be synthesized by a known method.

When the above resin is used for coating the magnetic core, the resin is excellent in adhesiveness with the magnetic core, and can provide high surface releasing performance, and hence additional improvements in developing performance and durability of the developer can be achieved.

The tetrahydrofuran (THF)-soluble matter of the above resin for coating the magnetic core preferably has a weight-average molecular weight Mw measured by gel permeation chromatography (GPC) of 15,000 or more and 300,000 or less in terms of adhesiveness between the resin and the magnetic core, and the uniformity of the coating of the surface of the magnetic core.

Further, various fine particles, a charge control agent, or a charge control resin may be incorporated into the above resin for coating the magnetic core before the magnetic core is coated with the resin. The content of the fine particles in the resin coat layer with which the magnetic core is coated is preferably 2 parts by mass or more and 80 parts by mass or less with respect to 100 parts by mass of the coat resin.

Fine particles made of each of an organic material and an inorganic material may be used as the above fine particles; crosslinked resin fine particles and inorganic fine particles each having such a strength as to be capable of maintaining its shape upon coating are preferable. A crosslinked resin of which each of the crosslinked resin fine particles is formed is, for example, a crosslinked polymethyl methacrylate resin, a crosslinked polystyrene resin, a melamine resin, a guanamine resin, a urea resin, a phenol resin, or a nylon resin. In addition, examples of the inorganic fine particles include fine particles each made of magnetite, hematite, silica, alumina, or a titania-containing metal oxide. In particular, the above inorganic fine particles are preferable in terms of the promotion of the provision of charge for the toner, a reduction in charge up, and an improvement in releasing performance of the magnetic carrier from the toner.

The above resin for coating the magnetic core may contain conductive fine particles as the fine particles. The conductive fine particles to be incorporated into the resin for coating the magnetic core each have a specific resistance at 1,000 V/cm of preferably $1.0\times10^8$ Ω·cm or less, or more preferably $1.0\times10^6$ Ω·cm or less.

Examples of the above conductive fine particles include carbon black fine particles, graphite fine particles, zinc oxide fine particles, and tin oxide fine particles. The carbon black fine particles are particularly preferably used as the conductive fine particles. The carbon black fine particles can appropriately control the specific resistance of the magnetic carrier because of their good conductivity. The conductive fine particles are preferably added in an amount of 0.1 part by mass or more and 10.0 parts by mass or less with respect to 100 parts by mass of the coat resin in order that the resistance of the magnetic carrier may be adjusted.

Examples of the charge control agent used in the resin for coating the magnetic core include nigrosin-based pigments, metal salts of naphthenate and higher fatty acids, alkoxylated amines, quaternary ammonium salt compounds, azo-based metal complexes, metal salts of salicyclic acid, and metal complexes thereof. Preferable examples of charge control agents for improving positive-providing performance include: Spilon Black TRH, T-77, and T-95 (Hodogaya Chemical Co., Ltd.); and BONTRON (registered trademark) S-34, S-44, S-54, E-84, E-88, and E-89 (Orient Chemical Industries, LTD.). Preferable examples of a charge control agent for improving negative-providing performance include: TP-302 and TP-415 (Hodogaya Chemical Co., Ltd.); BONTRON (registered trademark) N-01, N-04, N-07, and P-51 (Orient Chemical Industries, LTD.); and Copy Blue PR(Clariant).

The above charge control agent is preferably a nitrogen-containing compound for improving negative-providing performance as in the case of the charge control resin. The above charge control agent is preferably a sulfur-containing compound for improving positive-providing performance. The charge control agent is preferably added in an amount of 0.5 part by mass or more and 50.0 parts by mass or less with respect to 100 parts by mass of the coat resin for improving the dispersing performance and adjusting the charge quantity.

On the other hand, as the charge control resin used in the resin for coating the magnetic core, a resin having an amino group and a resin having a quaternary ammonium group introduced are preferred for positive-providing performance. Specific examples of the resin having an amino group include a copolymer of a monomer such as an acrylate having an amino group and a methacrylate having an amino group and at least one monomer forming a olefin resin such as an acrylic acid, a metahcrylic acid, styrene, polyethylene, and polypropylene. In addition, as the resin having a quaternary ammonium group introduced, a copolymer formed using a monomer containing a quaternary ammonium group and a copolymer formed using a substance obtained by changing a monomer having an amino group to a quaternary ammonium may be used. In addition, the part of the amino group in an amino group-containing resin may be changed to a quaternary ammonium. From the viewpoint of high charge-providing performance, the amino group in an amino group-containing resin is preferably changed to a quaternary ammonium.

Examples of the quaternary ammonium group include an amino group ($—N^+H_2R_3A^-$), a monosubstituted amino group ($—N^+HR_1R_3A^-$), and a disubstituted amino group ($—N^+R_1R_2R_3A^-$), where $R_1$, $R_2$, and $R_3$ each independently represent a substituent other than hydrogen atom, for example an alkyl group having 1 to 10 carbon atoms. Further, $A^-$ represents an appropriate anion such as $Cl^-$, $Br^-$, and $I^-$.

In addition, in terms of negative-providing performance, for example, a copolymer having the following characteristics is preferable: the copolymer is composed of a vinyl-based monomer and an $SO_3X$ (X=H or an alkali metal) group-containing (meth) acrylamide (hereinafter referred to as "sulfonic acid acrylamide"), and has a weight-average molecular weight of 10,000 or more and 30,000 or less. A charge control resin having the following characteristics is particularly preferably used because the resin suitably controls the charge of the magnetic carrier with ease: the resin is composed of at least one of a styrene copolymer and a styrene (meth)acrylate copolymer each containing a sulfonic acid acrylamide-based monomer at a copolymerization ratio of 2 mass % or more, or preferably 4 mass % or more, and each having a glass transition temperature (Tg) of 70° C. or higher. Specific examples of the resin include 2-acrylamide-2-methylpropanesulfonic acid and 2-methacrylamide-2-methylpropanesulfonic acid.

The charge control resin is preferably added in an amount of 0.5 part by mass or more and 30.0 parts by mass or less with respect to 100 parts by mass of the coat resin so that the resin may bring together a releasing effect on the coat resin and charge-providing performance.

The magnetic carrier used in the present invention has an apparent density of preferably 1.55 g/cm$^3$ or more and 1.90 g/cm$^3$ or less, or more preferably 1.60 g/cm$^3$ or more and 1.85 g/cm$^3$ or less.

When the apparent density of the magnetic carrier falls within the above range, the weight of the magnetic carrier in a certain developing zone can be specified, and hence a balance can be established between the total magnetization of the magnetic carrier and a stress to be applied to the magnetic carrier at the time of the mixing and stirring of the developer. As a result, the durability of the developer can be maintained while the carrier is prevented from adhering to an electrostatic latent image bearing member. It should be noted that the above apparent density of the magnetic carrier can be adjusted to fall within the above range by controlling the content of $SiO_2$ and/or $Al_2O_3$, and the amount of voids of the carrier.

The electric field intensity at which the magnetic carrier used in the present invention comes close to undergo breakdown is preferably 1,300 V/cm or more and 6,500 V/cm or less, or more preferably 3,000 V/cm or more and 5,000 V/cm or less.

The breakdown is described. In specific resistance measurement with an apparatus outlined in FIG. 6, an electrode area is 2.4 cm$^2$, the weight of a magnetic carrier is 0.7 g, and, for example, a Keithley 6517A (manufactured by Keithley Instruments Inc.) is used as an electrometer. The following screening is performed by utilizing the automatic ranging function of the electrometer while the maximum applied voltage is set to 1,000 V: voltages of 1 V, 2 V, 4 V, 8 V, 16 V, 32 V, 64 V, 128 V, 256 V, 512 V, and 1,000 V are applied for time periods of one second each. At that time, the electrometer judges whether a maximum of 1,000 V can be applied, and, when an excess current flows, an indicator "VOLTAGE SOURCE OPERATE" flashes. Then, the electrometer lowers the applied voltage, further screens a voltage that can be applied, and automatically determines the maximum value for the applied voltage. After that, the measurement is performed. The determined maximum applied voltage is divided into five steps, and a resistance is measured from a current value after the applied voltage has been held at each step for 30 seconds.

Figure 7:
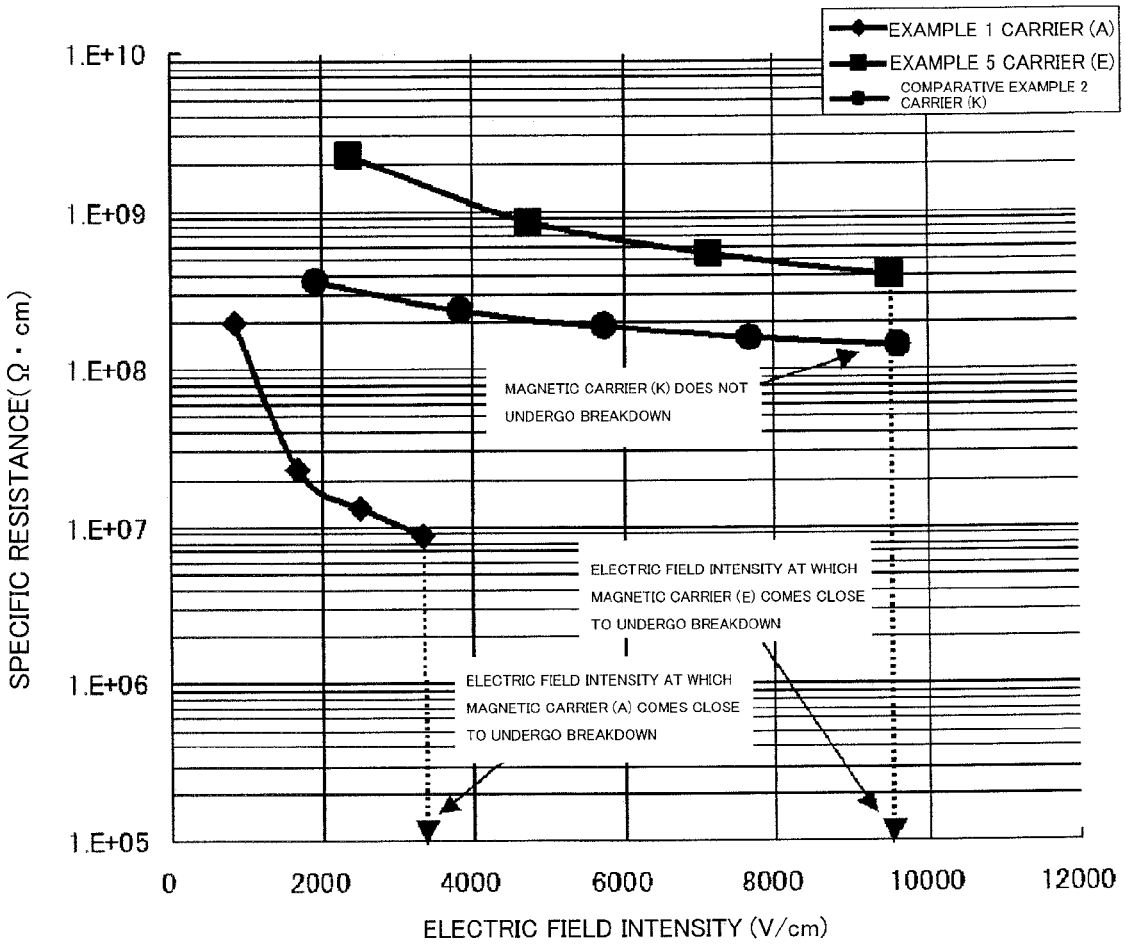
FIG. 7 is a view illustrating specific resistance data on magnetic carriers (A), (E), and (K) used in the present invention.

Description is given by taking a magnetic carrier used in Example 1 to be described later as an example. Table 5 shows the results of measurement for the magnetic core and the magnetic carrier. The table shows an applied voltage (V), an electric field intensity (V/cm) obtained by dividing the applied voltage by a sample thickness d, and a specific resistance (Ω·cm) at the intensity. FIG. 7 shows a graph obtained by plotting the specific resistances of sixth and subsequent steps in the table versus the electric field intensity. As can be seen from Table 5 and FIG. 7, the electric field intensity when 307.2 V is applied to the magnetic carrier, i.e., 3,340 V/cm is defined as the electric field intensity at which the magnetic carrier comes close to undergo breakdown. The breakdown is defined as follows: although it is judged at the time of screening that a voltage of 384 V can be applied, an excess current flows at the voltage at the time of the measurement by setting a relaxation time to 30 seconds, and a measured resistance becomes zero at a voltage in excess of 307.2 V. In addition, the electric field intensity at which the magnetic carrier comes close to undergo breakdown is defined as the electric field intensity at which the indicator "VOLTAGE SOURCE OPERATE" flashes, or the maximum electric field intensity versus which a specific resistance is plotted.

The inventors have found that, in the present invention, a sample thickness when 0.7 g of the magnetic carrier is loaded into a measuring device is about 1 mm, and there is a correlation between the application of a DC voltage corresponding to the electric field intensity at which the magnetic carrier comes close to undergo breakdown for 30 seconds and an applied bias in actual development. That is, the inventors have found that the application correlates with instantaneous application of the sum of a contrast voltage applied between an electrostatic latent image bearing member and a developer carrying member in an actual developing zone and the half value (½Vpp) of an alternating electric field, i.e., about 1,000 V (contrast: 350 V, ½Vpp: 650 V) to a magnetic brush. This is probably because of the following reason: the electric field intensity in the actual developing zone, which is 25,000 V/cm when an S-D distance is set to 400 μm, is equivalent to the intensity of an electric field which the magnetic carrier having a thickness of about 1 mm at the time of the specific resistance measurement receives when a maximum of 10,000 V/cm is applied to the magnetic carrier for 30 seconds. In addition, a correlation may be established between the application and the developing performance because the behavior of the resistance of the magnetic carrier when the thickness is about 1 mm, which is close to a gap in the actual developing zone, can be observed. That is, what correlates with the developing performance is the electric field intensity at which the magnetic carrier undergoes breakdown in a certain electric field intensity range rather than the specific resistance of the magnetic carrier.

When the electric field intensity at which the magnetic carrier comes close to undergo breakdown is 1,300 V/cm or more and 6,500 V/cm or less, image defects such as white spots due to current leakage at the time of development are suppressed, and high developing performance can be obtained at an additionally low developing bias. This is probably because of the following reasons: abrupt attenuation of counter charge on the surface of the carrier after the toner has flown as well as an electrode effect by virtue of a reduction in resistance of a magnetic brush to such an extent that the magnetic carrier undergoes breakdown when a developing electric field is applied.

The above electric field intensity at which the magnetic carrier comes close to undergo breakdown is more preferably 3,000 V/cm or more and 5,000 V/cm or less.

It should be noted that the above electric field intensity at which the magnetic carrier comes close to undergo breakdown can be adjusted to fall within the above range by combining the following approaches: the lowering of the resistance of the ferrite component of the magnetic core, appropriate addition of the phase composed of $SiO_2$ and/or $Al_2O_3$, and, furthermore, the coating of the surface of the magnetic core with the resin.

To be specific, the electric field intensity at which the magnetic carrier comes close to undergo breakdown can be controlled by: causing a high-resistance portion and a low-resistance portion to exist in the magnetic core; and moderately exposing the portions to the surface of the magnetic carrier.

Next, the toner used in the tow-component developer of the present invention is described.

The particle diameter and shape of each particle of the toner used in the present invention are preferably controlled because the toner can exert excellent developing performance when used in combination with the above-mentioned magnetic carrier.

A preferred embodiment of the toner is, for example, any one of the following toners.

A first example is a toner having toner particles each containing: a resin mainly composed of a polyester unit; and a colorant. A method of producing the toner mainly composed of the polyester unit is, for example, a pulverization method involving pulverizing molten, kneaded particles and controlling the circularities of the particles by classification or a post-treatment, a suspension granulation method involving introducing, into an aqueous medium, a solution prepared by dissolving or dispersing a binder resin and the colorant in a solvent, subjecting the mixture to suspension granulation, and removing the solvent to provide toner particles, or an emulsion agglomeration method of providing the toner through the step of agglomerating at least polymer fine particles and colorant fine particles to form a fine particle agglomerate and an aging step of causing melt adhesion between fine particles in the fine particle agglomerate. The term "polyester unit" refers to a portion derived from polyester, and the term "resin mainly composed of a polyester unit" refers to a resin constituted of repeating units most (preferably 50% or more) of which are repeating units each having an ester bond. The unit and the resin are described in detail later.

The above-mentioned polyester unit is formed by condensation-polymerizing an ester-based monomer. As the ester-based monomer, a polyhydric alcohol component, and a polycarboxylic acid, a polycarboxylic acid anhydride, or a polycarboxylic acid ester having two or more carboxyl groups is exemplified.

Of those polyhydric alcohol components, examples of the dihydric alcohol component include the following: alkylene oxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol; diethylene glycol; triethylene glycol; 1,2-propylene glycol; 1,3-propylene glycol; 1,4-butanediol; neopentyl glycol; 1,4-butenediol; 1,5-pentanediol; 1,6-hexanediol; 1,4-cyclohexanedimethanol; dipropylene glycol;

polyethylene glycol; polypropylene glycol; polytetramethylene glycol; bisphenol A; and hydrogenated bisphenol A.

Of those polyhydric alcohol components, examples of the alcohol component having three or more hydroxyl groups include the following: sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of the carboxylic acid component forming a polyester unit include the following: aromatic dicarboxylic acids such as phthalic acid, isophthalic acid, and terephthalic acid or anhydrides thereof; alkyldicarboxylic acids such as succinic acid, adipic acid, sebacic acid, and azelaic acid or anhydrides thereof; succinic acid substituted with an alkyl group having 6 to 12 carbon atoms or anhydrides thereof; and unsaturated dicarboxylic acids such as fumaric acid, maleic acid, and citraconic acid or anhydrides thereof.

A preferred example of a resin having a polyester unit contained in a toner particle includes the following: a polyester resin obtained by a condensation polymerization using a bisphenol derivative typified by a structure represented by the following formula (1) as an alcohol component and a carboxylic acid component (such as fumaric acid, maleic acid, maleic anhydride, phthalic acid, terephthalic acid, dodecenylsuccinic acid, trimellitic acid, or pyromellitic acid) derived from a divalent or higher carboxylic acid, an anhydride thereof, or a lower alkylester thereof as a carboxylic acid component. The polyester resin has good charging property. The charging property of the polyester resin works more effectively when the polyester resin is used as a resin which is included in a toner contained in a two-component developer.

[Chem 4]

(1)

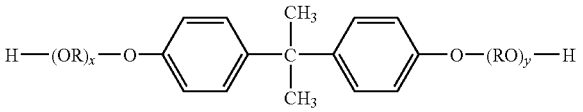

(where R represents one or more kinds of an ethylene or propylene groups, x and y each represent an integer of 1 or more, and an average value of x plus y is 2 to 10.)

In addition, preferable examples of the resin having a polyester unit contained in the toner particle include polyester resins having a crosslinked moiety. Each of the polyester resins having a crosslinked moiety is obtained by a condensation polymerization reaction between a polyhydric alcohol and a carboxylic acid component containing a polyvalent carboxylic acid which is trivalent or more. Examples of the polyvalent carboxylic acid component which is trivalent or more include the following: 1,2,4-benzenetricarboxylicacid, 1,2,5-benzenetricarboxylicacid, 1,2,4-naphthalenetricarboxylic acid, 2,5,7-naphthalenetricarboxylic acid, and 1,2,4,5-benzenetetracarboxylic acid, and anhydrides and ester compounds of these acids. The content of the polyvalent carboxylic acid component which is trivalent or more in ester-based monomers to be subjected to condensation polymerization is preferably 0.1 mol % or more and 1.9 mol % or less with respect to all the monomers.

Further, preferable examples of the resin having a polyester unit contained in a toner particle include: (a) a hybrid resin having the polyester unit and a vinyl-based polymer unit; (b) a mixture of a hybrid resin and a vinyl-based polymer; (c) a mixture of a polyester resin and a vinyl-based polymer; (d) a mixture of a hybrid resin and a polyester resin; and (e) a mixture of a polyester resin, a hybrid resin, and a vinyl-based polymer.

It should be noted that the hybrid resin is formed by bonding as a result of an ester exchange reaction between a polyester unit and a vinyl-based polymer unit obtained by the polymerization of a monomer component having a carboxylate group such as an acrylate. The hybrid resin is preferably a graft copolymer or block copolymer using a vinyl-based polymer as a stem polymer and a polyester unit as a branch polymer.

It should be noted that the above vinyl-based polymer unit refers to a portion originating from a vinyl-based polymer. The above vinyl-based polymer unit or vinyl-based polymer is obtained by the polymerization of the vinyl-based monomer described below.

A toner having toner particles obtained by a direct polymerization method or from an aqueous medium is also a preferred embodiment of the toner used in the two-component developer of the present invention. The toner particles may be produced by a direct polymerization method, or may be produced by: producing emulsified fine particles in advance; and agglomerating the fine particles together with the colorant and a release agent. A toner having the toner particles produced by the latter approach may be referred to as "toner obtained from an aqueous medium" or "toner obtained by an emulsion agglomeration method".

The toner of the present invention is obtained using a direct polymerization method or an emulsion agglomeration method, and preferably has toner particles having a resin such as a vinyl-based resin as a main component (preferably 50% or more). The vinyl-based resin which is the main component of the toner particles is obtained by the polymerization of a vinyl-based monomer. Examples of the vinyl-based monomer may include the following: a styrene-based monomer, an acrylic-based monomer, a methacrylic-based monomer, a monomer of unsaturated monoolefins, a monomer of vinylesters, a monomer of vinylethers, a monomer of vinyl ketones, a monomer of N-vinyl compounds, and other vinyl monomers.

Examples of the styrene-based monomer include the following: styrene; o-methylstyrene; m-methylstyrene; p-methylstyrene; p-methoxystyrene; p-phenylstyrene; p-chlorostyrene; 3,4-dichlorostyrene; p-ethylstyrene; 2,4-dimethylstyrene; p-n-butylstyrene; p-tert-butylstyrene; p-n-hexylstyrene; p-n-octylstyrene; p-n-nonylstyrene; p-n-decylstyrene; and p-n-dodecylstyrene.

Examples of the acrylic-based monomer may include the following: acrylates such as methyl acrylate, ethyl acrylate, n-butyl acrylate, isobutyl acrylate, propyl acrylate, n-octyl acrylate, dodecylacrylate, 2-ethylhexylacrylate, stearylacrylate, dimethylaminoethyl acrylate, and phenyl acrylate; acrylic acids; and acrylamides.

In addition, examples of the methacrylic-basedmonomer include the following: methacrylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; methacrylic acids; and methacrylamides.

Examples of the monomer of unsaturated monoolefins include ethylene, propylene, butylene, and isobutylene.

Examples of the monomer of vinylesters include vinyl acetate, vinyl propionate, and vinyl benzoate.

Examples of the monomer of vinylethers include vinyl methyl ether, vinyl ethyl ether, and vinyl isobutyl ether.

Examples of the monomer of vinyl ketones include vinyl methyl ketone, vinyl hexyl ketone, and methyl isopropenyl ketone.

Examples of the monomer of N-vinyl compounds include N-vinylpyrrole, N-vinylcarbazole, N-vinylindole, and N-vinylpyrrolidone.

Examples of the other kinds of vinyl monomers include vinylnaphthalines and acrylic acid derivatives or methacrylic acid derivatives such as acrylonitrile, methacrylonitrile, and acrylamide.

One kind of the vinyl-based monomers may be used, or two or more kinds of them can be used in combination.

Examples of the polymerization initiator used when a vinyl-based resin is produced, include the following: azo-based or diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; peroxide-based polymerization initiators or initiators having a peroxide on a side chain, such as benzoylperoxide, methylethylketoneperoxide, diisopropylperoxycarbonate, cumene hydroperoxide, t-butylhydroperoxide, di-t-butylperoxide, dicumylperoxide, 2,4-dichlorobenzoylperoxide, lauroylperoxide, 2,2-bis(4,4-t-butylperoxycyclohexyl)propane, and tris-(t-butylperoxy) triazine; persulfates such as potassium persulfate and ammonium persulfate; and hydrogen peroxide.

Further, examples of polyfunctional polymerization initiators which are radically polymerizable and has three or more functional groups include the following: tris(t-butylperoxy) triazine, vinyltris(t-butylperoxy)silane, 2,2-bis(4,4-di-t-butylperoxycyclohexyl)propane, 2,2-bis(4,4-di-t-amylperoxycyclohexyl)propane, 2,2-bis(4,4-di-t-octylperoxycyclohexyl)propane, and 2,2-bis(4,4-di-t-butylperoxycyclohexyl)butane.

The toner used in the present invention is preferably used in an electrophotography process having an oilless fixing system. Thus, it is preferred that the toner include a release agent.

Examples of the release agent include: aliphatic hydrocarbon-based waxes such as low-molecular-weight polyethylene, low-molecular-weight polypropylene, a polyolefin copolymer, a polyolefin wax, a microcrystalline wax, a paraffin wax, and a Fischer-Tropsch wax; oxides of aliphatic hydrocarbon-based waxes such as a polyethylene oxide wax, or block copolymers of the waxes; waxes mainly composed of aliphatic acid esters such as a carnauba wax, a montanic acid ester wax, and behenyl behenate; and partially or wholly deacidified aliphatic acid esters such as a deacidified carnauba wax. As a preferable release agent, a hydrocarbon-based wax and a paraffin wax are exemplified.

It is preferred that the toner used in the present invention have one or two or more endothermic peaks in the temperature range of 30° C. or higher to 200° C. or lower in the endothermic curve of the toner in differential scanning calorimetry (DSC), and the temperature of the highest endothermic peak in the endothermic peaks be 50° C. or higher and 110° C. or lower. Such toner, if used, tends to show additionally improved characteristics without adhering to the carrier to a large extent; specifically, the toner is excellent in developing performance, and has good low-temperature fixability and good durability.

The content of the release agent in the toner used in the present invention is preferably 1 part by mass or more and 15 parts by mass or less, or more preferably 3 parts by mass or more and 10 parts by mass or less with respect to 100 parts by mass of the binder resin in the toner particles. When the content of the release agent is 1 part by mass or more and 15 parts by mass or less, the toner tends to exert good releasing performance, and to exert excellent transferring performance at the time of oilless fixation.

In addition, the toner to be used in the present invention may contain a charge control agent. Examples of the charge control agent include organometallic complexes, metal salts, and chelate compounds. Examples of the organometallic complexes include monoazo metal complexes, acetylacetone metal complexes, hydroxycarboxylic acid metal complexes, polycarboxylic acid metal complexes, and polyol metal complexes. Other examples thereof include carboxylic acid derivatives and condensates of aromatic-based compounds such as metal salts of carboxylic acid, carboxylic anhydrides, and esters. In addition, phenol derivatives such as bisphenols and calixarene can be used as the charge control agent. The charge control agent contained in the toner used in the present invention is preferably a metal compound of an aromatic carboxylic acid from the viewpoint of improving the build up of charging of the toner.

The content of the above charge control agent is preferably 0.1 part by mass or more and 10.0 parts by mass or less, or more preferably 0.2 part by mass or more and 5.0 parts by mass or less with respect to 100 parts by mass of the binder resin. When the toner includes 0.1 part by mass or more and 10.0 parts by mass or less of the charge control agent with respect to 100 parts by mass of the binder resin in the toner particle, a change in triboelectric charge quantity of the toner can be reduced in any one of various environments ranging from a high-temperature, high-humidity environment to a low-temperature, low-humidity environment.

The toner to be used in the present invention may contain a colorant. The colorant may be a pigment or a dye, or a combination of them.

Examples of the dye may include the following: C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6.

Examples of the pigment may include the following: mineral Fast Yellow, Navel Yellow, Naphthol Yellow S, Hansa Yellow G, Permanent Yellow NCG, Tartrazine Lake, Molybdenum Orange, Permanent Orange GTR, Pyrazolone Orange, Benzidine Orange G, Permanent Red 4R, Watching Red calcium salt, eosine lake, Brilliant Carmine 3B, Manganese Violet, Fast Violet B, Methyl Violet Lake, Cobalt Blue, Alkali Blue Lake, Victoria Blue Lake, Phthalocyanine Blue, Fast Sky Blue, Indanthrene Blue BC, Chrome Green, Pigment Green B, Malachite Green Lake, and Final Yellow Green G.

In addition, when the two-component developer of the present invention is used as a developer for forming a full-color image, the toner can contain a magenta coloring pigment.

Examples of the magenta coloring pigment may include the following: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, and 238; C.I. Pigment Violet 19; and C.I. Vat Red 1, 2, 10, 13, 15, 23, 29, and 35.

The toner particles can includes only the magenta coloring pigments, but when the toner particles include a combination of the dye and the pigment, definition of the developer and image quality of a full color image can be improved. Examples of the magenta dye may include the following: Oil soluble dyes such as C.I. Solvent Red 1, 3, 8, 23, 24, 25, 27, 30, 49, 81, 82, 83, 84, 100, 109, and 121, C.I. Disperse Red 9, C.I. Solvent Violet 8, 13, 14, 21, and 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, and 40, and C.I. Basic Violet 1, 3, 7, 10, 14, 15, 21, 25, 26, 27, and 28.

Examples of the cyan coloring pigment may include the following: C.I. Pigment Blue 2, 3, 15, 15:1, 15:2, 15:3, 16, and 17; C.I. Acid Blue 6; C. I. Acid Blue 45; and copper phthalocyanine pigments having a phthalocyanine skeleton substituted by 1 or more and 5 or less methyl phthalimide groups.

Examples of the yellow coloring pigment may include the following: C.I. Pigment Yellow 1, 2, 3, 4, 5, 6, 7, 10, 11, 12, 13, 14, 15, 16, 17, 23, 65, 73, 74, 83, 93, 97, 155, and 180; and C.I. Vat Yellow 1, 3, and 20.

The black pigment is, for example, carbon black such as furnace black, channel black, acetylene black, thermal black, or lamp black, or a magnetic powder such as magnetite or ferrite.

In addition, a magenta dye and a magenta pigment, a yellow dye and a yellow pigment, and a cyan dye and a cyan pigment may be combined to conduct toning, and, further, the carbon black described above may be used in combination with any such dye or pigment.

The content of the colorant in the toner used in the present invention is preferably 1 part by mass or more and 15 parts by mass or less, more preferably 3 parts by mass or more and 12 parts by mass or less, or still more preferably 4 parts by mass or more and 10 parts by mass or less with respect to 100 parts by mass of the binder resin in the toner particles. When the content of the colorant is 1 part by mass or more and 15 parts by mass or less with respect to the binder resin in the toner particles, the transparency of the toner is maintained, and the reproducibility of the toner for a halftone typified by the skin color of a human being is improved. Further, the stability of the charging performance of the toner is improved, and the toner obtains low-temperature fixability.

It is preferred that inorganic fine particles having the following characteristic be externally added as spacer particles for improving releasing performance between the toner used in the present invention and the carrier to the toner: the inorganic fine particles have at least one local maximum in the range of 80 nm or more to 200 nm or less in their grain size distribution on a number basis. It is more preferred that inorganic fine particles having the following characteristic be externally added in order that the desorption of the particles from the toner may be suppressed in an additionally favorable fashion while the particles are caused to function as spacer particles: the inorganic fine particles have at least one local maximum in the range of 100 nm or more to 150 nm or less in their grain size distribution on a number basis. The above inorganic fine particles each preferably contain silica, titanium oxide, alumina, cerium oxide, or strontium titanate.

Further, other inorganic fine particles may be added to the toner particles with a view to improving the flowability or transferring performance of the toner. The above inorganic fine particles to be externally added to the surfaces of the toner particles each preferably contain titanium oxide, alumina, or silica. With regard to the particle diameter of each inorganic fine particle, the inorganic fine particles to be incorporated preferably have at least one local maximum in the range of 10 nm or more to 50 nm or less in their grain size distribution on a number basis. It is also preferred that the inorganic fine particles be used in combination with the above spacer particles.

The total content of the external additives is preferably 0.3 part by mass or more and 5.0 parts by mass or less, or more preferably 0.8 part by mass or more and 4.0 parts by mass or less with respect to 100 parts by mass of the toner particles. Of the external additives, the inorganic particles having at least one local maximum in the range of 80 nm or more to 200 nm or less in their grain size distribution on a number basis are added at a content of preferably 0.1 part by mass or more and 2.5 parts by mass or less, or more preferably 0.5 part by mass or more and 2.0 parts by mass or less. When the content of the particles falls within the range, an effect of the particles as spacer particles becomes additionally significant.

The surface of each of the above inorganic fine particles is preferably subjected to a hydrophobic treatment. The hydrophobic treatment is preferably performed with any one of the following hydrophobic treatment agents: coupling agents such as various titanium coupling agents and a silane coupling agent; aliphatic acids and metal salts of the acids; silicone oil; and a combination of two or more of them.

The above inorganic fine particles subjected to a hydrophobic treatment mean inorganic fine particles having a degree of hydrophobicity (methanol wettability; an indicator showing wettability for methanol) titrated by a methanol titration test on the inorganic fine particles after a hydrophobic treatment to be described later of 40% or more and 95% or less.

Examples of the titanium coupling agent used in the hydrophobic treatment include the following: tetrabutyl titanate, tetraoctyl titanate, isopropyl triisostearoyl titanate, isopropyl tridecylbenzene sulfonyl titanate, and bis(dioctlypyrophosphate)oxyacetate titanate.

Examples of the silane coupling agent used in the hydrophobic treatment may include the following: γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)-γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyl trimethoxysilane, and p-methylphenyl trimethoxysilane.

Examples of the fatty acid and metal salts to be used in the hydrophobic treatment include the following: long chain fatty acids such as undecyl acid, lauric acid, tridecyl acid, dodecyl acid, myristic acid, palmitic acid, pentadecyl acid, stearic acid, heptadecyl acid, arachic acid, montanic acid, oleic acid, linolic acid, and arachidonic acid.

Examples of the metals for the fatty acid metal salts include zinc, iron, magnesium, aluminum, calcium, sodium, and lithium.

Examples of the above silicone oil for a hydrophobic treatment include a dimethyl silicone oil, a methyl phenyl silicone oil, and an amino-modified silicone oil.

The above hydrophobic treatment is preferably performed by adding 1 mass % or more and 30 mass % or less, and more preferably 3 mass % or more and 7 mass % or less, of any one of the above hydrophobic treatment agents to the inorganic fine particles to coat the inorganic fine particles.

The hydrophobicity of each of the inorganic fine particles subjected to the hydrophobic treatment is not particularly limited. For example, a hydrophobicity subjected to a titeration by a methanol titration test for the inorganic fine particles after the hydrophobic treatment (methanol wettability; indicator showing wettability with respect to methanol) preferably falls within the range of 40% or more and 95% or less.

The above degree of hydrophobicity is specifically determined from a methanol dropping transmittance curve obtained as described below.

First, 70 ml of a water-containing methanol liquid composed of 30 vol % of methanol and 70 vol % of water are charged into a cylindrical glass container having a diameter of 5 cm and a thickness of 1.75 mm, and are dispersed with an ultrasonic dispersing device for 5 minutes so that air bubbles and the like may be removed.

Next, 0.06 g of the inorganic fine particles is precisely weighed, and is added to the container containing the above water-containing methanol liquid so that a sample liquid for measurement may be prepared.

Then, the sample liquid for measurement is set in a powder wettability tester "WET-100P" (manufactured by RHESCA). The sample liquid for measurement is stirred with a magnetic stirrer at a rate of 6.7 $s^{-1}$ (400 rpm). It should be noted that a fluorine resin-coated spindle rotor having a length of 25 mm and a maximum diameter of 8 mm is used as the rotor of the magnetic stirrer.

Next, the transmittance of the sample liquid for measurement for light having a wavelength of 780 nm is measured while methanol is continuously added to the liquid at a dropping rate of 1.3 ml/min through the above apparatus. Then, a methanol dropping transmittance curve is created on the basis of the measured value. A value corresponding to a transmittance of 50% in the resultant methanol dropping transmittance curve is defined as the degree of hydrophobicity.

The toner used in the present invention is preferably subjected to a sphering treatment or a surface-smoothing treatment by any one of the various methods before use because its transferring performance is improved. Examples of such methods include: a method involving smoothing the surface of the toner or sphering the toner with a mechanical force in an apparatus having a stirring blade or blade and a liner or casing upon, for example, passing of the toner through a minute gap between the blade and the liner; a method involving suspending the toner in hot water to sphere the toner; and a method involving exposing the toner to a heat air current to sphere the toner. In addition, a method of producing a spherical toner is, for example, a method involving suspending a mixture mainly composed of a monomer that serves as a binder resin for the toner in water and polymerizing the suspension to provide the toner.

The following method is also available as a general method of producing the toner used in the present invention. A polymerizable monomer, a colorant, a polymerization initiator, and, as required, a crosslinking agent, a charge control agent, a release agent, and any other additive are uniformly dissolved or dispersed so that a polymerizable monomer composition may be obtained. After that, the polymerizable monomer composition is dispersed in a continuous phase containing a dispersion stabilizer such as an aqueous phase with an appropriate stirring machine so as to be turned into particles each having a moderate particle diameter, and, furthermore, the particles are subjected to a polymerization reaction so that a toner having a desired particle diameter may be obtained.

When a two-component developer is prepared by mixing the above magnetic carrier and the toner, a mixing ratio between the magnetic carrier and the toner is typically as follows in order that good results may be obtained: a toner concentration in the developer is 2 mass % or more and 15 mass % or less, or preferably 4 mass % or more and 13 mass % or less. When the toner concentration is less than 2 mass %, an image density is apt to reduce. When the toner concentration exceeds 15 mass %, fogging or the scattering of the toner in a machine is apt to occur.

In the two-component developer of the present invention, the absolute value of the triboelectric charge quantity of the above toner measured by a two-component method using the toner and the above magnetic carrier is preferably 40.0 mC/kg or more and 80.0 mC/kg or less (more preferably 45.0 mC/kg or more and 70.0 mC/kg or less in order that the dot reproducibility and transferring performance of the developer may be additionally improved).

The developer using the toner the above absolute value of the triboelectric charge quantity of which is 40.0 mC/kg or more has the following characteristics: fogging is favorably suppressed, the dot reproducibility is improved, and the stability of the dot reproducibility is secured even after a durability test. Meanwhile, when the above absolute value of the triboelectric charge quantity of the toner is 80.0 mC/kg or less, a sufficient image density and high transfer efficiency can be maintained. This is probably because of the following reasons: an electrostatic adhesive force between the toner and the magnetic carrier or the surface of a photosensitive member becomes moderate so that the toner may be able to track an electrostatic latent image properly, and, furthermore, the developing performance of the toner can be maintained at a high level. The triboelectric charge quantity of the toner preferably falls within the above range in order that compatibility between the developing performance and the prevention of any one of the image defects such as fogging and blank dots may be achieved. The reason why a toner having such a high triboelectric charge quantity has good developing performance is as follows: the electric field intensity at which the magnetic carrier comes close to undergo breakdown is controlled on the basis of a balance in quantity between the ferrite phase and non-magnetic, high-resistance phase of the magnetic core, and the particle diameter and shape of each particle of the toner are set within predetermined ranges, and hence additionally good developing performance can be achieved.

It should be noted that the above absolute value of the triboelectric charge quantity of the toner can be adjusted to fall within the above range by the following approaches directed toward the toner: the kind of an external additive used in the toner, the kind of a surface treatment agent used for the external additive, the particle diameter of the external additive, and the ratio at which each toner particle is coated with the external additive are controlled. Meanwhile, the above absolute value of the triboelectric charge quantity of the toner can be adjusted to fall within the above range by the following approaches directed toward the magnetic carrier: the kind of a resin for coating the magnetic carrier (the resin may be loaded into the magnetic carrier), and the coat amount of the resin (which may be the amount of the resin loaded into the magnetic carrier) are optimized, and a charge-providing particle, a charge control agent component, and a charge control resin are added to the coat resin (which may be a resin to be loaded into the magnetic carrier).

Methods of measuring the various physical properties of the magnetic carrier and the toner used in the two-component developer of the present invention are described below.

<Measurement of Specific Resistance of Each of Magnetic Core and Magnetic Carrier, and Electric Field Intensity at which Magnetic Carrier Comes Close to Undergo Breakdown>

Figure 6:
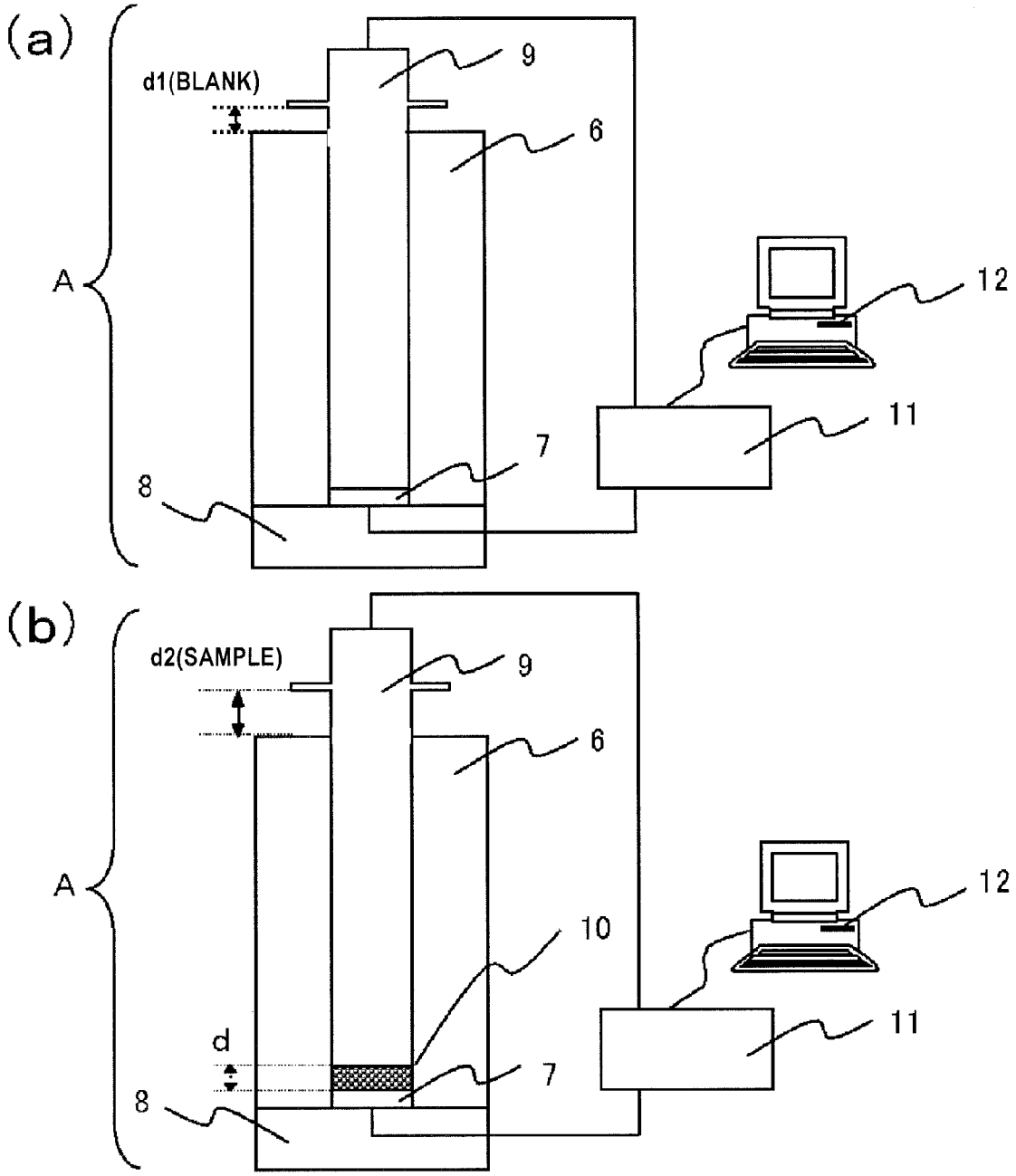
FIGS. 6(*a*) and 6(*b*) are each an outline sectional view of an apparatus for measuring the specific resistance of the magnetic core used in the present invention.

The specific resistance of each of the magnetic core and the magnetic carrier is measured with a measuring apparatus outlined in FIG. 6. It should be noted that, in the measurement for the magnetic core, a sample which has not been coated with a resin yet is used.

A resistance-measuring cell A is constituted of: a cylindrical resin container 6 (made of a PTFE resin) perforated with a hole having a sectional area of 2.4 $cm^2$; a lower electrode 7 (made of stainless steel); a supporting base 8 (made of a PTFE resin); and an upper electrode 9 (made of stainless steel). The cylindrical resin container 6 is mounted on the supporting base 8, and 0.7 g of a sample 10 (the magnetic core or the magnetic carrier) is loaded into the container. The upper electrode 9 is mounted on the loaded sample 10, and the thickness of the sample is measured. In the case where a thickness when no sample is present in advance is represented by d1 (blank) and a thickness when 0.7 g of the sample is loaded is represented by d2 (sample), the actual thickness d of the sample can be represented by the following equation.

$$d=d2(\text{sample})-d1(\text{blank})$$

That is, upper and lower portions in the cylindrical resin container having a measuring space with a sectional area of 2.4 $cm^2$ are provided with the upper and lower electrodes each having a measuring surface identical in shape to the sectional shape of the measuring space, 0.7 g of the magnetic core is loaded into a gap between the upper and lower electrodes, and the loaded magnetic core is subjected to measurement while being sandwiched between the upper and lower electrodes at a pressure of 50 $g/cm^2$.

The specific resistance of each of the magnetic core and the magnetic carrier can be determined by measuring a current flowing when a voltage is applied between the electrodes. An electrometer 11 (Keithley 6517A manufactured by Keithley Instruments Inc.) is used for the measurement, and a computer 12 is used for controlling the electrometer 11.

A control computer manufactured by National Instruments Corporation was used as a control computer, and a LabVIEW (manufactured by National Instruments Corporation) was used as control software. Measurement conditions areas follows: a contact area S ($2.4^{=2}$) between the sample and the electrode, and the actually measured value d of the thickness of the sample are input, and the load of the upper electrode and the maximum applied voltage are set to 120 g and 1,000 V, respectively.

Conditions for the application of the voltage are as described below. The following screening is performed with an IEEE-488 interface used for control between the control computer and the electrometer by utilizing the automatic ranging function of the electrometer: voltages of 1 V, 2 V, 4 V, 8 V, 16 V, 32 V, 64 V, 128 V, 256 V, 512 V, and 1,000 V are applied for time periods of one second each. At that time, the electrometer judges whether a maximum of 1,000 V can be applied, and, when an excess current flows, an indicator "VOLTAGE SOURCE OPERATE" flashes. Then, the electrometer lowers the applied voltage, further screens a voltage that can be applied, and automatically determines the maximum value for the applied voltage. After that, the measurement is automatically performed. The determined maximum voltage is divided into five steps, and the resistance is measured from a current value after the applied voltage has been held at each step for 30 seconds. For example, when the maximum applied voltage is 1,000 V, the applied voltage is increased in an increment of 200 V, and is then decreased in an increment of 200 V as follows: 200 V, 400 V, 600 V, 800 V, 1,000 V, 1,000 V, 800 V, 600 V, 400 V, and 200 V. Then, the resistance is measured from a current value after the applied voltage has been held at each step for 30 seconds.

In the case of the magnetic carrier used in Example 1, at the time of the screening, the maximum applied voltage is 384 V as shown in Table 5. At the time of the measurement, the applied voltage is applied in the following order: 76.8 V, 153.6 V, 230.4 V, 307.2 V, 384 V, 384 V, 307.2 V, 230.4 V, 153.6 V, and 76.8 V. Then, the obtained current value is treated with a computer, whereby an electric field intensity and a specific resistance from the sample thickness and the electrode area are calculated and plotted on a graph. In this case, five points from a point at which the applied voltage starts to decrease (the sixth step to the tenth step in Table 5) are plotted. It should be noted that, when the indicator "VOLTAGE SOURCE OPERATE" flashes and an excess current flows in measurement at each step, "0" is displayed as the measured resistance. The phenomenon is defined as breakdown. In addition, the phenomenon in which the indicator "VOLTAGE SOURCE OPERATE" flashes is defined as the electric field intensity at which the magnetic carrier comes close to undergo breakdown. Therefore, the point at which the indicator "VOLTAGE SOURCE OPERATE" flashes and the maximum electric field intensity with the above-mentioned profile is plotted is defined as the electric field intensity at which the magnetic carrier comes close to undergo breakdown. When the indicator "VOLTAGE SOURCE OPERATE" flashes upon application of the maximum applied voltage, and the resistance does not become zero and can be plotted, the point is defined as the electric field intensity at which the magnetic carrier comes close to undergo breakdown. In this case, breakdown occurs at 384 V, four points can be plotted on the graph, and the electric field intensity at which the magnetic carrier comes close to undergo breakdown is $3.34\times10^3$ V/cm (the applied voltage is 307.2 V).

It should be noted that the specific resistance and the electric field intensity can be determined by the following equations.

$$\text{Specific resistance}(\Omega\cdot cm)=(\text{applied voltage}(V)/\text{measurement current}(A))\times S(cm^2)/d(cm)$$

$$\text{Electric field intensity}(V/cm)=\text{applied voltage}(V)/d(cm)$$

FIG. 7 shows plots for a magnetic carrier (A) used in Example 1, a magnetic carrier (E) used in Example 5, and a magnetic carrier (K) used in Comparative Example 2. As can be seen from the graph, the electric field intensity at which the magnetic carrier (A) comes close to undergo breakdown is 3,340 V/cm, and the electric field intensity at which the magnetic carrier (E) comes close to undergo breakdown is 9,520 V/cm as indicated by arrows drawn with broken lines. In addition, the magnetic carrier (K) did not undergo breakdown even when 1,000 V (9,620 V/cm in terms of an electric field intensity) was applied. Table 6 shows the results of specific resistance measurement for the magnetic carriers (A), (E), and (K).

In addition, the specific resistance of a magnetic core at 1,000 V/cm is read from a graph showing the specific resistance at 1,000 V/cm on itself. The point of intersection of a vertical line corresponding to 1,000 V/cm on the graph and a line drawn by the actually measured specific resistances is defined as a specific resistance at the time of the application of 1,000 V/cm. In addition, when no point of intersection exists, extrapolation is performed with two plots to be extrapolated to the points of measurement, and the point of intersection of the vertical line corresponding to 1,000 V/cm and the extrapolated line is defined as a specific resistance at the time of the application of 1,000 V/cm.

In the case of the magnetic core (a) used in Example 1, at the time of the screening, the maximum applied voltage is 72

V as shown in Table 5. The applied voltage is applied in the following order: 14.4 V, 28.8 V, 43.2 V, 57.6 V, 72.0 V, 72.0 V, 57.6 V, 43.2 V, 28.8 V, and 14.4 V. When 72.0 V was applied, breakdown occurs and four points are plotted on a graph. In the case of the magnetic core, in order to determine a specific resistance at an electrical field intensity of 1,000 V/cm, when there is no plot passing a vertical line corresponding to the electrical field intensity of 1,000 V/cm, two plots toward the vertical line corresponding to 1,000 V/cm are extrapolated and a specific resistance at an intersection with the vertical line corresponding to 1,000 V/cm is defined as a specific resistance at the time of the application of 1,000 V/cm.

Figure 8:
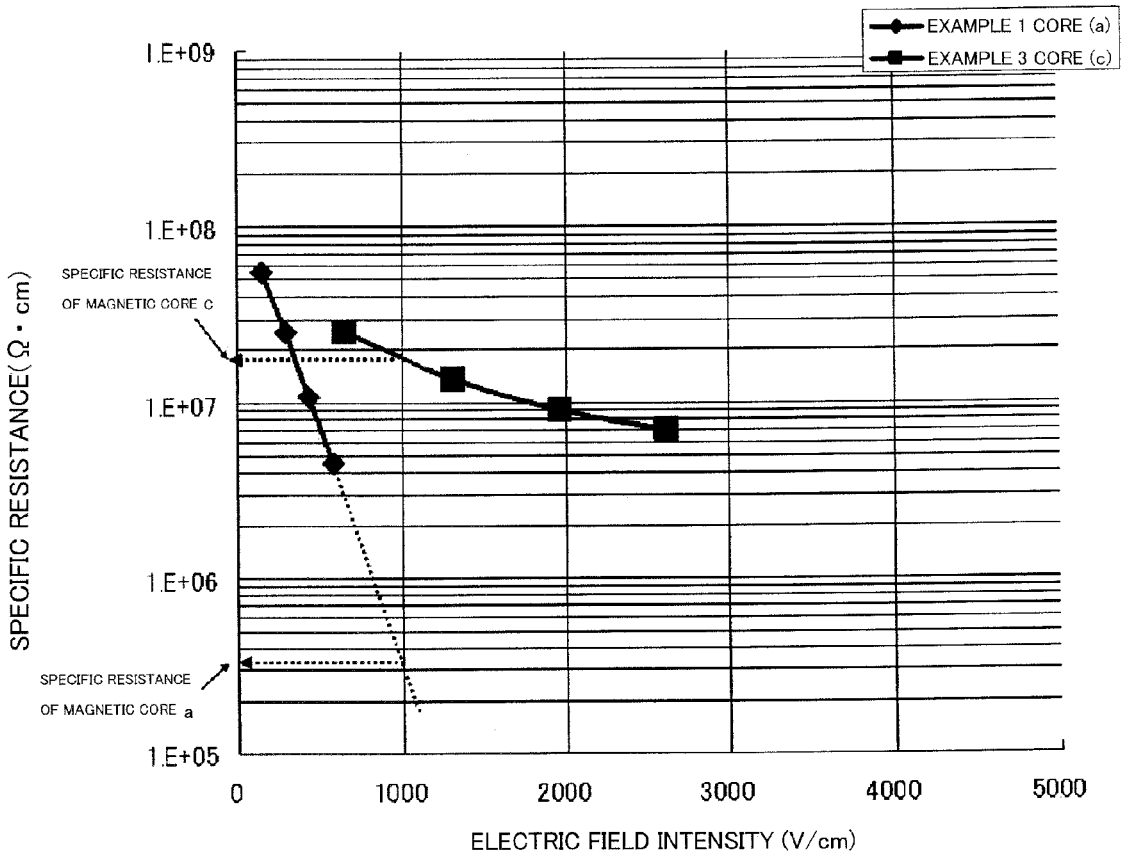
FIG. 8 is a view showing specific resistance data on magnetic cores (a) and (c) used in the present invention.

FIG. 8 shows plots for a magnetic core (a) used in Example 1 and a magnetic core (c) used in Example 3. The plots for the magnetic core (a) used in Example 1 do not include any plot at 1,000 V/cm, and hence the specific resistance at the point of intersection of an extrapolated line indicated by broken lines and a vertical line corresponding to 1,000 V/cm is defined as a specific resistance at the time of the application of 1,000 V/cm, which is $3.2\times10^5$ Ω·cm in this case. On the other hand, the magnetic core (c) used in Example 3 has a specific resistance at the time of the application of 1,000 V/cm of $1.8\times10^7$ Ω·cm as indicated by broken lines.

<Method of Measuring Intensity of Magnetization of Magnetic Carrier>

The intensity of magnetization of the magnetic carrier used in the present invention can be determined with a vibration magnetic field-type magnetic property apparatus "vibrating sample magnetometer" (VSM) or a DC magnetizing property recorder (B—H tracer). The intensity of magnetization can be preferably measured with the vibration magnetic field-type magnetic property apparatus. The vibration magnetic field-type magnetic property apparatus is, for example, a vibration magnetic field-type magnetic property automatic recorder BHV-30 manufactured by Riken Denshi. Co., Ltd. In the present invention, the intensity of magnetization was measured with the recorder in accordance with the operation manual of the recorder by the following procedure.

The magnetic carrier is closely packed into a cylindrical plastic container to a sufficient extent, and, in the meantime, an external magnetic field of 79.6 kA/m is generated. In the state, the magnetizing moment of the carrier packed into the container is measured. In addition, the magnetizing moment of the carrier when the external magnetic field is returned from 79.6 kA/m to 0 kA/m is defined as a residual magnetization. Further, the actual mass of the carrier packed into the container is measured, and the intensity of magnetization ($Am^2/kg$) and residual magnetization ($Am^2/kg$) of the magnetic carrier per unit mass at the time of the application of an external magnetic field of 79.6 kA/m are determined.

<Method of Measuring Apparent Density of Magnetic Carrier>

The apparent density of the magnetic carrier used in the present invention can be determined with a measuring apparatus in conformance with "method of determining apparent density of material that can be poured from specified funnel."

For example, the apparent density can be measured with a Powder Tester PT-R (manufactured by Hosokawa Micron Corporation).

A specific method is as described below. A container having an internal volume of 200 ml is replenished with the magnetic carrier by using a sieve having an aperture of 500 μm vibrated at an amplitude of 1 mm until the magnetic carrier spills from the container. A mountainous portion from the top surface of the container is leveled off with a rod, and then the apparent density ($g/cm^3$) is calculated from the mass of the magnetic carrier in the container.

<Method of Measuring Content of $SiO_2$ and/or $Al_2O_3$ in Magnetic Core>

The content of $SiO_2$ and/or $Al_2O_3$ in the magnetic core used in the present invention can be measured with a fluorescent X-ray analyzer. For example, the contents of elements ranging from Na to U in the magnetic core are directly measured with a wavelength-dispersive fluorescent X-ray analyzer Axios advanced (manufactured by PANalytical) under an He atmosphere by an FP method. At that time, it is assumed that all the detected elements are oxides. The total mass of the oxides is set to 100%, and the content (mass %) of $SiO_2$ and/or $Al_2O_3$ with respect to the total mass is determined in terms of an oxide with a software UniQuant 5 (ver. 5.49).

<Methods of Calculating Ratio of Areas of $SiO_2$ Component and/or $Al_2O_3$ Component to Sectional Area of Magnetic Core and Ratio of Areas of Void Portions to the Sectional Area>

A section of the magnetic core used in the present invention can be processed with a focused ion beam processing observer (FIB) FB-2100 (manufactured by Hitachi High-Technologies Corporation). It should be noted that, in the processing of the section of the magnetic core, a sample which has not been coated with a resin yet is used.

The sample is produced as described below. A carbon paste is applied to the side surface of the tip of a notch mesh for FIB, and a small amount of the particles of the magnetic core are fixed to the carbon paste so that each particle may be independently present. Then, platinum is deposited from the vapor to serve as a conductive film. Particles each having a particle diameter in the range of the 50% particle diameter on a volume basis (D50)±10% are randomly selected as magnetic core particles to be subjected to section processing.

It should be noted that cutting is performed so that the diameter of a processed section to be finally obtained may be substantially the maximum in the processing direction. To be specific, the position of a plane including the maximum length of a particle in the direction parallel to the fixed surface of the sample is defined as a distance h from the fixed surface (for example, in the case of a perfect sphere having a radius of r, h=r). A section is cut out in the distance range of h±10% in the direction perpendicular to the fixed surface (for example, in the case of a perfect sphere having a radius of r, the distance range of r±10% from the fixed surface).

The cutting was performed at an accelerating voltage of 40 kV with a Ga ion source through coarse processing (at a beam current of 39 nA) and finishing (at a beam current of 7 nA).

The sample with its section processed can be directly applied to observation with a scanning electron microscope (SEM). Since the amount of emission of reflected electrons depends on the atomic number of a substance of which the sample is constituted in the observation with a scanning electron microscope, the composition image of the section of each magnetic core particle can be obtained. In the observation of the section of each magnetic core particle used in the present invention, a heavy element region derived from the ferrite component seems to be light (the region has high luminance and becomes white), and a light element region derived from the $SiO_2$ component and/or the $Al_2O_3$ component seems to be dark (the region has low luminance and becomes black). In addition, each void portion becomes black or the recess of the void portion is seen; in each case, the void portion has low luminance and becomes black.

Specifically, a scanning electron microscope (SEM) S-4800 (manufactured by Hitachi High-Technologies Corporation) was used and the observation was performed under the following conditions.

Signal Name=SE (U, LA100)
Accelerating Voltage=5,000 Volt
Emission Current=10,000 nA
Working Distance=8,000 um
Lens Mode=High
Condenser 1=12
Scan Speed=40 sec
Magnification=1,500 (particle diameter 50 μm or less), 1,000 (particle diameter 50 μm or more)
Data size=1,280×960
Color Mode=Gray scale
Specimen Bias=0 V It should be noted that a reflected electron image was captured under the following conditions as well as the above conditions: brightness on the control software of the scanning electron microscope S-4800 was adjusted to "contrast=5, brightness=−5", and a magnetic substance observation mode was turned off. Thus, a 256-level gray-scale image was obtained.

Subsequently, a ratio of the sectional areas of each of the following regions to the sectional area of the magnetic core can be calculated by processing the resultant image: the void portions, the $SiO_2$ component and/or the $Al_2O_3$ component, and the ferrite component. The calculation was specifically performed by the following procedure.

First, only the processed section region of each magnetic core particle is selectively cut out of the resultant gray-scale image, and an image for image analysis is newly produced from the raw image by defining the background as a white color (255) in a 256-level gray scale. The image for image analysis can be produced with general image processing software; in the present invention, a Photoshop 5.0LE (manufactured by Adobe Systems Incorporated) was used.

Next, the ratio of the areas of each of the regions is calculated for the produced image with an image analysis software Image-ProPlus (ver 5.1.1.32 manufactured by Media Cybernetics, Inc.). In the section ""processing"-"false color"", the number of divisions is set to three under the following conditions: an upper limit for the divisions is set to 254, and a lower limit for the divisions is set to 0, in other words, the white color (255), which is the background, is not taken into account.

Subsequently, the gray levels are divided into three divisions in order of increasing levels as follows: the void portions (0 to 19), the $SiO_2$ component and/or the $Al_2O_3$ component (20 to 109), and the ferrite component (110 to 254). Then, the ratio (relative area) of the sectional areas of each of the regions is calculated with a tool "area ratio". Finally, ten magnetic core particles are subjected to the same image processing, and the arithmetic averages of the particles are defined as "the ratio (%) of the sectional areas of the $SiO_2$ component and/or the $Al_2O_3$ component with reference to the sectional area of the magnetic core and the ratio (%) of the sectional areas of the void portions with reference to the sectional area."

Figure 3:
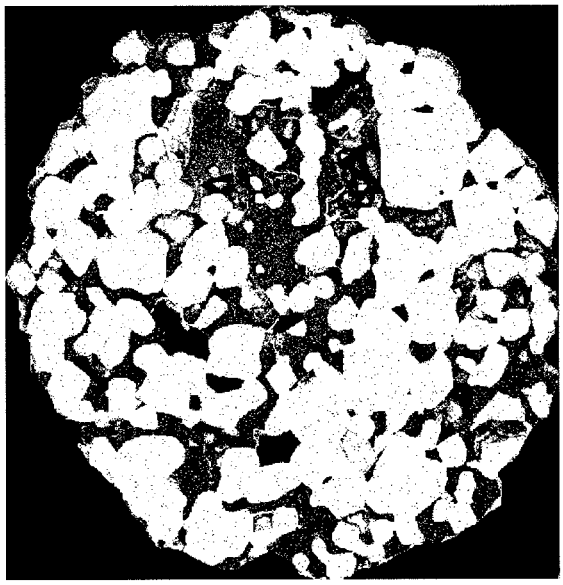
FIG. 3 is a schematic view of an image obtained by processing the SEM reflected electron image of the $SiO_2$-containing magnetic core used in the present invention to binarize a ferrite phase and any other portion.
Figure 4:
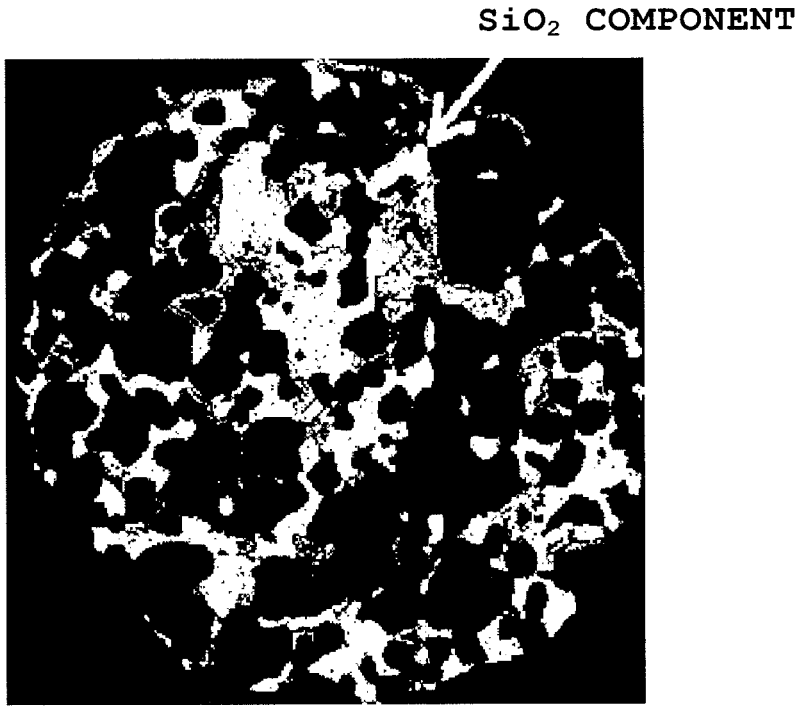
FIG. 4 is a schematic view of an image obtained by processing the SEM reflected electron image of the $SiO_2$-containing magnetic core used in the present invention to binarize a void portion and any other portion.
Figure 5:
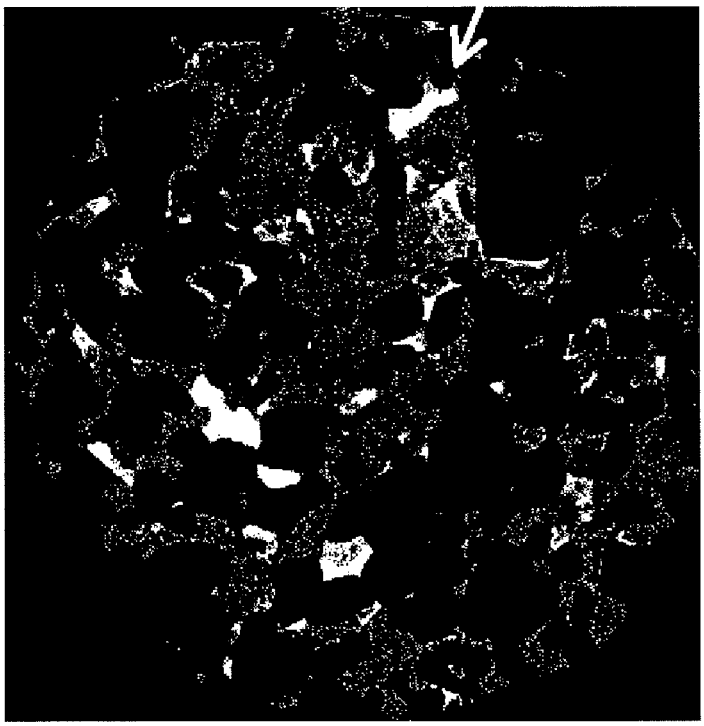
FIG. 5 is a schematic view of an image obtained by processing the SEM reflected electron image of the $SiO_2$-containing magnetic core used in the present invention to binarize an $SiO_2$ phase portion and any other portion.

FIGS. 3, 4, and 5 each show an example of an image obtained by processing the SEM reflected electron image of the $SiO_2$-containing magnetic core used in an example of the present application. FIG. 3 shows a binarized image obtained as follows: a threshold in the cut-out section of the magnetic core is set between the ferrite component and the $SiO_2$ phase (at the boundary between 109 and 110) so that the ferrite component may be represented as a white color. Similarly, FIG. 4 shows a binarized image obtained as follows: thresholds in the cut-out section of the magnetic core are set between the ferrite component and the $SiO_2$ phase (at the boundary between 109 and 110) and between the $SiO_2$ phase and the void portions (at the boundary between 19 and 20) so that the $SiO_2$ phase may be represented as a white color. Similarly, FIG. 5 shows a binarized image obtained as follows: a threshold in the cut-out section of the magnetic core is set between the $SiO_2$ phase and the void portions (at the boundary between 19 and 20) so that the void portions may be represented as a white color. When the region of each phase is binarized as described above, the ratio of the region can be calculated by dividing the area of the region by the area of the entire section of the magnetic core.

<Method of Calculating Ratio of Maximum Length of Each Connecting Phase of Ferrite Component in Section of Magnetic Core to Maximum Diameter of the Section of the Magnetic Core>

The calculation is performed by using an image obtained as follows: the above-mentioned SEM reflected electron image of the section of the magnetic core is subjected to image processing for binarizing the ferrite phase and any other portion so that the ferrite phase may be white. To be specific, a value obtained by the following procedure is calculated (see FIGS. 2 and 3): the maximum length 4 of each connecting phase of the white ferrite component shown in FIG. 3 which can be specified with a straight line without including the region composed of the $SiO_2$ component and/or the $Al_2O_3$ component, and the void region is divided by the maximum diameter 5 of the magnetic core. Here, the term "maximum length of each connecting phase" refers to a continuous ferrite block, and means the maximum length of each connecting phase which can be specified with a straight line without including the region composed of the $SiO_2$ component and/or the $Al_2O_3$ component, and the void region. In addition, the term "maximum diameter of the magnetic core" means the maximum length in the horizontal direction of the image.

It should be noted that, when the magnetic core is subjected to the measurement, the magnetic core which has not been coated yet is used. In addition, the arithmetic average of ten particles of the magnetic core is used as the above ratio.

<Method of Measuring 50% Particle Diameter on Volume Basis (D50) of Magnetic Carrier>

The grain size distribution of the magnetic carrier was measured with a laser diffraction/scattering grain size distribution measuring apparatus "Microtrac MT3300EX" (manufactured by NIKKISO CO., LTD.). The measurement was performed by mounting the measuring apparatus with a sample feeder for dry measurement "one-shot dry-type sample conditioner Turbotrac" (manufactured by NIKKISO CO., LTD.). Conditions under which the Turbotrac fed a sample were as follows: a dust collector was used as a vacuum source, an air quantity was set to about 33 l/sec, and a pressure was set to about 17 kPa. The measuring apparatus is automatically controlled on software. A50% particle diameter (D50) as an accumulated value on a volume basis is determined as the particle diameter of the magnetic carrier. The control and the analysis of measured data are performed with software included with the measuring apparatus (version 10.3.3-202D).

Measurement conditions are as described below.

| | |
|---|---|
| Set Zero time: | 10 seconds |
| Measuring time: | 10 seconds |
| Number of times of measurement: | 1 |
| Particle refractive index: | 1.81 |
| Particle shape: | Nonspherical |
| Measurement upper limit: | 1,408 μm |
| Measurement lower limit: | 0.243 μm |

-continued

| | |
|---|---|
| Measurement environment: | Normal-temperature, normal-humidity environment (23° C., 50% RH) |

<Methods of Measuring 50% Particle Diameter on Volume Basis (D50) and 90% Particle Diameter on Volume Basis (D90) of Finely Pulverized Products of Ferrite>

A laser diffraction/scattering grain size distribution measuring apparatus "Microtrac MT3300EX" (manufactured by NIKKISO CO., LTD.) is used in the measurement of the 50% particle diameter on a volume basis (D50) and 90% particle diameter on a volume basis (D90) of the finely pulverized products of the ferrite (ferrite slurry). The measurement was performed by mounting the measuring apparatus with a wet sample circulator "Sample Delivery Control (SDC)" (manufactured by NIKKISO CO., LTD.). Ion-exchanged water was circulated, and the ferrite slurry was dropped to the sample circulator so that its concentration might be ready for the measurement. A flow rate was set to 70%, ultrasonic power was set to 40 W, and an ultrasonic time was set to 60 seconds. The control of the measuring apparatus, and the calculation of the D50 and D90 are automatically performed on software under the following conditions. A50% particle diameter (D50) and a 90% particle diameter (D90) as accumulated values on a volume basis are determined as the particle diameters of the ferrite slurry.

Measurement conditions are as described below.

| | |
|---|---|
| Set Zero time: | 10 seconds |
| Measuring time: | 30 seconds |
| Number of times of measurement: | 10 |
| Solvent refractive index: | 1.33 |
| Particle refractive index: | 2.42 |
| Particle shape: | Nonspherical |
| Measurement upper limit: | 1,408 μm |
| Measurement lower limit: | 0.243 μm |
| Measurement environment: | Normal-temperature, normal-humidity environment (23° C., 50% RH) |

<Method of Measuring Weight Average Particle Diameter (D4) of Toner and $SiO_2$ and $Al_2O_3$ Used for Magnetic Core>

The weight average particle diameters (D4) of the toner and the like were measured with a precision grain size distribution measuring apparatus based on a pore electrical resistance method provided with a 100-μm aperture tube (weight average particle diameters (D4) of the $SiO_2$ and $Al_2O_3$ were measured with a precision grain size distribution measuring apparatus based on a pore electrical resistance method provided with a 50-μm aperture tube) "Coulter Counter Multisizer 3" (registered trademark, manufactured by Beckman Coulter, Inc.) and dedicated software included with the apparatus "Beckman Coulter Multisizer 3 Version 3.51" (manufactured by Beckman Coulter, Inc.) for setting measurement conditions and analyzing measurement data while the number of effective measurement channels was set to 25,000 whereby the measured data were analyzed to calculate the particle diameter.

An electrolyte solution prepared by dissolving reagent grade sodium chloride in ion-exchanged water to have a concentration of about 1 mass %, for example, an "ISOTON II" (manufactured by Beckman Coulter, Inc.) can be used in the measurement.

It should be noted that the dedicated software was set as described below prior to the measurement and the analysis.

In the "change of standard measurement method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a "threshold/noise level measurement" button. In addition, a current is set to 1,600 μA, a gain is set to 2, and an electrolyte solution is set to an ISOTON II, and a check mark is placed in a check box as to whether the aperture tube is flushed after the measurement.

In the "setting for conversion from pulse to particle diameter" screen of the dedicated software, a bin interval is set to a logarithmic particle diameter, the number of particle diameter bins is set to 256, and a particle diameter range is set to the range of 2 μm to 60 μm. (The particle diameter of $SiO_2$ and $Al_2O_3$ is set in the range of 1 μm to 30 μm.) A specific measurement method is as described below.

(1) About 200 ml of the electrolyte solution are charged into a 250-ml round-bottom beaker made of glass dedicated for the Multisizer 3. The beaker is set in a sample stand, and the electrolyte solution in the beaker is stirred with a stirrer rod at 24 rotations/sec in a counterclockwise direction. Then, dirt and bubbles in the aperture tube are removed by the "aperture flush" function of the analysis software.

(2) About 30 ml of the electrolyte solution are charged into a 100-ml flat-bottom beaker made of glass. About 0.3 ml of a diluted solution prepared by diluting a "Contaminon N" (a 10-mass % aqueous solution of a neutral detergent for washing a precision measuring device formed of a nonionic surfactant, an anionic surfactant, and an organic builder and having a pH of 7, manufactured by Wako Pure Chemical Industries, Ltd.) with ion-exchanged water by three mass-fold is added as a dispersant to the electrolyte solution.

(3) An ultrasonic dispersing unit "Ultrasonic Dispersion System Tetra 150" (manufactured by Nikkaki Bios Co., Ltd.) in which two oscillators each having an oscillatory frequency of 50 kHz are built so as to be out of phase by 180° and which has an electrical output of 120 W is prepared. A predetermined amount of ion-exchanged water is charged into the water tank of the ultrasonic dispersing unit. About 2 ml of the Contaminon N are charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte solution in the beaker may resonate with an ultrasonic wave from the ultrasonic dispersing unit to the fullest extent possible.

(5) About 10 mg of toner, or $SiO_2$ and $Al_2O_3$ are each gradually added to and dispersed in the electrolyte solution in the beaker in the section (4) in a state where the electrolyte solution is irradiated with the ultrasonic wave. Then, the ultrasonic dispersion treatment is continued for an additional 60 seconds. It should be noted that the temperature of water in the water tank is appropriately adjusted so as to be 10° C. or higher and 40° C. or lower upon ultrasonic dispersion.

(6) The electrolyte solution in the section (5) in which each of the toner, $SiO_2$ and $Al_2O_3$ has been dispersed is dropped with a pipette to the round-bottom beaker in the section (1) placed in the sample stand, and the concentration of sample to be measured is adjusted to about 5%. Then, measurement is performed until the particle diameters of 50,000 particles are measured.

(7) The measurement data is analyzed with the dedicated software included with the apparatus, and the weight average particle diameter (D4) is calculated. It should be noted that an "average diameter" on the "analysis/volume statistics (arithmetic average)" screen of the dedicated software ("Beckman Coulter Multisizer 3 Version 3.51") when the dedicated software is set to show a graph in a vol % unit is the weight average particle diameter (D4).

<Method of Measuring Average Circularity of Toner>

The average circularity of toner can be measured with a flow-type particle image analyzer "FPIA-3000 model" (manufactured by SYSMEX CORPORATION) under the same measurement and analysis conditions as those at the time of a calibration operation for the apparatus.

The measurement principle of the flow-type particle image analyzer "FPIA-3000 type" (manufactured by SYSMEX CORPORATION) is as follows: flowing particles are photographed as a static image, and the image is analyzed. A sample added to a sample chamber is transferred to a flat sheath flow cell with a sample sucking syringe. The sample transferred to the flat sheath flow cell is sandwiched by sheath liquids to form a flat flow. The sample passing through the inside of the flat sheath flow cell is irradiated with stroboscopic light at an interval of 1/60 second, whereby flowing particles can be photographed as a static image. In addition, the particles are photographed in focus because the flow of the particles is flat. A particle image is photographed with a CCD camera, and the photographed image is subjected to image processing at an image processing resolution of 512×512 pixels (each measuring 0.37 μm by 0.37 μm), whereby the border of each particle image is sampled. Then, the projected area, perimeter, and the like of each particle image are measured.

Next, projected areas S and the perimeter L of each measured particle image are measured. With the value for area S and perimeter L, a circle-equivalent diameter and a circularity are determined. The circle-equivalent diameter is defined as the diameter of a circle having the same area as that of the projected area of a particle image, the circularity is defined as a value obtained by dividing the perimeter of a circle determined from the circle-equivalent diameter by the perimeter of a particle projected image, and the circle-equivalent diameter and the circularity are calculated from the following equations.

$$C=2\times(\pi\times S)^{1/2}/L$$

When a particle image is of a round shape, the circularity of the particle in the image becomes 1.000. With an increase in a perimeter unevenness degree of the particle image, the circularity of the particle decreases.

After the circularities of the respective particles have been calculated, a circularity range of 0.200 to 1.000 is divided into 800 sections. The number of particles measured is used to calculate the average circularity.

As a specific measurement method, 0.1 ml of a surfactant, preferably alkylbenzene sulfonate, as a dispersant is added to 20 ml of ion-exchanged water, and then 0.5 g of a measurement sample is added to the mixture. Then, the mixture is subjected to a dispersion treatment with a desktop ultrasonic cleaning and dispersing machine having an oscillatory frequency of 50 kHz and an electrical output of 150 W ("VS-150" (manufactured by VELVO-CLEAR)) for 2 minutes, whereby a dispersion liquid for measurement is obtained. At that time, the dispersion liquid is appropriately cooled so as to have a temperature of 10° C. or higher and 40° C. or lower.

The flow-type particle image analyzer mounted with a standard objective lens (at a magnification of 10) is used in the measurement, and a particle sheath "PSE-900A" (manufactured by SYSMEX CORPORATION) is used as the sheath liquid. The dispersion liquid prepared in accordance with the above procedure is introduced into the flow-type particle image analyzer, and the particle diameters of 30,000 toner particles are measured according to the total count mode of an HPF measurement mode. Then, the average circularity of the toner particle is determined with a binarization threshold at the time of particle analysis set to 85% and particle diameters to be analyzed limited to ones each corresponding to a circle-equivalent diameter of 2.00 μm or more and 200.00 μm or less.

Prior to the initiation of the measurement, automatic focusing is performed by using standard latex particles (obtained by diluting a 5200A manufactured by Duke Scientific with ion-exchanged water). After that, focusing is preferably performed every two hours from the initiation of the measurement.

It should be noted that, in each example of the present application, calibration is conducted by SYSMEX CORPORATION, whereby a flow-type particle image analyzer which has received a calibration certificate issued by SYSMEX CORPORATION is used. At that time, the measurement is performed under measurement and analysis conditions identical to those at the time of the reception of the calibration certificate except that particle diameters to be analyzed are limited to ones each corresponding to a circle-equivalent diameter of 2.00 μm or more and 200.00 μm or less.

<Method of Measuring Grain Size Distribution on Number Basis of Inorganic Fine Particles Used in Toner>

The grain size distribution on a number basis of the inorganic fine particles used in the above toner is determined by observation with a scanning electron microscope (SEM) at a magnification of 50,000.

To be specific, the toner is observed in an undeposited state with a scanning electron microscope S-4800 (manufactured by Hitachi, Ltd.) at an accelerating voltage of 2.0 kV. A reflected electron image is observed at a magnification of 50,000. Since the amount of emission of reflected electrons depends on the atomic number of a substance of which the sample is constituted, contrast is established between each inorganic fine particle and an organic substance such as a toner particle base. A particle made of a component lighter (whiter) than the toner particle base can be judged to be an inorganic fine particle. Then, 500 fine particles each having a particle diameter of 5 nm or more are sampled at random. The longer diameter and shorter diameter of each of the sampled particles are measured with a digitizer, and the average of the longer diameter and the shorter diameter is defined as the particle diameter of the fine particle. In the grain size distribution of the 500 sampled particles (a histogram of columns each having a width of 10 nm like 5 to 15 nm, 15 to 25 nm, 25 to 35 nm, . . . is used), a histogram is drawn by using a particle diameter as the central value in each column. A particle diameter as a local maximum in the grain size distribution on a number basis is judged from the histogram. The number of particle diameters as local maxima in the histogram may be one or two or more.

<Method of Measuring Triboelectric Charge Quantity of Toner by Two-Component Method Using the Toner and Magnetic Carrier>

The toner and the magnetic carrier are subjected to moisture conditioning under a normal-temperature, normal-humidity environment (23° C., 50%) for 24 hours. The toner and the magnetic carrier are loaded into a V-type mixer so that a developer concentration ready for evaluation in an actual machine may be achieved. To be specific, in the case of Example 1, 9.0 kg of the magnetic carrier and 1.0 kg of the toner, which is to be placed on the magnetic carrier, are weighed, a container containing the magnetic carrier and the toner is covered with a lid in a state where the magnetic carrier and the toner are laminated, and the magnetic carrier and the toner are shaken with the V-type mixer at 150 $min^{-1}$ for 10 minutes. The mixed developer is charged into a developer container, a developer carrying member is rotated for 2 minutes, and the developer on the developer carrying member is sampled with a magnet. The triboelectric charge quantity of the toner at this time is defined as an initial triboelectric charge quantity. Further, a developer which has been subjected to duration is used for image output until a toner concentration reaches an initially set value. In that case, when one wishes to increase the toner concentration, a print percentage is set to 1%, and the amount of the toner to be replenished is set to be 1.01 times as large as the amount of the toner to be consumed. When one wishes to decrease the toner concentration, the print percentage is set to 20%, and there is no toner to be replenished.

A suction separation type charge quantity measuring device Sepasoft STC-1-C1 model (manufactured by SANKYO PIO-TECH. CO., Ltd.) is used as a device for measuring a triboelectric charge quantity. A mesh (metal gauze) having an aperture of 20 μm is placed at the bottom of a sample holder (Faraday gauge), 0.10 g of a developer is placed on the mesh, and the holder is capped. The mass of the entirety of the sample holder at that time is weighed and represented by W1 (g). Next, the sample holder is installed in the main body of the device, and a suction pressure is set to 2 kPa by adjusting an air quantity control valve. In this state, the toner is removed by suction for 2 minutes. Charge at that time is represented by Q (μC). In addition, the mass of the entirety of the sample holder after the suction is weighed and represented by W2 (g). Since Q thus determined corresponds to the measured value for the charge of the carrier, the triboelectric charge quantity of the toner is opposite in polarity to Q. The absolute value for the triboelectric charge quantity (mC/kg) of the developer is calculated from the following equation. It should be noted that the measurement is also performed under the normal-temperature, normal-humidity environment (23° C., 50%).

$$\text{Triboelectric charge quantity}(mC/kg)=Q/(W1-W2) \quad \text{(Equation)}$$

EXAMPLES

Hereinafter, the description will be described more specifically with reference to examples. However, the present invention is not limited to these examples. The term "part(s)" used in the examples refers to "part(s) by mass" without any exception.

Production Example of Magnetic Core a 70 parts by mass of $Fe_2O_3$ and 30 parts by mass of $MnCO_3$ were weighed. Water was added to the materials, and the contents were subjected to wet mixing with a ball mill. After the wet mixing, the resultant was calcined at a temperature of 900° C. for 2 hours, whereby a ferrite was produced. The ferrite was pulverized with a crusher into products each having a diameter of about 0.1 to 1.0 mm. After that, water was added to the products, and the products were finely pulverized with a ball mill into products each having a diameter of 0.1 to 0.5 μm, whereby ferrite slurry was obtained. The finely pulverized products of the ferrite had a 50% particle diameter on a volume basis (D50) of 0.4 μm and a 90% particle diameter on a volume basis (D90) of 0.9 μm. Next, 5 parts by mass of spherical $SiO_2$ having a weight-average particle diameter of 4 μm, 2.0 parts by mass of polyvinyl alcohol having a weight-average molecular weight of 5,000 as a binder, 1.5 parts by mass of polyammonium carboxylate as a dispersant, and 0.05 part by mass of a nonionic surfactant as a wetting agent were weighed with respect to 100 parts by mass of the finely pulverized products of the ferrite in the slurry, and were added to the slurry. The mixture was granulated and dried with a Spray Dryer (manufactured by OHKAWARA KAKOHKI CO., LTD.). The granulated product was fired under a nitrogen atmosphere having an oxygen concentration of 1.0% in an electric furnace having a temperature of 1,150° C. for 5 hours. After the firing, the resultant was shredded with a hammer mill. Coarse particles were removed with a sieve having an aperture of 100 μm, and a fine powder was removed with an air classifier (Elbow Jet EJ-LABO: manufactured by Nittetsu Mining Co., Ltd.), whereby the magnetic core a was obtained. Table 1 shows the composition and physical properties of the resultant magnetic core.

Production Example of Magnetic Core b

A magnetic core b was obtained in the same manner as in the magnetic core a except that 20 parts by mass of spherical $SiO_2$ having a weight-average particle diameter of 4 μm were added to 100 parts by mass of the finely pulverized products of the ferrite in the ferrite slurry in the case of the magnetic core a. Table 1 shows the composition and physical properties of the resultant magnetic core.

Production Example of Magnetic Core c

The magnetic core c was obtained in the same manner as in the magnetic core a except that 40 parts by mass of spherical $SiO_2$ having a weight-average particle diameter of 4 μm were added to 100 parts by mass of the finely pulverized products of the ferrite in the ferrite slurry in the case of the magnetic core a. Table 1 shows the composition and physical properties of the resultant magnetic core.

Production Example of Magnetic Core d 75 parts by mass of $Fe_2O_3$, 23 parts by mass of $MnCO_3$, and 2 parts by mass of $Mg(OH)_2$ were weighed. Water was added to the materials, and the contents were subjected to wet mixing with a ball mill. After the wet mixing, the resultant was calcined at a temperature of 900° C. for 2 hours, whereby a ferrite was produced. The ferrite was pulverized with a crusher into products each having a diameter of about 0.1 to 1.0 mm. After that, water was added to the products, and the products were finely pulverized with a ball mill into products each having a diameter of 0.1 to 0.5 μm, whereby ferrite slurry was obtained. The finely pulverized products of the ferrite had a 50% particle diameter on a volume basis (D50) of 0.4 μm and a 90% particle diameter on a volume basis (D90) of 1.1 μm. Next, 10 parts by mass of spherical $SiO_2$ having a weight-average particle diameter of 4 μm, 2.0 parts by mass of polyvinyl alcohol having a weight-average molecular weight of 5,000 as a binder, 1.5 parts by mass of polyammonium carboxylate as a dispersant, and 0.05 part by mass of a nonionic surfactant as a wetting agent were weighed with respect to 100 parts by mass of the finely pulverized products of the ferrite in the slurry, and were added to the slurry. The mixture was granulated and dried with a Spray Dryer (manufactured by OHKAWARA KAKOHKI CO., LTD.). The granulated product was fired under a nitrogen atmosphere having an oxygen concentration of 1.0% in an electric furnace having a temperature of 1,200° C. for 4 hours. The resultant was further fired under a nitrogen atmosphere having an oxygen concentration of 0.1% at a temperature of 750° C. for 1 hour.

After the firing, the resultant was shredded with a hammer mill. Coarse particles were removed with a sieve having an aperture of 100 μm, and a fine powder was removed with an air classifier (Elbow Jet EJ-LABO: manufactured by Nittetsu Mining Co., Ltd.), whereby the magnetic core d was obtained. Table 1 shows the composition and physical properties of the resultant magnetic core.

Production Example of Magnetic Core e

A magnetic core e was obtained in the same manner as in the magnetic core a except that: $SiO_2$ in the magnetic core a was changed to amorphous $Al_2O_3$ having a weight-average particle diameter of 5 μm; and 40 parts by mass of $Al_2O_3$ described above were added to 100 parts by mass of the finely pulverized products of the ferrite in the ferrite slurry. Table 1 shows the composition and physical properties of the resultant magnetic core.

Production Example of Magnetic Core f 92 parts by mass of $Fe_2O_3$ and 8 parts by mass of $Mg(OH)_2$ were weighed. Water was added to the materials, and the contents were subjected to wet mixing with a ball mill. After the wet mixing, the resultant was calcined at a temperature of 900° C. for 2 hours, whereby a ferrite was produced. The ferrite was pulverized with a crusher into products each having a diameter of about 0.1 to 1.0 mm. After that, water was added to the products, and the products were finely pulverized with a ball mill into products each having a diameter of 0.1 to 0.5 μm, whereby ferrite slurry was obtained. The finely pulverized products of the ferrite had a 50% particle diameter on a volume basis (D50) of 0.4 μm and a 90% particle diameter on a volume basis (D90) of 1.5 μm. Next, 45 parts by mass of spherical $SiO_2$ having a weight-average particle diameter of 4 μm, 2.0 parts by mass of polyvinyl alcohol having a weight-average molecular weight of 5,000 as a binder, 1.5 parts by mass of polyammonium carboxylate as a dispersant, and 0.05 part by mass of a nonionic surfactant as a wetting agent were weighed with respect to 100 parts by mass of the finely pulverized products of the ferrite in the slurry, and were added to the slurry. The mixture was granulated and dried with a Spray Dryer (manufactured by OHKAWARA KAKOHKI CO., LTD.). The granulated product was fired under a nitrogen atmosphere having an oxygen concentration of 1.0% in an electric furnace having a temperature of 1,150° C. for 5 hours. After the firing, the resultant was shredded with a hammer mill. Coarse particles were removed with a sieve having an aperture of 100 μm, and a fine powder was removed with an air classifier (Elbow Jet EJ-LABO: manufactured by Nittetsu Mining Co., Ltd.), whereby the magnetic core f was obtained. Table 1 shows the composition and physical properties of the resultant magnetic core.

Production Example of Magnetic Core g

A magnetic core g was obtained in the same manner as in the magnetic core b except for the following changes. In the granulating step involving the use of the ferrite slurry in the case of the magnetic core b, the number of revolutions of the atomizer disk of the Spray Dryer was reduced. In addition, in the firing step involving the use of the granulated product after a treatment with the Spray Dryer, the granulated product was fired under a nitrogen atmosphere having an oxygen concentration of 1.0% in an electric furnace having a temperature of 1,300° C. for 5 hours, and small particles were removed at the time of air classification. Table 1 shows the composition and physical properties of the resultant magnetic core.

Production Example of Magnetic Core h

A magnetic core h was obtained in the same manner as in the magnetic core b except for the following changes. In the granulating step involving the use of the ferrite slurry in the case of the magnetic core b, the number of revolutions of the atomizer disk of the Spray Dryer was raised. In addition, in the firing step involving the use of the granulated product after a treatment with the Spray Dryer, the granulated product was fired under a nitrogen atmosphere having an oxygen concentration of 1.0% in an electric furnace having a temperature of 950° C. for 4 hours, and large particles were removed at the time of air classification. Table 1 shows the composition and physical properties of the resultant magnetic core.

Production Example of Magnetic Core i 60 parts by mass of $Fe_2O_3$ and 40 parts by mass of $MnCO_3$ were weighed. Water was added to the materials, and the contents were subjected to wet mixing with a ball mill. After the wet mixing, the resultant was calcined at a temperature of 900° C. for 2 hours, whereby a ferrite was produced. The ferrite was pulverized with a crusher into products each having a diameter of about 0.1 to 1.0 mm. After that, water was added to the products, and the products were finely pulverized with a ball mill into products each having a diameter of 0.1 to 5.0 μm, whereby ferrite slurry was obtained. The finely pulverized products of the ferrite had a 50% particle diameter on a volume basis (D50) of 2.1 μm and a 90% particle diameter on a volume basis (D90) of 6.3 μm. Next, 30 parts by mass of spherical $SiO_2$ having a weight-average particle diameter of 4 μm, 2.0 parts by mass of polyvinyl alcohol having a weight-average molecular weight of 5,000 as a binder, 1.5 parts by mass of polyammonium carboxylate as a dispersant, and 0.05 part by mass of a nonionic surfactant as a wetting agent were weighed with respect to 100 parts by mass of the finely pulverized products of the ferrite in the slurry, and were added to the slurry. The mixture was granulated and dried with a Spray Dryer (manufactured by OHKAWARA KAKOHKI CO., LTD.). The granulated product was fired under a nitrogen atmosphere having an oxygen concentration of 1.0% in an electric furnace having a temperature of 950° C. for 4 hours. After the firing, the resultant was shredded with a hammer mill. Coarse particles were removed with a sieve having an aperture of 100 μm, and a fine powder was removed with an air classifier (Elbow Jet EJ-LABO: manufactured by Nittetsu Mining Co., Ltd.), whereby the magnetic core i was obtained. Table 1 shows the composition and physical properties of the resultant magnetic core.

Production Example of Magnetic Core j

A magnetic core j was obtained in the same manner as in the magnetic core a except that 50 parts by mass of spherical $SiO_2$ having a weight-average particle diameter of 4 μm were added to 100 parts by mass of the finely pulverized products of the ferrite in the ferrite slurry in the case of the magnetic core a. Table 1 shows the composition and physical properties of the resultant magnetic core.

Production Example of Magnetic Core k 78 parts by mass of $Fe_2O_3$, 12 parts by mass of ZnO, and 10 parts by mass of CuO were weighed. Water was added to the materials, and the contents were subjected to wet mixing with a ball mill. After the wet mixing, the resultant was calcined at a temperature of 900° C. for 2 hours, whereby a ferrite was produced. The ferrite was pulverized with a crusher into products each having a diameter of about 0.1 to 1.0 mm. After that, water was added to the products, and the products were finely pulverized with a ball mill into products each having a diameter of 0.1 to 0.5 μm, whereby ferrite slurry was obtained. The finely pulverized products of the ferrite had a 50% particle diameter on a volume basis (D50) of 0.4 μm and a 90% particle diameter on a volume basis (D90) of 1.0 μm. Next, 2.0 parts by mass of polyvinyl alcohol having a weight-average molecular weight of 5,000 as a binder, 1.5 parts by mass of polyammonium carboxylate as a dispersant, and 0.05 part by mass of a nonionic surfactant as a wetting agent were weighed with respect to 100 parts by mass of the finely pulverized products of the ferrite in the slurry, and were added to the slurry. The mixture was granulated and dried with a Spray Dryer (manufactured by OHKAWARA KAKOHKI CO., LTD.). The granulated product was fired under a nitrogen atmosphere having an oxygen concentration of 1.0% in an electric furnace having a temperature of 1,150° C. for 5 hours. After the firing, the resultant was shredded with a hammer mill. Coarse particles were removed with a sieve having an aperture of 100 μm, and a fine powder was removed with an air classifier (Elbow Jet EJ-LABO: manufactured by Nittetsu Mining Co., Ltd.), whereby the magnetic core k was obtained. Table 1 shows the composition and physical properties of the resultant magnetic core.

Production Example of Magnetic Core l 4 parts by mass of spherical $SiO_2$ having a weight-average particle diameter of 4 μm, 2.0 parts by mass of polyvinyl alcohol having a weight-average molecular weight of 5,000 as a binder, 1.5 parts by mass of polyammonium carboxylate as a dispersant, and 0.05 part by mass of a nonionic surfactant as a wetting agent were weighed with respect to 100 parts by mass of magnetite having a 50% particle diameter on a volume basis (D50) of 0.3 μm and a 90% particle diameter on a volume basis (D90) of 0.6 μm in water, and were added to magnetite. The mixture was granulated and dried with a Spray Dryer (manufactured by OHKAWARA KAKOHKI CO., LTD.). The granulated product was fired under a nitrogen atmosphere having an oxygen concentration of 1.0% in an electric furnace having a temperature of 1,150° C. for 5 hours. After the firing, the resultant was shredded with a hammer mill. Coarse particles were removed with a sieve having an aperture of 100 μm, and a fine powder was removed with an air classifier (Elbow Jet EJ-LABO: manufactured by Nittetsu Mining Co., Ltd.), whereby a magnetic core l was obtained. Table 1 shows the composition and physical properties of the resultant magnetic core.

Production Example of Magnetic Core m 91 parts by mass of $Fe_2O_3$ and 9 parts by mass of $Mg(OH)_2$ were weighed. Water was added to the materials, and the contents were subjected to wet mixing with a ball mill. After the wet mixing, the resultant was calcined at a temperature of 900° C. for 2 hours, whereby a ferrite was produced. The ferrite was pulverized with a crusher into products each having a diameter of about 0.1 to 1.0 mm. After that, water was added to the products, and the products were finely pulverized with a ball mill into products each having a diameter of 0.1 to 0.5 μm, whereby ferrite slurry was obtained. The finely pulverized products of the ferrite had a 50% particle diameter on a volume basis (D50) of 0.6 μm and a 90% particle diameter on a volume basis (D90) of 1.4 μm. Next, 20 parts by mass of spherical $SiO_2$ having a weight-average particle diameter of 6 μm, 2.0 parts by mass of polyvinyl alcohol having a weight-average molecular weight of 5,000 as a binder, 1.5 parts by mass of polyammonium carboxylate as a dispersant, and 0.05 part by mass of a nonionic surfactant as a wetting agent were weighed with respect to 100 parts by mass of the finely pulverized products of the ferrite in the slurry, and were added to the slurry. The mixture was granulated and dried with a Spray Dryer (manufactured by OHKAWARA KAKOHKI CO., LTD.). The granulated product was fired under a nitrogen atmosphere having an oxygen concentration of 0.1% in an electric furnace having a temperature of 1,100° C. for 5 hours. After the firing, the resultant was shredded with a hammer mill. Coarse particles were removed with a sieve having an aperture of 100 μm, and a fine powder was removed with an air classifier (Elbow Jet EJ-LABO: manufactured by Nittetsu Mining Co., Ltd.), whereby the magnetic core m was obtained. Table 1 shows the composition and physical properties of the resultant magnetic core.

Production Example of Magnetic Core n

A magnetic core n was obtained in the same manner as in the magnetic core a except that 3 parts by mass of spherical $SiO_2$ having a weight-average particle diameter of 4 μm were added to 100 parts by mass of the finely pulverized products of the ferrite in the ferrite slurry in the case of the magnetic core a. Table 1 shows the composition and physical properties of the resultant magnetic core.

Production Example of Magnetic Core o

A magnetic core o was obtained in the same manner as in the magnetic core a except that 50 parts by mass of spherical $SiO_2$ having a weight-average particle diameter of 4 μm were added to 100 parts by mass of the finely pulverized products of the ferrite in the ferrite slurry in the case of the magnetic core a. Table 1 shows the composition and physical properties of the resultant magnetic core.

Production Example of Magnetic Core p 70 parts by mass of $Fe_2O_3$ and 30 parts by mass of $MnCO_3$ were weighed. Water was added to the materials, and the contents were subjected to wet mixing with a ball mill. After the wet mixing, the resultant was calcined at a temperature of 900° C. for 2 hours, whereby a ferrite was produced. The ferrite was pulverized with a crusher into products each having a diameter of about 0.1 to 1.0 mm. After that, water was added to the products, and the products were finely pulverized with a ball mill into products each having a diameter of 0.1 to 0.5 μm, whereby ferrite slurry was obtained. The finely pulverized products of the ferrite had a 50% particle diameter on a volume basis (D50) of 0.4 μm and a 90% particle diameter on a volume basis (D90) of 0.9 μm. Next, 5 parts by mass of spherical $SiO_2$ having a weight-average particle diameter of 4 μm, 2.0 parts by mass of polyvinyl alcohol having a weight-average molecular weight of 5,000 as a binder, 1.5 parts by mass of polyammonium carboxylate as a dispersant, and 0.05 part by mass of a nonionic surfactant as a wetting agent were weighed with respect to 100 parts by mass of the finely pulverized products of the ferrite in the slurry, and were added to the slurry. The mixture was granulated and dried with a Spray Dryer (manufactured by OHKAWARA KAKOHKI CO., LTD.). The granulated product was fired under a nitrogen atmosphere having an oxygen concentration of 1.0% in an electric furnace having a temperature of 1,150° C. for 5 hours. After being cooled, the resultant was placed again in the electric furnace and was subjected to a reduction treatment at a temperature of 500° C. in a hydrogen reducing atmosphere for 3 hours. After that, the resultant was shredded with a hammer mill. Coarse particles were removed with a sieve having an aperture of 100 μm, and a fine powder was removed with an air classifier (Elbow Jet EJ-LABO: manufactured by Nittetsu Mining Co., Ltd.), whereby the magnetic core p was obtained. Table 1 shows the composition and physical properties of the resultant magnetic core.

Production Example of Magnetic Core q 70 parts by mass of $Fe_2O_3$ and 30 parts by mass of $MnCO_3$ were weighed. Water was added to the materials, and the contents were subjected to wet mixing with a ball mill. After the wet mixing, the resultant was calcined at a temperature of 900° C. for 2 hours, whereby a ferrite was produced. The ferrite was pulverized with a crusher into products each having a diameter of about 0.1 to 1.0 mm. After that, water was added to the products, and the products were finely pulverized with a ball mill into products each having a diameter of 0.1 to 0.5 μm, whereby ferrite slurry was obtained. The finely pulverized products of the ferrite had a 50% particle diameter on a volume basis (D50) of 0.4 μm and a 90% particle diameter on a volume basis (D90) of 0.9 μm. Next, 30 parts by mass of spherical $SiO_2$ having a weight-average particle diameter of 4 μm, 2.0 parts by mass of polyvinyl alcohol having a weight-average molecular weight of 5,000 as a binder, 1.5 parts by mass of polyammonium carboxylate as a dispersant, and 0.05 part by mass of a nonionic surfactant as a wetting agent were weighed with respect to 100 parts by mass of the finely pulverized products of the ferrite in the slurry, and were added to the slurry. The mixture was granulated and dried with a Spray Dryer (manufactured by OHKAWARA KAKOHKI CO., LTD.). The granulated product was fired under a nitrogen atmosphere having an oxygen concentration of 1.0% in an electric furnace having a temperature of 980° C. for 5 hours. After being cooled, the resultant was placed again in the electric furnace and was subjected to a resistance-increasing treatment at a temperature of 400° C. in an oxygen/nitrogen atmosphere for 3 hours so as to have the oxygen concentration of 30.0%. After the resistance-increasing treatment, the resultant was shredded with a hammer mill. Coarse particles were removed with a sieve having an aperture of 100 μm, and a fine powder was removed with an air classifier (Elbow Jet EJ-LABO: manufactured by Nittetsu Mining Co., Ltd.), whereby the magnetic core q was obtained. Table 1 shows the composition and physical properties of the resultant magnetic core.

Production Example of Magnetic Core r 92 parts by mass of $Fe_2O_3$ and 8 parts by mass of $Mg(OH)_2$ were weighed. Water was added to the materials, and the contents were subjected to wet mixing with a ball mill. After the wet mixing, the resultant was calcined at a temperature of 900° C. for 2 hours, whereby a ferrite was produced. The ferrite was pulverized with a crusher into products each having a diameter of about 0.1 to 1.0 mm. After that, water was added to the products, and the products were finely pulverized with a ball mill into products each having a diameter of 0.1 to 0.5 μm, whereby ferrite slurry was obtained. The finely pulverized products of the ferrite had a 50% particle diameter on a volume basis (D50) of 0.4 μm and a 90% particle diameter on a volume basis (D90) of 1.5 μm. Next, 30 parts by mass of spherical $SiO_2$ having a weight-average particle diameter of 4 μm, 2.0 parts by mass of polyvinyl alcohol having a weight-average molecular weight of 5,000 as a binder, 1.5 parts by mass of polyammonium carboxylate as a dispersant, and 0.05 part by mass of a nonionic surfactant as a wetting agent were weighed with respect to 100 parts by mass of the finely pulverized products of the ferrite in the slurry, and were added to the slurry. The mixture was granulated and dried with a Spray Dryer (manufactured by OHKAWARA KAKOHKI CO., LTD.). The granulated product was fired under a nitrogen atmosphere having an oxygen concentration of 1.0% in an electric furnace having a temperature of 1,150° C. for 5 hours. After being cooled, the resultant was placed again in the electric furnace and was subjected to a resistance-increasing treatment at a temperature of 400° C. in an oxygen/nitrogen atmosphere for 3 hours so as to have the oxygen concentration of 30.0%. After the resistance-increasing treatment, the resultant was shredded with a hammer mill. Coarse particles were removed with a sieve having an aperture of 100 μm, and a fine powder was removed with an air classifier (Elbow Jet EJ-LABO: manufactured by Nittetsu Mining Co., Ltd.), whereby the magnetic core r was obtained. Table 1 shows the composition and physical properties of the resultant magnetic core.

Production Example of Magnetic Core s 60 parts by mass of $Fe_2O_3$ and 40 parts by mass of $MnCO_3$ were weighed. Water was added to the materials, and the contents were subjected to wet mixing with a ball mill. After the wet mixing, the resultant was calcined at a temperature of 900° C. for 2 hours, whereby a ferrite was produced. The ferrite was pulverized with a crusher into products each having a diameter of about 0.1 to 1.0 mm. After that, water was added to the products, and the products were finely pulverized with a ball mill into products each having a diameter of 1.0 to 5.0 μm, whereby ferrite slurry was obtained. The finely pulverized products of the ferrite had a 50% particle diameter on a volume basis (D50) of 2.1 μm and a 90% particle diameter on a volume basis (D90) of 6.3 μm. Next, 5 parts by mass of spherical $SiO_2$ having a weight-average particle diameter of 4 μm, 2.0 parts by mass of polyvinyl alcohol having a weight-average molecular weight of 5,000 as a binder, 1.5 parts by mass of polyammonium carboxylate as a dispersant, and 0.05 part by mass of a nonionic surfactant as a wetting agent were weighed with respect to 100 parts by mass of the finely pulverized products of the ferrite in the slurry, and were added to the slurry. The mixture was granulated and dried with a Spray Dryer (manufactured by OHKAWARA KAKOHKI CO., LTD.). The granulated product was fired under a nitrogen atmosphere having an oxygen concentration of 1.0% in an electric furnace having a temperature of 1,130° C. for 4 hours. After being cooled, the resultant was placed again in the electric furnace and was subjected to a reduction treatment at a temperature of 450° C. in a hydrogen reducing atmosphere for 3 hours. After that, the resultant was shredded with a hammer mill. Coarse particles were removed with a sieve having an aperture of 100 μm, and a fine powder was removed with an air classifier (Elbow Jet EJ-LABO: manufactured by Nittetsu Mining Co., Ltd.), whereby the magnetic core s was obtained. Table 1 shows the composition and physical properties of the resultant magnetic core.

Production Example of Magnetic Core t 10 parts by mass of spherical $SiO_2$ having a weight-average particle diameter of 4 μm, 2.0 parts by mass of polyvinyl alcohol having a weight-average molecular weight of 5,000 as a binder, 1.5 parts by mass of polyammonium carboxylate as a dispersant, and 0.05 part by mass of a nonionic surfactant as a wetting agent were weighed with respect to 100 parts by mass of magnetite having a 50% particle diameter on a volume basis (D50) of 0.3 μm and a 90% particle diameter on a volume basis (D90) of 0.6 μm in water, and were added to magnetite. The mixture was granulated and dried with a Spray Dryer (manufactured by OHKAWARA KAKOHKI CO., LTD.). The granulated product was fired under a nitrogen atmosphere having an oxygen concentration of 0.5% in an electric furnace having a temperature of 1,130° C. for 5 hours. After the firing, the resultant was shredded with a hammer mill. Coarse particles were removed with a sieve having an aperture of 100 μm, and a fine powder was removed with an air classifier (Elbow Jet EJ-LABO: manufactured by Nittetsu Mining Co., Ltd.), whereby a magnetic core t was obtained. Table 1 shows the composition and physical properties of the resultant magnetic core.

TABLE 1

| Core | $Fe_2O_3$:$MnCO_3$:$Mg(OH)_2$ Parts by mass | Composition | $SiO_2$ Parts by mass | $Al_2O_3$ Parts by mass | Content of $SiO_2$ and $Al_2O_3$ Mass % | Areas of $SiO_2$ and $Al_2O_3$ Sectional area % | Maximum length of connecting phase of ferrite/maximum diameter of magnetic core % (Average) | Void Sectional area % | Core specific resistance (1000 V/cm) Ω · cm |
|---|---|---|---|---|---|---|---|---|---|
| a | 70:30:0 | $(Fe_2O_3)_{0.63}(MnO)_{0.37}$ | 5 | — | 4.3 | 3 | 85 | 2 | $3.2 \times 10^5$ |
| b | 70:30:0 | $(Fe_2O_3)_{0.63}(MnO)_{0.37}$ | 20 | — | 15.6 | 14 | 61 | 3 | $8.5 \times 10^6$ |
| c | 70:30:0 | $(Fe_2O_3)_{0.63}(MnO)_{0.37}$ | 40 | — | 33.4 | 30 | 51 | 5 | $1.8 \times 10^7$ |
| d | 75:23:2 | $(Fe_2O_3)_{0.67}(MnO)_{0.28}(MgO)_{0.05}$ | 10 | — | 8.2 | 7 | 79 | 4 | $9.7 \times 10^5$ |
| e | 70:30:0 | $(Fe_2O_3)_{0.63}(MnO)_{0.37}$ | — | 40 | 32.8 | 32 | 48 | 6 | $4.7 \times 10^8$ |
| f | 92:0:8 | $(Fe_2O_3)_{0.81}(MgO)_{0.19}$ | 45 | — | 38.1 | 34 | 56 | 5 | $2.8 \times 10^7$ |
| g | 70:30:0 | $(Fe_2O_3)_{0.63}(MnO)_{0.37}$ | 20 | — | 16.6 | 14 | 67 | 3 | $3.1 \times 10^7$ |
| h | 70:30:0 | $(Fe_2O_3)_{0.63}(MnO)_{0.37}$ | 20 | — | 15.7 | 15 | 53 | 14 | $4.9 \times 10^7$ |
| i | 60:40:0 | $(Fe_2O_3)_{0.52}(MnO)_{0.48}$ | 30 | — | 25.4 | 22 | 43 | 15 | $3.2 \times 10^8$ |
| j | 70:30:0 | $(Fe_2O_3)_{0.63}(MnO)_{0.37}$ | 50 | — | 40.3 | 37 | 42 | 11 | $7.6 \times 10^8$ |
| k | $Fe_2O_3$:ZnO:CuO 78:12:10 | $(Fe_2O_3)_{0.64}(ZnO)_{0.20}(CuO)_{0.16}$ | — | — | — | — | 92 | 1 | $1.5 \times 10^8$ |
| l | — | $Fe_3O_4$ | 4 | — | 3.8 | 2 | 75 | 3 | $1.3 \times 10^6$ |
| m | 91:0:9 | $(Fe_2O_3)_{0.79}(MgO)_{0.21}$ | 20 | — | 15.9 | 13 | 71 | 11 | $7.8 \times 10^5$ |
| n | 70:30:0 | $(Fe_2O_3)_{0.63}(MnO)_{0.37}$ | 3 | — | 2.7 | 2 | 86 | 2 | $1.7 \times 10^5$ |
| o | 70:30:0 | $(Fe_2O_3)_{0.63}(MnO)_{0.37}$ | 50 | — | 40.2 | 36 | 46 | 3 | $4.8 \times 10^8$ |
| p | 70:30:0 | $(Fe_2O_3)_{0.63}(MnO)_{0.37}$ | 5 | — | 4.3 | 3 | 85 | 2 | $4.7 \times 10^4$ |
| q | 70:30:0 | $(Fe_2O_3)_{0.63}(MnO)_{0.37}$ | 30 | — | 26.3 | 23 | 42 | 14 | $6.5 \times 10^8$ |
| r | 92:0:8 | $(Fe_2O_3)_{0.81}(MgO)_{0.19}$ | 30 | — | 26.1 | 26 | 50 | 4 | $2.2 \times 10^8$ |
| s | 60:40:0 | $(Fe_2O_3)_{0.52}(MnO)_{0.48}$ | 5 | — | 4.1 | 3 | 77 | 5 | $8.1 \times 10^4$ |
| t | — | $Fe_3O_4$ | 10 | — | 8.1 | 7 | 75 | 5 | $3.8 \times 10^6$ |

Production Example of Magnetic Carrier A

A magnetic carrier A was produced by using the following materials and the following production method.

Magnetic Core a

Resin Composition 1

Production Example of Resin Composition 1

35 parts by mass of a methyl methacrylate macromer (average n=50) having a structure represented by the following formula (1), an ethylenically unsaturated group (methacryloyl group) at one of its terminals, and a weight-average molecular weight of 5,000 and 65 parts by mass of a cyclohexyl methacrylate monomer having a structure represented by the following formula (2), using a cyclohexyl group as a unit, and having an ester site were loaded into a four-necked flask having a reflux condenser, a temperature gauge, a nitrogen-inhaling pipe, and a ground joint stirring apparatus. Further, 90 parts by mass of toluene, 110 parts by mass of methyl ethyl ketone, and 2.0 parts by mass of azobisisovaleronitrile were added to the mixture. The resultant mixture was held at a temperature of 70° C. for 10 hours in a stream of nitrogen. After the completion of the polymerization reaction, the resultant was repeatedly washed, whereby a solution (having a solid content of 33 mass %) of a resin composition 1 (graft copolymer) was obtained. The solution had a weight-average molecular weight by gel permeation chromatography (GPC) of 56,000 and a Tg of 94° C.

[Chem 5]

(1)

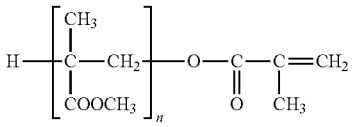

-continued

[Chem 6]

(2)

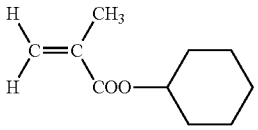

The resultant graft copolymer solution was diluted with toluene so that its solid content might be 5 mass %. Thus, a coating resin solution was prepared. The magnetic core a and the coating resin solution were heated to a temperature of 65° C. and stirred with a universal mixing stirrer (manufactured by Fuji Paudal co., ltd.) under reduced pressure so that a coat amount might be 6.5 parts by mass while nitrogen was introduced; the coating resin solution was charged in five portions. Then, the solvent was removed until the carrier became slick. After having been cooled, the resultant carrier was transferred to a Julia Mixer (manufactured by TOKUJU Co., LTD.), and was treated with heat under a nitrogen atmosphere at 100° C. for 2 hours. Further, the resultant was subjected to vibration screening with a mesh having an aperture of 105 μm, whereby the magnetic carrier A was obtained. Table 2 shows the composition and physical properties of the resultant magnetic carrier. It should be noted that the unit "parts by mass" of the coat amount in Table 2 is a ratio with respect to 100 parts by mass of the magnetic core.

Production Example of Magnetic Carrier B

A magnetic carrier B was produced by using the following materials and the following production method.

Magnetic Core b

Resin Composition 1

The magnetic carrier B was obtained in the same manner as in the magnetic carrier A except that: the magnetic core b was used instead of the magnetic core a; and the coat amount was changed to 7.5 parts by mass. Table 2 shows the composition and physical properties of the resultant magnetic carrier.

Production Example of Magnetic Carrier C

A magnetic carrier C was produced by using the following materials and the following production method.

Magnetic Core c

Resin Composition 1

The magnetic carrier C was obtained in the same manner as in the magnetic carrier A except that: the magnetic core c was used instead of the magnetic core a; and the coat amount was changed to 9.0 parts by mass. Table 2 shows the composition and physical properties of the resultant magnetic carrier.

Production Example of Magnetic Carrier D

A magnetic carrier D was produced by using the following materials and the following production method.

Magnetic Core d

Resin Composition 1

The magnetic carrier D was obtained in the same manner as in the magnetic carrier A except that: the magnetic core d was used instead of the magnetic core a; and the coat amount was changed to 7.0 parts by mass. Table 2 shows the composition and physical properties of the resultant magnetic carrier.

Production Example of Magnetic Carrier E

A magnetic carrier E was produced by using the following materials and the following production method.

Magnetic Core e

Resin Composition 1

The magnetic carrier E was obtained in the same manner as in the magnetic carrier A except that: the magnetic core e was used instead of the magnetic core a; and the coat amount was changed to 10.0 parts by mass. Table 2 shows the composition and physical properties of the resultant magnetic carrier.

Production Example of Magnetic Carrier F

A magnetic carrier F was produced by using the following materials and the following production method.

Magnetic Core f

Resin Composition 1

The magnetic carrier F was obtained in the same manner as in the magnetic carrier A except that: the magnetic core f was used instead of the magnetic core a; and the coat amount was changed to 9.5 parts by mass. Table 2 shows the composition and physical properties of the resultant magnetic carrier.

Production Example of Magnetic Carrier G

A magnetic carrier G was produced by using the following materials and the following production method.

Magnetic Core g

Resin Composition 2

A coating resin solution prepared as follows was used as a resin composition 2: a silicone resin SR2410 (manufactured by Dow Corning Toray Co., Ltd.) was diluted with 200 parts by mass of toluene so that a silicone resin solid content might be 10 mass %, and then 8 parts by mass of γ-aminopropyltrimethoxysilane were added to the silicone resin, and the contents were mixed well. The magnetic core g and the coating resin solution were heated to a temperature of 65° C. and stirred with a universal mixing stirrer (manufactured by Fuji Paudal co., ltd.) under reduced pressure so that a coat amount might be 6.0 parts by mass while nitrogen was introduced; the coating resin solution was charged in five portions. Then, the solvent was removed until the carrier became slick. After having been cooled, the resultant carrier was transferred to a Julia Mixer (manufactured by TOKUJU Co., LTD.), and was treated with heat under a nitrogen atmosphere at 160° C. for 2 hours. Further, the resultant was subjected to vibration screening with a mesh having an aperture of 105 μm, whereby a magnetic carrier G was obtained. Table 2 shows the composition and physical properties of the resultant magnetic carrier.

Production Example of Magnetic Carrier H

A magnetic carrier H was produced by using the following materials and the following production method.

Magnetic Core h

Resin Composition 2

The magnetic carrier H was obtained in the same manner as in the magnetic carrier G except that: the magnetic core h was used instead of the magnetic core g; and the coat amount was changed to 12.5 parts by mass. Table 2 shows the composition and physical properties of the resultant magnetic carrier.

Production Example of Magnetic Carrier I

A magnetic carrier I was produced by using the following materials and the following production method.

Magnetic Core i

Resin Composition 2

The magnetic carrier I was obtained in the same manner as in the magnetic carrier G except that: the magnetic core i was used instead of the magnetic core g; and the coat amount was changed to 15.0 parts by mass. Table 2 shows the composition and physical properties of the resultant magnetic carrier.

Production Example of Magnetic Carrier J

A magnetic carrier J was produced by using the following materials and the following production method.

Magnetic Core j

Resin Composition 3

Production Example of Resin Composition 3

10 parts by mass of a methyl acrylate macromer (average n=50) having a structure represented by the following formula (3) and a weight-average molecular weight of 5,000, 50 parts by mass of a stearyl methacrylate monomer having a structure represented by the following formula (4), and 40 parts by mass of methyl methacrylate monomer were loaded into a four-necked flask having a reflux condenser, a temperature gauge, a nitrogen-inhaling pipe, and a ground joint stirring apparatus. Further, 90 parts by mass of toluene, 110 parts by mass of methyl ethyl ketone, and 2.0 parts by mass of azobisisovaleronitrile were added to the mixture. The resultant mixture was held at a temperature of 70° C. for 10 hours in a stream of nitrogen. Thus, a solution (having a solid content of 33 mass %) of a resin composition 3 (graft copolymer) was obtained. The solution had a weight-average molecular weight by gel permeation chromatography (GPC) of 49,000 and a Tg of 81° C.

[Chem 7]

(3)

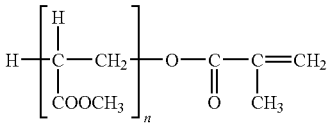

[Chem 8]

(4)

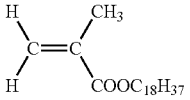

A magnetic carrier J was obtained in the same manner as in the magnetic carrier A except that: the magnetic core j was used instead of the magnetic core a; the resin composition 3 was used instead of the resin composition 1; the coat amount was changed to 10.0 parts by mass; and the carrier which had been coated was transferred to a Julia Mixer (manufactured by TOKUJU Co., LTD.), and was treated with heat under a nitrogen atmosphere at 90° C. for 2 hours. Table 2 shows the composition and physical properties of the resultant magnetic carrier.

Production Example of Magnetic Carrier K

A magnetic carrier K was produced by using the following materials and the following production method.

Magnetic Core k

Resin Composition 3

The magnetic carrier K was obtained in the same manner as in the magnetic carrier J except that: the magnetic core k was used instead of the magnetic core j; and the coat amount was changed to 1.5 parts by mass. Table 2 shows the composition and physical properties of the resultant magnetic carrier.

Production Example of Magnetic Carrier L

A magnetic carrier L was produced by using the following materials and the following production method.

Magnetic Core l

Resin Composition 3

The magnetic carrier L was obtained in the same manner as in the magnetic carrier J except that: the magnetic core l was used instead of the magnetic core j; and the coat amount was changed to 7.5 parts by mass. Table 2 shows the composition and physical properties of the resultant magnetic carrier.

Production Example of Magnetic Carrier M

A magnetic carrier M was produced by using the following materials and the following production method.

Magnetic Core g

Resin Composition 4

A coating resin solution prepared as follows was used as a resin composition 4: a silicone resin SR2410 (manufactured by Dow Corning Toray Co., Ltd.) was diluted with 200 parts by mass of toluene so that a silicone resin solid content might be 10 mass %, and then 20 parts by mass of γ-aminopropyltrimethoxysilane were added to the silicone resin, and the contents were mixed well. The magnetic core g and the coating resin solution were heated to a temperature of 65° C. and stirred with a universal mixing stirrer (manufactured by Fuji Paudal co., ltd.) under reduced pressure so that a coat amount might be 6.0 parts by mass while nitrogen was introduced; the coating resin solution was charged in five portions. Then, the solvent was removed until the carrier became slick. After having been cooled, the resultant carrier was transferred to a Julia Mixer (manufactured by TOKUJU Co., LTD.), and was treated with heat under a nitrogen atmosphere at 160° C. for 2 hours. Further, the resultant was subjected to vibration screening with a mesh having an aperture of 105 μm, whereby a magnetic carrier M was obtained. Table 2 shows the composition and physical properties of the resultant magnetic carrier.

Production Example of Magnetic Carrier N

A magnetic carrier N was produced by using the following materials and the following production method.

Magnetic Core m

Resin Composition 5

A coating resin solution prepared as follows was used as a resin composition 5: a silicone resin SR2411 (manufactured by Dow Corning Toray Co., Ltd.) was diluted with 50 parts by mass of toluene so that a silicone resin solid content might be 20 mass %. The magnetic core m and the coating resin solution were heated to a temperature of 150° C. and stirred with a universal mixing stirrer (manufactured by Fuji Paudal co., ltd.) under reduced pressure so that a coat amount might be 12.0 parts by mass while nitrogen was introduced; the coating resin solution was charged once without division. Then, the solvent was removed until the carrier became slick. After having been cooled, the resultant carrier was transferred to a Julia Mixer (manufactured by TOKUJU Co., LTD.), and was treated with heat under a nitrogen atmosphere at 250° C. for 5 hours. Further, the resultant was subjected to vibration screening with a mesh having an aperture of 105 μm, whereby a magnetic carrier N was obtained. The loading of the resin in the magnetic carrier was not favorable and a part of the surface of the magnetic carrier was rich in the resin. In addition, the efficiency was slightly bad due to the agglomeration. Table 2 shows the composition and physical properties of the resultant magnetic carrier.

Production Example of Magnetic Carrier O

A magnetic carrier O was produced by using the following materials and the following production method.

Magnetic Core n

Resin Composition 2

The magnetic carrier O was obtained in the same manner as in the magnetic carrier G except that: the magnetic core n was used instead of the magnetic core g; and the coat amount was changed to 5.5 parts by mass. Table 2 shows the composition and physical properties of the resultant magnetic carrier.

Production Example of Magnetic Carrier P

A magnetic carrier P was produced by using the following materials and the following production method.

Magnetic Core o
Resin Composition 2

The magnetic carrier P was obtained in the same manner as in the magnetic carrier G except that: the magnetic core o was used instead of the magnetic core g; and the coat amount was changed to 5.0 parts by mass. Table 2 shows the composition and physical properties of the resultant magnetic carrier.

Production Example of Magnetic Carrier Q

A magnetic carrier Q was produced by using the following materials and the following production method.
Magnetic Core p
Resin Composition 2

The magnetic carrier Q was obtained in the same manner as in the magnetic carrier G except that: the magnetic core p was used instead of the magnetic core g; and the coat amount was changed to 6.5 parts by mass. Table 2 shows the composition and physical properties of the resultant magnetic carrier.

Production Example of Magnetic Carrier R

A magnetic carrier R was produced by using the following materials and the following production method.
Magnetic Core q
Resin Composition 2

The magnetic carrier R was obtained in the same manner as in the magnetic carrier G except that: the magnetic core q was used instead of the magnetic core g; and the coat amount was changed to 17.0 parts by mass. Table 2 shows the composition and physical properties of the resultant magnetic carrier.

Production Example of Magnetic Carrier S

A magnetic carrier S was produced by using the following materials and the following production method.
Magnetic Core r
Resin Composition 2

The magnetic carrier S was obtained in the same manner as in the magnetic carrier G except that: the magnetic core r was used instead of the magnetic core g; and the coat amount was changed to 7.0 parts by mass. Table 2 shows the composition and physical properties of the resultant magnetic carrier.

Production Example of Magnetic Carrier T

A magnetic carrier T was produced by using the following materials and the following production method.
Magnetic Core s
Resin Composition 2

The magnetic carrier T was obtained in the same manner as in the magnetic carrier G except that: the magnetic core s was used instead of the magnetic core g; and the coat amount was changed to 7.0 parts by mass. Table 2 shows the composition and physical properties of the resultant magnetic carrier.

Production Example of Magnetic Carrier U

A magnetic carrier U was produced by using the following materials and the following production method.
Magnetic Core t
Resin Composition 2

The magnetic carrier U was obtained in the same manner as in the magnetic carrier G except that: the magnetic core t was used instead of the magnetic core g; and the coat amount was changed to 8.5 parts by mass. Table 2 shows the composition and physical properties of the resultant magnetic carrier.

TABLE 2

| Magnetic carrier | Resin composition | Coat amount Parts by mass | Magnetic core | Magnetization (σ1k) $Am^2/kg$ | Residual magnetization (σr) $Am^2/kg$ | Particle diameter (D50) μm | Apparent density $g/cm^3$ | Electric field intensity at which magnetic carrier comes close to undergo breakdown V/cm |
|---|---|---|---|---|---|---|---|---|
| Carrier A | 1 | 6.5 | a | 64.6 | 1.8 | 38.5 | 2.05 | 3,340 |
| Carrier B | 1 | 7.5 | b | 56.4 | 1.5 | 40.2 | 1.83 | 4,850 |
| Carrier C | 1 | 9.0 | c | 44.2 | 1.2 | 38.1 | 1.66 | 4,970 |
| Carrier D | 1 | 7.0 | d | 60.5 | 1.9 | 44.9 | 1.78 | 3,770 |
| Carrier E | 1 | 10.0 | e | 42.2 | 1.3 | 37.2 | 1.68 | No breakdown |
| Carrier F | 1 | 9.5 | f | 41.5 | 1.3 | 37.6 | 1.59 | 9,520 |
| Carrier G | 2 | 6.0 | g | 56.4 | 1.8 | 51.3 | 1.71 | 6,030 |
| Carrier H | 2 | 12.5 | h | 48.3 | 1.0 | 31.2 | 1.61 | 5,990 |
| Carrier I | 2 | 15.0 | i | 42.8 | 1.0 | 34.3 | 1.56 | No breakdown |
| Carrier M | 4 | 6.0 | g | 56.8 | 1.8 | 51.5 | 1.70 | 5,740 |
| Carrier J | 3 | 10.0 | j | 35.4 | 1.0 | 39.6 | 1.51 | No breakdown |
| Carrier K | 3 | 1.5 | k | 60.5 | 0.7 | 60.0 | 2.45 | No breakdown |
| Carrier L | 3 | 7.5 | l | 65.2 | 3.1 | 45.3 | 2.15 | 3,060 |
| Carrier N | 5 | 12.0 | m | 52.6 | 1.5 | 37.9 | 1.53 | No breakdown |
| Carrier O | 2 | 5.5 | n | 64.8 | 1.7 | 37.5 | 2.08 | 2,800 |
| Carrier P | 2 | 5.0 | o | 40.2 | 1.1 | 39.2 | 1.62 | No breakdown |
| Carrier Q | 2 | 6.5 | p | 63.8 | 1.6 | 37.9 | 1.99 | 3,020 |
| Carrier R | 2 | 17.0 | q | 40.3 | 0.7 | 34.4 | 1.50 | No breakdown |
| Carrier S | 2 | 7.0 | r | 34.2 | 0.5 | 40.1 | 1.92 | No breakdown |
| Carrier T | 2 | 7.0 | s | 68.2 | 1.9 | 39.9 | 2.01 | 3,110 |
| Carrier U | 2 | 8.5 | t | 64.4 | 3.2 | 35.0 | 2.08 | 5,600 |

Production Example of Toner 1

600 parts by mass of a 0.10-M aqueous solution of $Na_3PO_4$ were charged into 500 parts by mass of ion-exchanged water, and the mixture was heated to a temperature of 60° C. After that, the mixture was stirred with a TK-homomixer (manufactured by Tokushu Kika Kogyo) at 14,000 rpm. 93 parts by mass of a 1.0-M aqueous solution of $CaCl_2$ were gradually added to the mixture, whereby an aqueous medium containing $Ca_3(PO_4)_2$ was obtained.

| | |
|---|---|
| Styrene | 162 parts by mass |
| n-butyl acrylate | 38 parts by mass |
| Ester wax (maximum endothermic peak temperature 72° C.) | 20 parts by mass |

-continued

| | |
|---|---|
| 3,5-di-t-butyl salicylic acid aluminum compound | 1 part by mass |
| Saturated polyester (terephthalic acid-propylene oxide-modified bisphenol A; acid value 15 mgKOH/g, peak molecular weight 6,000) | 10 parts by mass |
| C.I. Pigment Blue 15:3 | 12 parts by mass |

The above materials were heated to a temperature of 60° C., and were uniformly dissolved and dispersed with a TK-homomixer (manufactured by Tokushu Kika Kogyo) at 13,000 $min^{-1}$. 8 parts by mass of a polymerization initiator 2,2'-azobis(2,4-dimethylvaleronitrile) were dissolved in the resultant, whereby a polymerizable monomer composition was prepared. The above polymerizable monomer composition was loaded into the aqueous medium, and the mixture was stirred under a nitrogen atmosphere with a TK-homomixer at a temperature of 60° C. and 15,000 $min^{-1}$ for 10 minutes so that the polymerizable monomer composition might be granulated. After that, the temperature of the granulated product was increased to 80° C. while the granulated product was stirred with a paddle stirring blade. Then, the granulated product was subjected to a reaction for 10 hours. After the completion of the polymerization reaction, the remaining monomers were removed by distillation under reduced pressure, and the remainder was cooled. After that, hydrochloric acid was added to the remainder to dissolve $Ca_3(PO_4)_2$, and the resultant was filtrated, washed with water, and dried, whereby toner particles were obtained. 0.8 part by mass of titanium oxide particles having a maximum peak particle diameter on a number basis of 40 nm and a degree of hydrophobicity of 65%, and 1.2 parts by mass of silica particles having a maximum peak particle diameter on a number basis of 40 nm and a degree of hydrophobicity of 95% were added to 100 parts by mass of the resultant toner particles, and the particles were mixed with a Henschel mixer (manufactured by Mitsui Miike Machinery Co., Ltd.), whereby Toner 1 having a weight-average particle diameter of 3.2 μm and an average circularity of 0.982 was obtained. Table 3 shows the physical properties of the resultant toner.

Production Example of Toner 2

Toner 2 having a weight-average particle diameter of 4.5 μm and an average circularity of 0.985 was obtained in the same manner as in Toner 1 except that a 0.14-M aqueous solution of $Na_3PO_4$ and a 1.40-M aqueous solution of $CaCl_2$ were used in the step of producing an aqueous medium containing $Ca_3(PO_4)_2$ in the case of Toner 1. Table 3 shows the physical properties of the resultant toner.

Production Example of Toner 3

10 parts by mass of styrene, 5 parts by mass of 2-ethylhexyl acrylate, 2 parts by mass of fumaric acid, and 5 parts by mass of a dimer of α-methylstyrene as materials for a vinyl-based copolymer, and 5 parts by mass of dicumyl peroxide were loaded into a dropping funnel. In addition, 25 parts by mass of polyoxypropylene (2.2)-2,2-bis(4-hydroxyphenyl) propane, 15 parts by mass of polyoxyethylene (2.2)-2,2-bis(4-hydroxyphenyl) propane, 9 parts by mass of terephthalic acid, 5 parts by mass of trimellitic anhydride, 24 parts by mass of fumaric acid, and 0.2 part by mass of tin 2-ethylhexanoate were loaded into a 4-l four-necked flask made of glass. The four-necked flask was equipped with a temperature gauge, a stirring rod, a condenser, and a nitrogen-introducing pipe, and was placed in a mantle heater. Next, the air in the four-necked flask was replaced with a nitrogen gas, and then the temperature in the flask was gradually increased while the mixture in the flask was stirred. While the mixture was stirred at a temperature of 130° C., and the monomers of a vinyl-based copolymer, a crosslinking agent, and a polymerization initiator were dropped from the above dropping funnel to the mixture over about 4 hours. Next, the temperature of the resultant was increased to 200° C., and the resultant was subjected to a reaction for 4 hours, whereby a resin having a weight-average molecular weight of 78,000 and a number-average molecular weight of 3,800 was obtained.

| | |
|---|---|
| The above-mentioned resin | 100 parts by mass |
| Purified normal paraffin (maximum endothermic peak temperature 80° C.) | 5 parts by mass |
| 3,5-di-t-butyl salicylic acid aluminum compound | 0.5 part by mass |
| C.I. Pigment Blue 15:3 | 6 parts by mass |

The materials having the above formulation were mixed with a Henschel mixer (FM-75 model, manufactured by Mitsui Miike Machinery Co., Ltd.). After that, the mixture was kneaded with a biaxial kneader (PCM-30 manufactured by Ikegai, Ltd.) with its temperature set to 130° C. The resultant kneaded product was cooled, and was coarsely pulverized with a hammer mill into products each having a diameter of 1 mm or less, whereby coarsely pulverized products were obtained. The resultant toner coarsely pulverized products were finely pulverized with a collision-type air pulverizer using a high-pressure gas. Further, the resultant finely pulverized products were classified, and, furthermore, were repeatedly treated with a HYBRIDIZER (manufactured by NARA MACHINERY CO., LTD.) treating apparatus for 3 minutes at 600 $min^{-1}$ six or more times, whereby toner particles were obtained. 1.0 part by mass of silica particles having a maximum peak particle diameter on a number basis of 110 nm, 0.9 part by mass of titanium oxide particles having a maximum peak particle diameter on a number basis of 50 nm and a degree of hydrophobicity of 70%, and 0.5 part by mass of silica particles subjected to oil treatment and having a maximum peak particle diameter on a number basis of 30 nm and a degree of hydrophobicity of 98% were added to 100 parts by mass of the resultant toner particles, and the particles were mixed with a Henschel mixer (manufactured by Mitsui Miike Machinery Co., Ltd.), whereby Toner 3 having a weight-average particle diameter of 5.9 μm and an average circularity of 0.961 was obtained. Table 3 shows the physical properties of the resultant toner.

Production Example of Toner 4

Toner 4 having a weight-average particle diameter of 7.9 μm and an average circularity of 0.989 was obtained in the same manner as in Toner 1 except that a 0.20-M aqueous solution of $Na_3PO_4$ and a 2.00-M aqueous solution of $CaCl_2$ were used in the step of producing an aqueous medium containing $Ca_3(PO_4)_2$ in the case of Toner 1. Table 3 shows the physical properties of the resultant toner.

Production Example of Toner 5

The coarsely pulverized products in Toner 3 were finely pulverized with the collision-type air pulverizer using a high-pressure gas while the air pressure of the pulverizer was changed. Then, the finely pulverized products were classified, whereby toner particles were obtained. 0.4 part by mass of titanium oxide particles having a maximum peak particle diameter on a number basis of 40 nm and a degree of hydrophobicity of 65%, and 0.6 part by mass of silica particles having a maximum peak particle diameter on a number basis of 25 nm and a degree of hydrophobicity of 95% were added to 100 parts by mass of the resultant toner particles, and the particles were mixed with a Henschel mixer (manufactured by Mitsui Miike Machinery Co., Ltd.), whereby Toner 5 having a weight-average particle diameter of 9.7 μm and an average circularity of 0.945 was obtained. Table 3 shows the physical properties of the resultant toner.

Production Example of Toner 6

The coarsely pulverized products in Toner 3 were finely pulverized with the collision-type air pulverizer using a high-pressure gas while the air pressure of the pulverizer was changed. Then, the finely pulverized products were classified, whereby toner particles were obtained. 0.4 part by mass of titanium oxide particles having a maximum peak particle diameter on a number basis of 40 nm and a degree of hydrophobicity of 65%, and 0.6 part by mass of silica particles having a maximum peak particle diameter on a number basis of 25 nm and a degree of hydrophobicity of 95% were added to 100 parts by mass of the resultant toner particles, and the particles were mixed with a Henschel mixer (manufactured by Mitsui Miike Machinery Co., Ltd.), whereby Toner 6 having a weight-average particle diameter of 10.5 μm and an average circularity of 0.936 was obtained. Table 3 shows the physical properties of the resultant toner.

Production Example of Toner 7

600 parts by mass of a 0.10-M aqueous solution of $Na_3PO_4$ were charged into 500 parts by mass of ion-exchanged water, and the mixture was heated to a temperature of 60° C. After that, the mixture was stirred with a TK-homomixer (manufactured by Tokushu Kika Kogyo) at 16,000 rpm. 93 parts by mass of a 1.0-M aqueous solution of $CaCl_2$ were gradually added to the mixture, whereby an aqueous medium containing $Ca_3(PO_4)_2$ was obtained.

| | |
|---|---|
| Styrene | 162 parts by mass |
| n-butyl acrylate | 38 parts by mass |
| Ester wax (maximum endothermic peak temperature 72° C.) | 20 parts by mass |
| 3,5-di-t-butyl salicylic acid aluminum compound | 1 part by mass |
| Saturated polyester (terephthalic acid-propylene oxide-modified bisphenol A; acid value 15 mgKOH/g, peak molecular weight 6,000) | 10 parts by mass |
| C.I. Pigment Blue 15:3 | 12 parts by mass |

The above materials were heated to a temperature of 60° C., and were uniformly dissolved and dispersed with a TK-homomixer (manufactured by Tokushu Kika Kogyo) at 13,500 $min^{-1}$. 8 parts by mass of a polymerization initiator 2,2'-azobis(2,4-dimethylvaleronitrile) were dissolved in the resultant, whereby a polymerizable monomer composition was prepared. The above polymerizable monomer composition was loaded into the aqueous medium, and the mixture was stirred under a nitrogen atmosphere with a TK-homomixer at a temperature of 60° C. and 15,000 $min^{-1}$ for 10 minutes so that the polymerizable monomer composition might be granulated. After that, the temperature of the granulated product was increased to 80° C. while the granulated product was stirred with a paddle stirring blade. Then, the granulated product was subjected to a reaction for 10 hours. After the completion of the polymerization reaction, the remaining monomers were removed by distillation under reduced pressure, and the remainder was cooled. After that, hydrochloric acid was added to the remainder to dissolve $Ca_3(PO_4)_2$, and the resultant was filtrated, washed with water, and dried, whereby toner particles were obtained. 1.8 parts by mass of silica particles having a maximum peak particle diameter on a number basis of 40 nm and a degree of hydrophobicity of 95% were added to 100 parts by mass of the resultant toner particles, and the particles were mixed with a Henschel mixer (manufactured by Mitsui Miike Machinery Co., Ltd.), whereby Toner 7 having a weight-average particle diameter of 2.8 μm and an average circularity of 0.985 was obtained. Table 3 shows the physical properties of the resultant toner.

Production Example of Toner 8

The coarsely pulverized products in Toner 3 were finely pulverized with the collision-type air pulverizer using a high-pressure gas while the air pressure of the pulverizer was changed. Then, heated air was introduced by using a heated air treating apparatus so that an inlet temperature was 250° C. and toner particles were collected with a cyclone, whereby toner particles were obtained. 0.6 part by mass of silica particles having a maximum peak particle diameter on a number basis of 40 nm and a degree of hydrophobicity of 95% were added to 100 parts by mass of the resultant toner particles, and the particles were mixed with a Henschel mixer (manufactured by Mitsui Miike Machinery Co., Ltd.), whereby Toner 8 having a weight-average particle diameter of 10.2 μm and an average circularity of 0.980 was obtained. Table 3 shows the physical properties of the resultant toner.

Production Example of Toner 9

The coarsely pulverized products in Toner 3 were finely pulverized with the collision-type air pulverizer using a high-pressure gas while the air pressure of the pulverizer was changed. Then, the finely pulverized products were classified. The resultant toner particles were not subjected to a mechanical sphering treatment. 1.0 part by mass of silica particles having a maximum peak particle diameter on a number basis of 40 nm and a degree of hydrophobicity of 95% were added to 100 parts by mass of the resultant toner particles, and the particles were mixed with a Henschel mixer (manufactured by Mitsui Miike Machinery Co., Ltd.), whereby Toner 9 having a weight-average particle diameter of 7.6 μm and an average circularity of 0.935 was obtained. Table 3 shows the physical properties of the resultant toner.

Production Example of Toner 10

600 parts by mass of a 0.10-M aqueous solution of $Na_3PO_4$ were charged into 500 parts by mass of ion-exchanged water, and the mixture was heated to a temperature of 60° C. After that, the mixture was stirred with a TK-homomixer (manufactured by Tokushu Kika Kogyo) at 15,500 rpm. 95 parts by mass of a 1.0-M aqueous solution of $CaCl_2$ were gradually added to the mixture, whereby an aqueous medium containing $Ca_3(PO_4)_2$ was obtained.

| | |
|---|---|
| Styrene | 162 parts by mass |
| n-butyl acrylate | 38 parts by mass |

-continued

| | |
|---|---|
| Ester wax (maximum endothermic peak temperature 72° C.) | 20 parts by mass |
| 3,5-di-t-butyl salicylic acid aluminum compound | 1 part by mass |
| Saturated polyester (terephthalic acid-propylene oxide-modified bisphenol A; acid value 15 mgKOH/g, peak molecular weight 6,000) | 10 parts by mass |
| C.I. Pigment Blue 15:3 | 12 parts by mass |

The above materials were heated to a temperature of 63° C., and were uniformly dissolved and dispersed with a TK-homomixer (manufactured by Tokushu Kika Kogyo) at 13,300 $min^{-1}$. 8 parts by mass of a polymerization initiator 2,2'-azobis(2,4-dimethylvaleronitrile) were dissolved in the resultant, whereby a polymerizable monomer composition was prepared. The above polymerizable monomer composition was loaded into the aqueous medium, and the mixture was stirred under a nitrogen atmosphere with a TK-homomixer at a temperature of 63° C. and 14,500 $min^{-1}$ for 10 minutes so that the polymerizable monomer composition might be granulated. After that, the temperature of the granulated product was increased to 80° C. while the granulated product was stirred with a paddle stirring blade. Then, the granulated product was subjected to a reaction for 10 hours. After the completion of the polymerization reaction, the remaining monomers were removed by distillation under reduced pressure, and the remainder was cooled. After that, hydrochloric acid was added to the remainder to dissolve $Ca_3(PO_4)_2$, and the resultant was filtrated, washed with water, and dried, whereby toner particles were obtained. 1.8 parts by mass of silica particles having a maximum peak particle diameter on a number basis of 40 nm and a degree of hydrophobicity of 95% were added to 100 parts by mass of the resultant toner particles, and the particles were mixed with a Henschel mixer (manufactured by Mitsui Miike Machinery Co., Ltd.), whereby Toner 10 having a weight-average particle diameter of 3.1 μm and an average circularity of 0.991 was obtained. Table 3 shows the physical properties of the resultant toner.

TABLE 3

| Toner | Weight-average particle diameter D4 | Average circularity | Local maximum particle diameter of inorganic fine particles (nm) |
|---|---|---|---|
| 1 | 3.2 | 0.982 | 40 |
| 2 | 4.5 | 0.985 | 40 |
| 3 | 5.9 | 0.961 | 30, 50, 110 |
| 4 | 7.9 | 0.989 | 40 |
| 5 | 9.7 | 0.945 | 30, 40 |
| 6 | 10.5 | 0.936 | 30, 40 |
| 7 | 2.8 | 0.985 | 40 |
| 8 | 10.2 | 0.980 | 40 |
| 9 | 7.6 | 0.935 | 40 |
| 10 | 3.1 | 0.991 | 40 |

Example 1

The magnetic carrier A (90 mass %) and Toner 2 (10 mass %) were mixed with a V-type mixer at 38 $min^{-1}$ for 10 minutes, whereby a two-component developer was obtained.

Next, the above two-component developer was subjected to image output evaluation with a reconstructed apparatus of an imagePRESS C1 (manufactured by Canon Inc.) as an evaluating machine by charging the developer into a developing device at a cyan position. The machine was reconstructed as follows: a discharge port for a replenishing developer was blocked so that the machine might be replenished with toner alone, and the circumferential speed of a developing sleeve relative to a photosensitive member was increased by a factor of 1.5. Then, an AC voltage (rectangular wave) having a frequency of 2.0 kHz and a Vpp of 1.5 kV, and a DC voltage $V_{DC}$ were applied to the developing sleeve. A contrast voltage was set to 300 V under a normal-temperature, low-humidity environment (23° C./5 RH %) or to 200 V under a high-temperature, high-humidity environment (30° C./80 RH %).

The results of a 30,000 (30 k)-sheet image output test were evaluated with an original copy having an image area ratio of 3% according to a monochromatic mode under a normal-temperature, low-humidity environment (23° C./5 RH %); a CLC 80 g paper (manufactured by Canon Marketing Japan Inc.) was used in the evaluation.

In addition, a 30,000 (30 k)-sheet image output test was similarly performed with an original copy having an image area ratio of 35% under a high-temperature, high-humidity environment (30° C./80 RH %).

After the above image output tests, evaluation for each item was performed on the basis of the following evaluation method. Table 4 shows the results.

<Evaluation Method and Criteria>

[Carrier Adhesion]

At the initial stage (first sheet) of image output and at a time point after the passing of 30,000 sheets (30 k) under the above environments and conditions, a solid image (5 cm×5 cm) was printed while a development voltage was adjusted so that a toner laid-on level on paper was 0.6 $mg/cm^2$.

The power supply of the main body of the copying machine was turned off when the solid image on an electrostatic latent image bearing member was developed with toner at the initial stage (second sheet) of the image output and at a time point after the passing of 30,001 sheets, and the number of magnetic carriers adhering onto the electrostatic latent image bearing member was counted with an optical microscope.

A: 3 or less (extremely good)

B: 4 or more and 10 or less (good)

C: 11 or more and 20 or less (acceptable level for the present invention)

D: 21 or more (not acceptable level for the present invention)

[Dot Reproducibility]

At the initial stage (first sheet) of image output and at a time point after the passing of 30,000 sheets (30 k) under the above environments and conditions, and at the initial stage (second sheet) of image output and at a time point after the passing of 30,001 sheets under the above environments and conditions, a one-dot image was formed so that the area of one dot on an electrostatic latent image bearing member became 2,000 $\mu m^2$ or more and 3,000 $\mu m^2$ or less. Next, the areas of 1,000 dots were measured with a digital microscope VHX-500 (mounted with a lens wide-range zoom lens VH-Z100, manufactured by KEYENCE CORPORATION).

The number average (S) and standard deviation (σ) of the dot areas were calculated, and a dot reproducibility index was calculated from the following equation.

$$\text{Dot reproducibility index}(I)=(\sigma/S)\times 100$$

A: I is less than 4.0. (extremely good)

B: I is 4.0 or more and less than 6.0. (good)

C: I is 6.0 or more and less than 8.0. (acceptable level for the present invention)

D: I is 8.0 or more. (not acceptable level for the present invention)

[Developing Performance (Blank Dots)]

At the initial stage (first sheet) of image output and at a time point after the passing of 30,000 sheets (30 k) under the above environments and conditions, a solid image (3 cm×5 cm) having an image area of 100% was printed while a development voltage was adjusted so that a toner laid-on level on paper was 0.6 mg/cm$^2$.

The following image densities were each measured with a Macbeth Densitometer RD918 manufactured by Macbeth Co. mounted with an SPI filter at the initial stage (second sheet) of the image output and at a time point after the passing of 30,001 sheets.

Front end image density: Densities at three points each of which was 0.5 cm distant from the front end of the image (portion printed early) were measured, and the average of the measured values was defined as the front end image density.

Rear end image density: Densities at three points each of which was 0.5 cm distant from the rear end of the image (portion printed after) were measured, and the average of the measured values was defined as the rear end image density.

The difference between the "front end image density" and "rear end image density" was obtained, and the obtained values were used for evaluation of developing performance (blank diets).

A: Less than 0.05 (extremely good)

B: 0.05 or more and less than 0.10 (good)

C: 0.10 or more and less than 0.20 (acceptable level for the present invention)

D: 0.20 or more (not acceptable level for the present invention)

[Difference Between Density Before Durability Test and Density after Durability Test]

A development voltage (contrast voltage) was adjusted so that a toner laid-on level on paper was 0.6 mg/cm$^2$ before the durability test. A solid image (3 cm×3 cm) having an image area of 100% was printed. After the durability test was performed at each mode under the above environments, a solid image (3 cm×3 cm) having an image area of 100% was printed on the 30,001-th sheet in the same manner as the initial evaluation at the development voltage (contrast voltage) set at the initial stage.

The image densities were each measured with a Macbeth Densitometer RD918 manufactured by Macbeth Co. mounted with an SPI filter, and the difference between the initial stage of duration (second sheet) and the 30,001-th sheet was measured.

A: Less than 0.05 (extremely good)

B: 0.05 or more and less than 0.10 (good)

C: 0.10 or more and less than 0.20 (acceptable level for the present invention)

D: 0.20 or more (not acceptable level for the present invention)

Example 2

Evaluation was performed in the same manner as in Example 1 except that the magnetic carrier B was used instead of the magnetic carrier A. Table 4 shows the results of the evaluation.

Example 3

Evaluation was performed in the same manner as in Example 1 except that the magnetic carrier C (90 mass %) and Toner 3 (10 mass %) were mixed with a V-type mixer at 38 min$^{-1}$ for 10 minutes. Table 4 shows the results of the evaluation.

Example 4

Evaluation was performed in the same manner as in Example 3 except that the magnetic carrier D was used instead of the magnetic carrier C. Table 4 shows the results of the evaluation.

Example 5

Evaluation was performed in the same manner as in Example 1 except that the magnetic carrier E (90 mass %) and Toner 1 (10 mass %) were mixed with a V-type mixer at 38 min$^{-1}$ for 10 minutes. Table 4 shows the results of the evaluation.

Example 6

Evaluation was performed in the same manner as in Example 5 except that the magnetic carrier F was used instead of the magnetic carrier E. Table 4 shows the results of the evaluation.

Example 7

Evaluation was performed in the same manner as in Example 1 except that the magnetic carrier G (90 mass %) and Toner 4 (10 mass %) were mixed with a V-type mixer at 38 min$^{-1}$ for 10 minutes. Table 4 shows the results of the evaluation.

Example 8

Evaluation was performed in the same manner as in Example 7 except that the magnetic carrier H was used instead of the magnetic carrier G. Table 4 shows the results of the evaluation.

Example 9

Evaluation was performed in the same manner as in Example 1 except that the magnetic carrier I (90 mass %) and Toner 5 (10 mass %) were mixed with a V-type mixer at 38 min$^{-1}$ for 10 minutes. Table 4 shows the results of the evaluation.

Comparative Example 1

Evaluation was performed in the same manner as in Example 1 except that the magnetic carrier J (90 mass %) and Toner 5 (10 mass %) were mixed with a V-type mixer at 38 min$^{-1}$ for 10 minutes. Table 4 shows the results of the evaluation.

Comparative Example 2

A two-component developer was prepared in the same manner as in Comparative Example 1 except that the magnetic carrier K was used instead of the magnetic carrier J, and evaluation was performed in the same manner as in Example 1. Table 4 shows the results of the evaluation.

Comparative Example 3

A two-component developer was prepared in the same manner as in Comparative Example 1 except that the magnetic carrier L was used instead of the magnetic carrier J, and evaluation was performed in the same manner as in Example 1. Table 4 shows the results of the evaluation.

Comparative Example 4

Evaluation was performed in the same manner as in Example 1 except that the magnetic carrier I (90 mass %) and Toner 6 (10 mass %) were mixed with a V-type mixer at 38 $min^{-1}$ for 10 minutes. Table 4 shows the results of the evaluation.

Example 10

Evaluation was performed in the same manner as in Example 7 except that: the magnetic carrier M (90 mass %) and Toner 4 (10 mass %) were mixed with a V-type mixer at 38 $min^{-1}$ for 10 minutes; and the contrast voltage was set to 450 V under a normal-temperature, low-humidity environment (23° C./5 RH %) or to 350 V under a high-temperature, high-humidity environment (30° C./80 RH %). Table 4 shows the results of the evaluation. In this example, the triboelectric charge quantity was high, and the dot reproducibility was improved as compared to Example 7.

Example 11

Evaluation was performed in the same manner as in Example 1 except that the magnetic carrier N (90 mass %) and Toner 2 (10 mass %) were mixed with a V-type mixer at 38 $min^{-1}$ for 10 minutes. Table 4 shows the results of the evaluation. The two-component developer had a low charge quantity, and was somewhat poor in developing performance, but the charge quantity and the developing performance after a durability test and under each environment were at acceptable levels in the present invention. This is probably attributable to the nonuniformity of the loading and coating of the resin in the magnetic carrier.

Comparative Example 5

Evaluation was performed in the same manner as in Example 1 except that the magnetic carrier O (90 mass %) and Toner 2 (10 mass %) were mixed with a V-type mixer at 38 $min^{-1}$ for 10 minutes. Table 4 shows the results of the evaluation. As a result, the adhesion of the carrier occurred under a high-temperature, high-humidity environment.

Comparative Example 6

Evaluation was performed in the same manner as in Example 1 except that the magnetic carrier P (90 mass %) and Toner 2 (10 mass %) were mixed with a V-type mixer at 38 $min^{-1}$ for 10 minutes. Table 4 shows the results of the evaluation. As a result, after a durability test under a normal-temperature, low-humidity environment, the blank dots were generated due to the deterioration of the developing performance.

Comparative Example 7

Evaluation was performed in the same manner as in Example 1 except that the magnetic carrier Q (90 mass %) and Toner 2 (10 mass %) were mixed with a V-type mixer at 38 $min^{-1}$ for 10 minutes. Table 4 shows the results of the evaluation. As a result, the adhesion of the carrier increased under a high-temperature, high-humidity environment. The reason therefor can be considered that, due to the low resistance of the magnetic core, the developing bias injected charge into the magnetic carrier.

Comparative Example 8

Evaluation was performed in the same manner as in Example 1 except that the magnetic carrier R (90 mass %) and Toner 2 (10 mass %) were mixed with a V-type mixer at 38 $min^{-1}$ for 10 minutes. Table 4 shows the results of the evaluation. As a result, the deterioration of the developing performance due to the high resistance of the magnetic core was observed.

Comparative Example 9

Evaluation was performed in the same manner as in Example 1 except that the magnetic carrier S (90 mass %) and Toner 2 (10 mass %) were mixed with a V-type mixer at 38 $min^{-1}$ for 10 minutes. Table 4 shows the results of the evaluation. As a result, the carrier adhesion was inferior, and, after a durability test, the blank dots due to the deterioration of the developing performance was observed.

Comparative Example 10

Evaluation was performed in the same manner as in Example 1 except that the magnetic carrier T (90 mass %) and Toner 2 (10 mass %) were mixed with a V-type mixer at 38 $min^{-1}$ for 10 minutes. Table 4 shows the results of the evaluation. As a result, the dot reproducibility was inferior. The reason therefor can be considered that, due to the high intensity of magnetization of the magnetic carrier, the initial dot reproducibility and the dot reproducibility during the durability test were inferior.

Comparative Example 11

Evaluation was performed in the same manner as in Example 1 except that the magnetic carrier U (90 mass %) and Toner 2 (10 mass %) were mixed with a V-type mixer at 38 $min^{-1}$ for 10 minutes. Table 4 shows the results of the evaluation. As a result, the shift of the image density during the durability test was large. The reason therefor can be considered that, due to the influence of the residual magnetization of the magnetic carrier, the charge-providing performance to the toner was changed.

Comparative Example 12

Evaluation was performed in the same manner as in Example 1 except that the magnetic carrier G (95 mass %) and Toner 7 (5 mass %) were mixed with a V-type mixer at 38 $min^{-1}$ for 10 minutes. Table 4 shows the results of the evaluation. As a result, the shift of the image density during the durability test was large under a normal-temperature, low-humidity environment. The reason therefor can be considered that, due to the small particle diameter of the toner, charge up of the toner occurred.

Comparative Example 13

Evaluation was performed in the same manner as in Example 1 except that the magnetic carrier G (90 mass %) and Toner 8 (10 mass %) were mixed with a V-type mixer at 38 $min^{-1}$ for 10 minutes. Table 4 shows the results of the evaluation.

Comparative Example 14

Evaluation was performed in the same manner as in Example 1 except that the magnetic carrier G (90 mass %) and Toner 9 (10 mass %) were mixed with a V-type mixer at 38 $min^{-1}$ for 10 minutes. Table 4 shows the results of the evaluation. Under any environment, the initial dot reproducibility was within a practical level in the present invention, but the dot reproducibility deteriorated after a durability test. The reason therefor can be considered to be toner spent to the magnetic carrier due to the shape of the toner.

Comparative Example 15

Evaluation was performed in the same manner as in Example 1 except that the magnetic carrier G (95 mass %) and Toner 10 (5 mass %) were mixed with a V-type mixer at 38 $min^{-1}$ for 10 minutes. Table shows the results of the evaluation. The initial dot reproducibility was extremely good under a normal-temperature, low-humidity environment, but the dot reproducibility deteriorated due to the durability test. The reason therefor can be considered that, due to the deterioration of the toner, charge up of the toner occurred.

TABLE 4

| | | | Normal-temperature, low-humidity (23° C./5 RH %) | | | | | | | | |
|---|---|---|---|---|---|---|---|---|---|---|---|
| | | | Initial stage (second sheet) | | | | 30 k durability test | | | | |
| | Magnetic carrier | Toner | Tribo-electric charge quantity (mc/kg) | Carrier adhesion | Dot repro-ducibility | Developing performance (blank dots) | Tribo-electric charge quantity (mc/kg) | Carrier adhesion | Dot repro-ducibility | Developing performance (blank dots) | Difference between image density before durability test and image density after durability test |
| Example 1 | Carrier A | 2 | −31.5 | A (0) | A (3.7) | A (0.00) | −32.3 | B (5) | A (3.9) | A (0.02) | A (0.03) |
| Example 2 | Carrier B | 2 | −31.6 | A (0) | A (2.6) | A (0.03) | −31.9 | A (0) | A (2.7) | A (0.04) | A (0.02) |
| Example 3 | Carrier C | 3 | −32.1 | A (3) | A (2.3) | A (0.04) | −34.2 | A (2) | A (2.4) | B (0.07) | B (0.05) |
| Example 4 | Carrier D | 3 | −30.6 | A (1) | A (3.3) | A (0.02) | −31.3 | B (5) | A (3.6) | A (0.04) | A (0.04) |
| Example 5 | Carrier E | 1 | −31.9 | A (3) | A (2.2) | B (0.09) | −33.8 | A (3) | A (2.3) | C (0.11) | B (0.05) |
| Example 6 | Carrier F | 1 | −29.6 | A (3) | A (2.5) | B (0.09) | −32.5 | A (3) | A (2.8) | B (0.09) | B (0.06) |
| Example 7 | Carrier G | 4 | −28.7 | A (1) | B (4.6) | A (0.03) | −30.8 | A (0) | B (5.8) | B (0.06) | B (0.05) |
| Example 8 | Carrier H | 4 | −33.5 | A (2) | A (3.1) | B (0.06) | −36.9 | A (3) | A (3.7) | B (0.09) | C (0.10) |
| Example 9 | Carrier I | 5 | −30.7 | A (3) | A (3.9) | B (0.09) | −33.7 | A (3) | A (3.9) | C (0.14) | C (0.11) |
| Comparative Example 1 | Carrier J | 5 | −27.6 | B (7) | A (3.5) | C (0.18) | −32.4 | B (8) | A (3.7) | C (0.19) | D (0.23) |
| Comparative Example 2 | Carrier K | 5 | −25.4 | A (0) | C (6.0) | B (0.08) | −27.6 | A (0) | D (8.3) | B (0.09) | C (0.17) |
| Comparative Example 3 | Carrier L | 5 | −26.8 | A (2) | C (6.2) | B (0.05) | −29.9 | A (1) | D (8.9) | C (0.15) | D (0.22) |
| Comparative Example 4 | Carrier I | 6 | −25.7 | A (3) | C (6.0) | C (0.10) | −26.8 | A (3) | C (6.9) | C (0.13) | C (0.15) |
| Example 10 | Carrier M | 4 | −60.1 | A (1) | A (3.5) | B (0.06) | −61.0 | A (0) | A (3.8) | B (0.07) | A (0.04) |
| Example 11 | Carrier N | 2 | −19.9 | B (4) | B (4.8) | C (0.10) | −17.5 | B (6) | C (6.1) | C (0.19) | C (0.17) |
| Comparative Example 5 | Carrier O | 2 | −30.6 | B (8) | A (3.8) | A (0.01) | −32.0 | C (14) | A (3.9) | A (0.04) | B (0.05) |
| Comparative Example 6 | Carrier P | 2 | −34.0 | C (14) | A (2.9) | C (0.18) | −36.1 | C (11) | A (3.6) | D (0.22) | B (0.06) |
| Comparative Example 7 | Carrier Q | 2 | −29.8 | C (14) | B (4.6) | A (0.02) | −31.6 | C (16) | C (6.0) | A (0.04) | B (0.06) |
| Comparative Example 8 | Carrier R | 2 | −34.8 | B (8) | A (3.3) | C (0.19) | −37.6 | C (14) | B (4.3) | D (0.24) | C (0.17) |
| Comparative Example 9 | Carrier S | 2 | −31.1 | C (18) | A (2.3) | C (0.19) | −31.9 | D (21) | A (2.6) | C (0.16) | A (0.04) |
| Comparative Example 10 | Carrier T | 2 | −32.7 | A (0) | C (7.2) | A (0.03) | −33.9 | A (0) | D (8.8) | A (0.04) | C (0.17) |
| Comparative Example 11 | Carrier U | 2 | −32.0 | A (2) | C (6.0) | B (0.06) | −26.8 | A (2) | D (8.5) | C (0.16) | D (0.22) |
| Comparative Example 12 | Carrier G | 7 | −37.2 | A (0) | B (4.7) | B (0.07) | −40.1 | A (2) | B (4.9) | C (0.17) | D (0.20) |
| Comparative Example 13 | Carrier G | 8 | −23.4 | A (0) | C (7.0) | B (0.05) | −25.5 | A (0) | C (7.7) | B (0.09) | B (0.08) |
| Comparative Example 14 | Carrier G | 9 | −26.8 | A (1) | C (6.0) | A (0.04) | −29.8 | A (1) | D (8.3) | B (0.08) | C (0.16) |
| Comparative Example 15 | Carrier G | 10 | −35.7 | A (3) | A (2.3) | B (0.05) | −41.2 | A (3) | D (8.2) | C (0.10) | C (0.13) |

TABLE 4-continued

| | | | High-temperature, high-humidity (30° C./80 RH %) | | | | | | | | |
|---|---|---|---|---|---|---|---|---|---|---|---|
| | | | | | | | 30 k durability test | | | | |
| | | | Initial stage (second sheet) | | | | | | | | Difference |
| | Magnetic carrier | Toner | Tribo-electric charge quantity (mc/kg) | Carrier adhesion | Dot repro-ducibility | Developing performance (blank dots) | Tribo-electric charge quantity (mc/kg) | Carrier adhesion | Dot repro-ducibility | Developing performance (blank dots) | between image density before durability test and image density after durability test |
| Example 1 | Carrier A | 2 | −23.3 | A (0) | A (3.9) | A (0.00) | −22.5 | B (4) | A (3.9) | A (0.01) | A (0.04) |
| Example 2 | Carrier B | 2 | −22.5 | A (0) | A (2.8) | A (0.02) | −21.6 | A (1) | A (2.8) | A (0.03) | A (0.03) |
| Example 3 | Carrier C | 3 | −22.0 | A (3) | A (2.9) | A (0.03) | −21.4 | A (3) | A (3.1) | A (0.04) | A (0.04) |
| Example 4 | Carrier D | 3 | −20.1 | A (3) | A (3.6) | A (0.02) | −18.5 | B (4) | B (4.0) | A (0.03) | A (0.04) |
| Example 5 | Carrier E | 1 | −20.5 | A (2) | A (2.9) | B (0.08) | −19.9 | A (2) | A (3.0) | C (0.11) | A (0.04) |
| Example 6 | Carrier F | 1 | −20.6 | A (3) | A (2.8) | B (0.07) | −19.4 | A (3) | B (4.0) | B (0.09) | B (0.06) |
| Example 7 | Carrier G | 4 | −19.9 | A (1) | C (6.0) | B (0.06) | −18.1 | A (1) | C (6.1) | B (0.08) | A (0.04) |
| Example 8 | Carrier H | 4 | −22.4 | A (2) | A (3.8) | B (0.05) | −20.9 | A (3) | A (3.9) | B (0.08) | B (0.06) |
| Example 9 | Carrier I | 5 | −20.5 | A (3) | A (3.9) | C (0.10) | −18.4 | A (2) | B (4.3) | C (0.12) | C (0.12) |
| Comparative Example 1 | Carrier J | 5 | −18.8 | B (6) | A (3.8) | B (0.09) | −17.9 | B (5) | A (3.9) | C (0.14) | C (0.17) |
| Comparative Example 2 | Carrier K | 5 | −18.2 | A (0) | C (6.5) | C (0.10) | −14.6 | A (1) | D (8.0) | C (0.16) | C (0.14) |
| Comparative Example 3 | Carrier L | 5 | −18.9 | A (3) | C (7.1) | B (0.05) | −14.8 | A (2) | D (8.7) | D (0.24) | C (0.18) |
| Comparative Example 4 | Carrier I | 6 | −18.1 | A (3) | C (6.4) | C (0.10) | −16.2 | A (2) | C (7.5) | D (0.21) | C (0.19) |
| Example 10 | Carrier M | 4 | −51.0 | A (0) | A (3.7) | B (0.05) | −49.7 | A (0) | A (3.8) | B (0.06) | B (0.06) |
| Example 11 | Carrier N | 2 | −15.0 | B (5) | C (6.0) | C (0.10) | −12.1 | B (7) | C (7.7) | C (0.18) | C (0.19) |
| Comparative Example 5 | Carrier O | 2 | −22.9 | C (15) | A (3.9) | A (0.03) | −21.6 | D (22) | B (4.0) | A (0.04) | C (0.10) |
| Comparative Example 6 | Carrier P | 2 | −23.4 | C (19) | A (2.9) | C (0.18) | −21.0 | C (17) | A (3.1) | C (0.19) | B (0.06) |
| Comparative Example 7 | Carrier Q | 2 | −19.8 | C (17) | C (7.0) | A (0.03) | −16.5 | D (21) | C (7.8) | A (0.04) | C (0.11) |
| Comparative Example 8 | Carrier R | 2 | −24.0 | C (14) | B (4.0) | C (0.15) | −22.4 | C (15) | B (5.6) | D (0.22) | C (0.18) |
| Comparative Example 9 | Carrier S | 2 | −23.6 | C (19) | A (2.8) | C (0.18) | −22.4 | D (21) | A (3.0) | C (0.19) | B (0.05) |
| Comparative Example 10 | Carrier T | 2 | −19.8 | A (1) | D (8.0) | A (0.03) | −18.9 | A (3) | D (8.5) | B (0.05) | C (0.14) |
| Comparative Example 11 | Carrier U | 2 | −20.8 | A (3) | B (5.4) | B (0.05) | −14.5 | B (5) | C (6.7) | C (0.19) | D (0.24) |
| Comparative Example 12 | Carrier G | 7 | −25.1 | A (1) | B (4.9) | B (0.09) | −23.0 | A (3) | B (4.0) | C (0.14) | C (0.19) |
| Comparative Example 13 | Carrier G | 8 | −15.5 | A (0) | C (7.8) | B (0.08) | −13.5 | A (1) | D (8.6) | C (0.12) | B (0.05) |
| Comparative Example 14 | Carrier G | 9 | −19.6 | A (1) | C (6.1) | B (0.06) | −15.7 | A (2) | D (8.0) | C (0.10) | C (0.14) |
| Comparative Example 15 | Carrier G | 10 | −25.3 | A (1) | A (3.8) | B (0.08) | −23.6 | A (2) | C (7.4) | C (0.14) | C (0.17) |

TABLE 5

| Step | Applied voltage (V) | Electric field intensity (V/cm) | Specific resistance (Ω · cm) | Applied voltage (V) | Electric field intensity (V/cm) | Specific resistance (Ω · cm) |
|---|---|---|---|---|---|---|
| 1 | 14.4 | $1.45 \times 10^2$ | $9.77 \times 10^7$ | 76.8 | $8.35 \times 10^2$ | $2.51 \times 10^8$ |
| 2 | 28.8 | $2.91 \times 10^2$ | $3.47 \times 10^7$ | 153.6 | $1.67 \times 10^3$ | $6.34 \times 10^7$ |
| 3 | 43.2 | $4.36 \times 10^2$ | $1.62 \times 10^7$ | 230.4 | $2.50 \times 10^3$ | $2.69 \times 10^7$ |
| 4 | 57.6 | $5.82 \times 10^2$ | $7.24 \times 10^6$ | 307.2 | $3.34 \times 10^3$ | $1.05 \times 10^7$ |
| 5 | 72.0 | $7.27 \times 10^2$ | 0.00 | 384.0 | $4.17 \times 10^3$ | 0.00 |

TABLE 5-continued

| Step | Applied voltage (V) | Electric field intensity (V/cm) | Specific resistance (Ω · cm) | Applied voltage (V) | Electric field intensity (V/cm) | Specific resistance (Ω · cm) |
|---|---|---|---|---|---|---|
| 6 | 72.0 | $7.27 \times 10^2$ | 0.00 | 384.0 | $4.17 \times 10^3$ | 0.00 |
| 7 | 57.6 | $5.82 \times 10^2$ | $4.49 \times 10^6$ | 307.2 | $3.34 \times 10^3$ | $8.91 \times 10^6$ |
| 8 | 43.2 | $4.36 \times 10^2$ | $1.08 \times 10^7$ | 230.4 | $2.50 \times 10^3$ | $1.32 \times 10^7$ |
| 9 | 28.8 | $2.91 \times 10^2$ | $2.56 \times 10^7$ | 153.6 | $1.67 \times 10^3$ | $2.34 \times 10^7$ |
| 10 | 14.4 | $1.45 \times 10^2$ | $5.55 \times 10^7$ | 76.8 | $8.35 \times 10^2$ | $1.97 \times 10^8$ |
| | Example 1 core(a) | | | Example 1 carrier (A) | | |

TABLE 6

| Step | Applied voltage (V) | Electric field intensity (V/cm) | Specific resistance (Ω · cm) | Applied voltage (V) | Electric field intensity (V/cm) | Specific resistance (Ω · cm) | Applied voltage (V) | Electric field intensity (V/cm) | Specific resistance (Ω · cm) |
|---|---|---|---|---|---|---|---|---|---|
| 1 | 76.8 | $8.35 \times 10^2$ | $2.51 \times 10^8$ | 200 | $2.38 \times 10^3$ | $1.08 \times 10^{11}$ | 200 | $1.92 \times 10^3$ | $5.14 \times 10^8$ |
| 2 | 153.6 | $1.67 \times 10^3$ | $6.34 \times 10^7$ | 400 | $4.76 \times 10^3$ | $6.75 \times 10^9$ | 400 | $3.85 \times 10^3$ | $2.98 \times 10^8$ |
| 3 | 230.4 | $2.50 \times 10^3$ | $2.69 \times 10^7$ | 600 | $7.14 \times 10^3$ | $2.04 \times 10^9$ | 600 | $5.77 \times 10^3$ | $2.20 \times 10^8$ |
| 4 | 307.2 | $3.34 \times 10^3$ | $1.05 \times 10^7$ | 800 | $9.52 \times 10^3$ | $9.12 \times 10^8$ | 800 | $7.69 \times 10^3$ | $1.77 \times 10^8$ |
| 5 | 384.0 | $4.17 \times 10^3$ | 0.00 | 1,000 | $1.19 \times 10^4$ | 0.00 | 1,000 | $9.62 \times 10^3$ | $1.47 \times 10^8$ |
| 6 | 384.0 | $4.17 \times 10^3$ | 0.00 | 1,000 | $1.19 \times 10^4$ | 0.00 | 1,000 | $9.62 \times 10^3$ | $1.42 \times 10^8$ |
| 7 | 307.2 | $3.34 \times 10^3$ | $8.91 \times 10^6$ | 800 | $9.52 \times 10^3$ | $3.98 \times 10^8$ | 800 | $7.69 \times 10^3$ | $1.60 \times 10^8$ |
| 8 | 230.4 | $2.50 \times 10^3$ | $1.32 \times 10^7$ | 600 | $7.14 \times 10^3$ | $5.42 \times 10^8$ | 600 | $5.77 \times 10^3$ | $1.88 \times 10^8$ |
| 9 | 153.6 | $1.67 \times 10^3$ | $2.34 \times 10^7$ | 400 | $4.76 \times 10^3$ | $8.56 \times 10^8$ | 400 | $3.85 \times 10^3$ | $2.36 \times 10^8$ |
| 10 | 76.8 | $8.35 \times 10^2$ | $1.97 \times 10^8$ | 200 | $2.38 \times 10^3$ | $2.25 \times 10^9$ | 200 | $1.92 \times 10^3$ | $3.64 \times 10^8$ |
| | Example 1 carrier (A) | | | Example 5 carrier (E) | | | Comparative Example 2 carrier (K) | | |

The invention claimed is:

1. A two-component developer, comprising:

a magnetic carrier obtained by coating a magnetic core with a resin; and toner, wherein:

the magnetic core contains at least a ferrite component and $SiO_2$;

a ratio of a length of a longest straight line among straight lines drawable on the ferrite component observed in a reflected electron image photographed with a scanning electron microscope to a maximum diameter of the section of the magnetic core in the reflected electron image is 50% or more and 85% or less;

a content of $SiO_2$ is 4.0 mass % or more and 40.0 mass % or less with respect to the magnetic core;

the magnetic core has a specific resistance of $5.0 \times 10^4$ Ω·cm or more and $5.0 \times 10^8$ Ω·cm or less at a time of application of 1,000 V/cm under the following measurement conditions;

the magnetic carrier has an intensity of magnetization in 79.6 kA/m of 40.0 $Am^2$/kg or more and 65.0 $Am^2$/kg or less, and a residual magnetization after application of an external magnetic field of 79.6 kA/m of 3.0 $Am^2$/kg or less; and the toner has a weight-average particle diameter (D4) of 3.0 μm or more and 10.0 μm or less and an average circularity of 0.940 or more and 0.990 or less:

measurement conditions:

upper and lower portions in a cylindrical resin container having a measuring space with a sectional area of 2.4 $cm^2$ are provided with upper and lower electrodes each having a measuring surface identical in shape to a sectional shape of the measuring space, 0.7 g of the magnetic core is loaded into a gap between the upper and lower electrodes, and the loaded magnetic core is subjected to measurement while being sandwiched between the upper and lower electrodes at a pressure of 50 g/$cm^2$.

2. A two-component developer according to claim 1, wherein a total amount of sectional areas of $SiO_2$ accounts for 2% or more and 35% or less with reference to an area of the section of the magnetic core.

3. A two-component developer according to claim 1, wherein the magnetic core contains void portions in its section, and a total sum of sectional areas of the void portions accounts for 2% or more and 15% or less with reference to an area of the section of the magnetic core.

4. A two-component developer according to claim 1, wherein the ferrite component of the magnetic core contains at least an Mn atom.

5. A two-component developer according to claim 1, wherein the magnetic carrier has an apparent density of 1.55 g/$cm^3$ or more and 1.90 g/$cm^3$ or less.

6. A two-component developer according to claim 1, wherein the ratio of the maximum length of each of the connecting phases to the maximum diameter of the section of the magnetic core is 50% or more and 85% or less.

7. A two-component developer according to claim 1, wherein the resin for coating the magnetic core comprises a resin containing a copolymer using at least a monomer having a structure represented by the following formula (A1) and a macromonomer having a structure represented by the following formula (A2) as copolymerization components:

[Chem 1]

(A1)

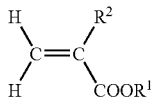

where $R^1$ represents a hydrocarbon group having 4 or more carbon atoms, and $R^2$ represents H or $CH_3$,

[Chem 2]

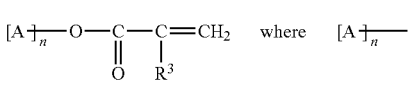

(A2)

represents a polymer unit having a weight-average molecular weight of 3,000 or more and 10,000 or less, $R^3$ represents H or $CH_3$, and n represents a number of repetitions which is a positive integer.

8. A two-component developer according to claim 1, wherein an electric field intensity at which the magnetic carrier comes close to undergo breakdown is 1,300 V/cm or more and 6,500 V/cm or less.

9. A two-component developer according to claim 1, wherein an absolute value of a triboelectric charge quantity of the toner measured by a two-component method using the toner and the magnetic carrier is 40.0 mC/kg or more and 80.0 mC/kg or less.

* * * * *